US006976598B2

(12) United States Patent
Engel

(10) Patent No.: US 6,976,598 B2
(45) Date of Patent: Dec. 20, 2005

(54) SHELVING SYSTEM

(76) Inventor: Zackary Engel, 301E 79th St., Apt. 11C, New York, NY (US) 10021

( * ) Notice: Subject to any disclaimer, the term of this patent is extended or adjusted under 35 U.S.C. 154(b) by 14 days.

(21) Appl. No.: 10/371,719

(22) Filed: Feb. 21, 2003

(65) Prior Publication Data

US 2003/0189021 A1 Oct. 9, 2003

Related U.S. Application Data

(60) Provisional application No. 60/359,037, filed on Feb. 21, 2002, provisional application No. 60/391,381, filed on Jun. 26, 2002, provisional application No. 60/418,270, filed on Oct. 14, 2002.

(51) Int. Cl.[7] ..... A47F 5/00
(52) U.S. Cl. ..... 211/187; 211/175
(58) Field of Search ..... 211/187, 175, 151, 211/90.02, 209, 207; 108/107, 108; 248/241, 248/244

(56) References Cited

U.S. PATENT DOCUMENTS

| | | | | |
|---|---|---|---|---|
| 4,056,196 | A * | 11/1977 | Brauning | 211/207 |
| 4,070,072 | A * | 1/1978 | Skaller | 312/71 |
| 4,307,671 | A | 12/1981 | Albano | |
| 4,620,489 | A | 11/1986 | Albano | |
| 4,651,652 | A | 3/1987 | Wyckoff | |
| 4,919,282 | A * | 4/1990 | Duff et al. | 211/134 |
| 5,531,168 | A * | 7/1996 | Towfigh | 108/108 |
| 5,799,588 | A | 9/1998 | Engel | |
| 5,950,846 | A | 9/1999 | Duane | |
| 5,970,887 | A | 10/1999 | Hardy | |
| 6,065,821 | A | 5/2000 | Anderson et al. | |
| 6,112,913 | A | 9/2000 | Rindoks et al. | |
| 6,138,583 | A * | 10/2000 | Mahone et al. | 108/108 |
| 6,164,610 | A | 12/2000 | Santiago | |
| 6,422,399 | B1 * | 7/2002 | Castillo et al. | 211/26 |
| 2003/0168951 | A1 * | 9/2003 | Holbrook et al. | 312/245 |

FOREIGN PATENT DOCUMENTS

| | | |
|---|---|---|
| DE | 29818420 | 1/1999 |
| GB | 1193859 | 6/1970 |

* cited by examiner

*Primary Examiner*—Jennifer E. Novosad
(74) *Attorney, Agent, or Firm*—McCarter & English, LLP

(57) ABSTRACT

The present disclosure provides enhanced storage systems that facilitate efficient storage of, and access to, a variety of items and products. Exemplary systems according to the present disclosure include Mechanisms that permit reliable and efficient repositioning of one or more shelves, thereby enhancing utilization and efficiencies associated therewith. Shelving systems facilitate synchronized vertical motion of shelving units, e.g., based on coordinated pulley/cable systems, and advantageously include spring designs that facilitate controlled vertical motion of shelving units, e.g., based on fluid movement and/or discharge from the spring design. Shelves and/or shelving units may be readily repositioned at elbow or eye level, and repositioned at their respective initial positions in an efficient and advantageous manner. The shelving systems may be original manufacture units or may be designed for use in retrofitting existing shelving systems.

36 Claims, 35 Drawing Sheets

SHELVING SYSTEM

CROSS-REFERENCE TO RELATED APPLICATIONS

The present application claims the benefit of three co-pending and commonly assigned provisional patent applications, as follows: U.S. Provisional Patent Application Ser. No. 60/359,037, filed Feb. 21, 2002 and entitled "Storage System;" U.S. Provisional Patent Application Ser. No. 60/391,381, filed Jun. 26, 2002 and entitled "Two-Dimensions Slides;" and U.S. Provisional Patent Application Ser. No. 60/418,270, filed Oct. 14, 2002 and entitled "Two-Dimensions Spring." The entire contents of the foregoing three provisional patent applications are hereby incorporated by reference.

BACKGROUND OF THE DISCLOSURE

1. Technical Field

The present disclosure relates to enhanced storage systems, and more particularly to storage systems that facilitate efficient storage of, and access to, a variety of items and products. Exemplary systems according to the present disclosure include mechanism(s) that permit reliable and efficient repositioning of one or more shelves, thereby enhancing utilization and efficiencies associated therewith.

2. Background Art

Shelves and shelf systems are widely used for displaying and storing items. Sometimes shelves are contained within cabinets, armoires, closets, etc., while in other applications, e.g., supermarket and book shelves, the shelving units are free-standing and are constructed to facilitate access to items stored thereon. In designing shelving systems, designers must ensure system stability while, to the extent possible, providing efficient access to stored items.

The height to which a stack of shelves can extend is typically limited by the reach of a person of average size. Alternatively, in some cases upper shelves are positioned out of the reach of users and various tools are provided to permit access to the contents of upper shelves. For example, users may be provided with tools that include footstools, stepladders, reach poles, etc. The use of such tools, however, can be inefficient and, in some cases, can contribute to dangerous conditions. For example, people may be injured from falls off of stepladders and/or footstools. Likewise, the use of reach poles can result in inadvertent knocking and/or dislodging of the desired item or an adjacent item from the shelf. In such circumstances, item(s) may be broken or, worse yet, item(s) may fall from the upper shelf, potentially striking and injuring the person using the reach pole or another person in the vicinity thereof. In addition, such tools are typically a nuisance to have about, can lead to injuries merely by tripping a person, and are frequently misplaced or not readily available for use.

In the past, efforts have been directed to providing moveable shelves to address the problems associated with fixedly positioned shelves. Examples of previous efforts directed to developing enhanced shelving systems, which are disclosed in the patent literature include the following U.S. patents.

Ochse, U.S. Pat. No. 1,940,877, discloses extension shelving for display cabinets wherein the shelving may be drawn out of the display cabinet by means of tracks and rollers, and the shelves may be tilted to assume a rearward ascending step-wise arrangement, the lowermost shelf extending forward of the cabinet and the upper shelves.

Snyder, U.S. Pat. No. 3,640,389, discloses a display stand and expandable shelf for use thereon. The Snyder '389 system includes a base and a pair of upright shelf supports. The components of the system are slidably engageable with each other and conventional fastening means are not required for assembly. Additionally, the shelves include a portion (80) that can be extended vertically upward from the remainder of the shelf (70) to form a step, and other portion(s) (90 and 96) can be extended horizontally outward from the shelf to form a wider shelf (again having a step).

Brauning, U.S. Pat. No. 4,056,196, discloses a supporting framework for shelves including crosspieces interconnected with uprights. The cross pieces can ride up and down the uprights and, when positioned in a desired location, can be locked into place by a locking mechanism.

Wyckoff, U.S. Pat. No. 4,651,652, discloses a vertically adjustable work desk that is raised by a force applied by a lockable gas spring via a first pulley system. A second pulley system insures that all areas of the work surface are equally raised.

Duff et al., U.S. Pat. No. 4,919,282, discloses movable gondola shelving for merchandise display having a rolling base that supports channeled uprights and a center panel. Cantilevered shelves are interconnected with the channeled uprights by means of cam assemblies at the rear corners of the shelves. The cam assemblies allow for the shelves to be vertically adjusted while the shelves are maintained in a level position.

Bustos, U.S. Pat. No. 5,014,862, discloses an assembly for a cantilevered display header for a gondola display rack that includes two uprights braced to the gondola display rack in vertical spaced relation. The header, which defines a light box that can receive a sign for illumination thereof, is mounted separately from the shelf and is vertically moveable with respect thereto for adjusting the height of the header with respect to the shelf.

Duane, U.S. Pat. No. 5,950,846, discloses a storage rack that includes vertically and horizontally moveable supports. The storage rack includes plural spaced horizontal supports for vertical motion. Vertical movement of the rack is powered by one or more hydraulic cylinders carried in the vertical support columns, and an associated control mechanism that allows adjustable vertical positioning of the rack. Horizontal supports of a compound nature are disclosed which permit lateral extension to expose material carried on the support element.

Hardy, U.S. Pat. No. 5,970,887, discloses an extendable shelf assembly that includes extender bars having slots and a cooperating pair of rotatable sprockets that are affixed to an axle. The sprockets include a plurality of teeth that engage the slots of the extender bars.

Anderson et al., U.S. Pat. No. 6,065,821, discloses a vertically adjustable shelf and support rail arrangement for use in a cabinet. The shelf arrangement includes a pair of rotatably mounted rear sprocket members and a driving mechanism for rotating the sprockets to vertically adjust the shelf within the cabinet. The driving mechanism can be manually or electrically powered, and the adjustable shelf may include elements that ensure that the sprockets are not disengaged from the rails while the shelf is within the cabinet.

Rindoks et al., U.S. Pat. No. 6,112,913, discloses a support arrangement for a furniture system that includes a support assembly having a pair of standards which extend vertically in spaced relate. Each of the standards includes two rows of openings extending vertically in spaced relation. A first support member may be detachably mounted in a pair of outermost rows of openings, and a second support may be detachably mounted in a pair of innermost rows of openings.

Santiago, U.S. Pat. No. 6,164,610, discloses a cantilever shelf support system wherein the disclosed bracket includes a plurality of forwardly projecting cantilevered male members for insertion into mating female apertures formed in the shelf.

In addition to the prior art efforts discussed above, the present inventor has previously disclosed advantageous shelving systems. In particular, U.S. Pat. No. 5,799,588 to Engel discloses advantageous shelving systems wherein shelves are provided in a stack arrangement mounted to two or more uprights. The uprights include one or more shelf support members which support the shelves. One or more of the shelves are movable out from the shelf stack, either by way of a telescoping support member, or otherwise, to permit movement of such shelf or shelves to or past a lower shelf. After an upper shelf or shelves are moved vertically past a lower shelf, the upper shelf or shelves can be moved back into alignment with the lower shelf. In this arrangement, the upper shelf or shelves may be positioned below the lower shelf to permit easy access to the upper shelf or shelves (and their contents).

Despite these prior art efforts, a need remains for enhanced shelving system designs that are stable in construction and that facilitate access to items stored thereon. These and other objectives are satisfied by the enhanced shelving systems disclosed herein, as will be apparent from the detailed description, which follows.

SUMMARY OF THE DISCLOSURE

These and other objects are achieved by the shelf system of the present invention, which includes two or more shelves in a stack arrangement mounted to uprights. The uprights include one or more shelf support members which support the shelves. One or more of the shelves are movable out from the shelf stack, either by way of a telescoping support member, or otherwise, to permit movement of such shelf or shelves to or past a lower shelf. The movable stack of shelves are generally connected such that outward movement of one shelf effects a corresponding movement of the other shelf (or shelves). After an upper shelf or shelves are moved vertically to or past a lower shelf, the upper shelf or shelves may be moved back into alignment with the lower shelf. In this arrangement, the upper shelf or shelves can thereby become positioned below the lower shelf. This permits easy access to the upper shelf or shelves.

In preferred embodiments of the present disclosure, a shelf/shelving unit that is moved to a "higher" or "upper" position, as described above, may be telescoped horizontally outward and moved past the "lower" shelves to again reverse position. In other words, the shelves/shelving units may be repeatedly moved past each other, with the shelf/shelving unit in the "upper" (or the "lower") position being the shelf/shelving unit that is moved horizontally outward to create vertical clearance relative to the other shelf/shelving unit. Thus, the shelves/shelving unit positions may be repeatedly reversed in an efficient and reliable manner.

Vertical movement of the upper shelves and the lower shelf can be facilitated through a pulley arrangement whereby the upper shelf and the lower shelf are interconnected and constrained to move together in opposite directions. Alternative structures and/or mechanisms may be used to effect shelf movement, e.g., motorized mechanisms and/or bar systems. Also, rollers may be used to facilitate such movement of the shelves. Accordingly, movement of one roller corresponding to an upper shelf causes a corresponding opposite movement of another roller corresponding to a lower shelf, and thereby, movement of one shelf causes a corresponding opposite movement of the other shelf. Alternatively, integral tracks may be formed in the shelving system to guide the movement of upper shelves out from the stack, to or past a lower shelf, and back into position with the stack of shelves. Importantly, an upper shelf can be moved down the stack to take the place of a lower shelf so that the upper shelf can be accessed.

According to the present invention, numerous improved and advantageous shelving systems and shelving system components are disclosed, including:

1. Shelving systems (referred to as "Patanosta" shelving systems, Madafim, Inc.). may be provided whereby repeated repositioning of shelves/shelving units is effected by outward horizontal motion of the shelf/shelving unit then located in the "upper" position. Thus, it is not always the same shelf/shelving unit that is moved outward to create the desired clearance, but rather the shelf/shelving unit located in the same relative vertical position that is moved outward to create such clearance. The same advantageous result may be achieved according to the present disclosure by repeatedly manipulating the shelf/shelving unit located in the "lower" position, if desired. Advantageous mechanisms and structural arrangements facilitating such relative motion of the shelves/shelving units are disclosed herein.
2. Advantageous spring systems that advantageously permit repositioning of the shelves/shelving units are disclosed, such spring systems advantageously dampening motion of the shelves/shelving units. Preferred spring systems control fluid/airflow to achieve the advantageous results described herein
3. Advantageous ceiling height systems are disclosed that allow a stack of shelves to trade places with another stack of shelves, and further permit, within each shelving stack, shelves may be repositioned with respect to other shelves within the stack.
4. Advantageous shelving systems include various upright support arrangements, e.g., designs wherein different numbers and combinations of shelf supports are employed to permit vertical repositioning of the shelves/shelving units.
5. Advantageous shelving systems are provided that include a "mobile arm," i.e., an arm or set of arms that travel up and down relative to upright system supports. The mobile arm is adapted to pick any chosen storage area and transport the selected storage area to the desired level, e.g., elbow or eye level. Once use of the storage area at elbow/eye level is complete, the mobile arm may be advantageously used to transport the storage area to its original location. The process may be controlled by motor, processor and software, by motor and gears, and/or by manual selection.
6. Advantageous shelving systems are provided that include one or more "split shelve" that facilitate vertical repositioning of shelves/shelving units, e.g., in European cabinet designs where a bar or face board is typically centrally positioned in the cabinet opening.

7. Advantageous shelving systems are provided that facilitate safe usage of storage areas by children and/or handicapped people, including wheelchair bound people.

These and other structural aspects, features and functionalities of the advantageous shelving systems of the present disclosure will become more readily apparent to those having ordinary skill in the art from the following detailed description of exemplary embodiments taken in conjunction with the drawings appended hereto.

BRIEF DESCRIPTION OF THE DRAWINGS

So that those having ordinary skill in the art to which the disclosed shelving systems appertain will more readily understand how to make and use the same, reference may be had to the appended drawings, wherein.

DETAILED DESCRIPTION OF EXEMPLARY EMBODIMENT(S)

Figure 1:
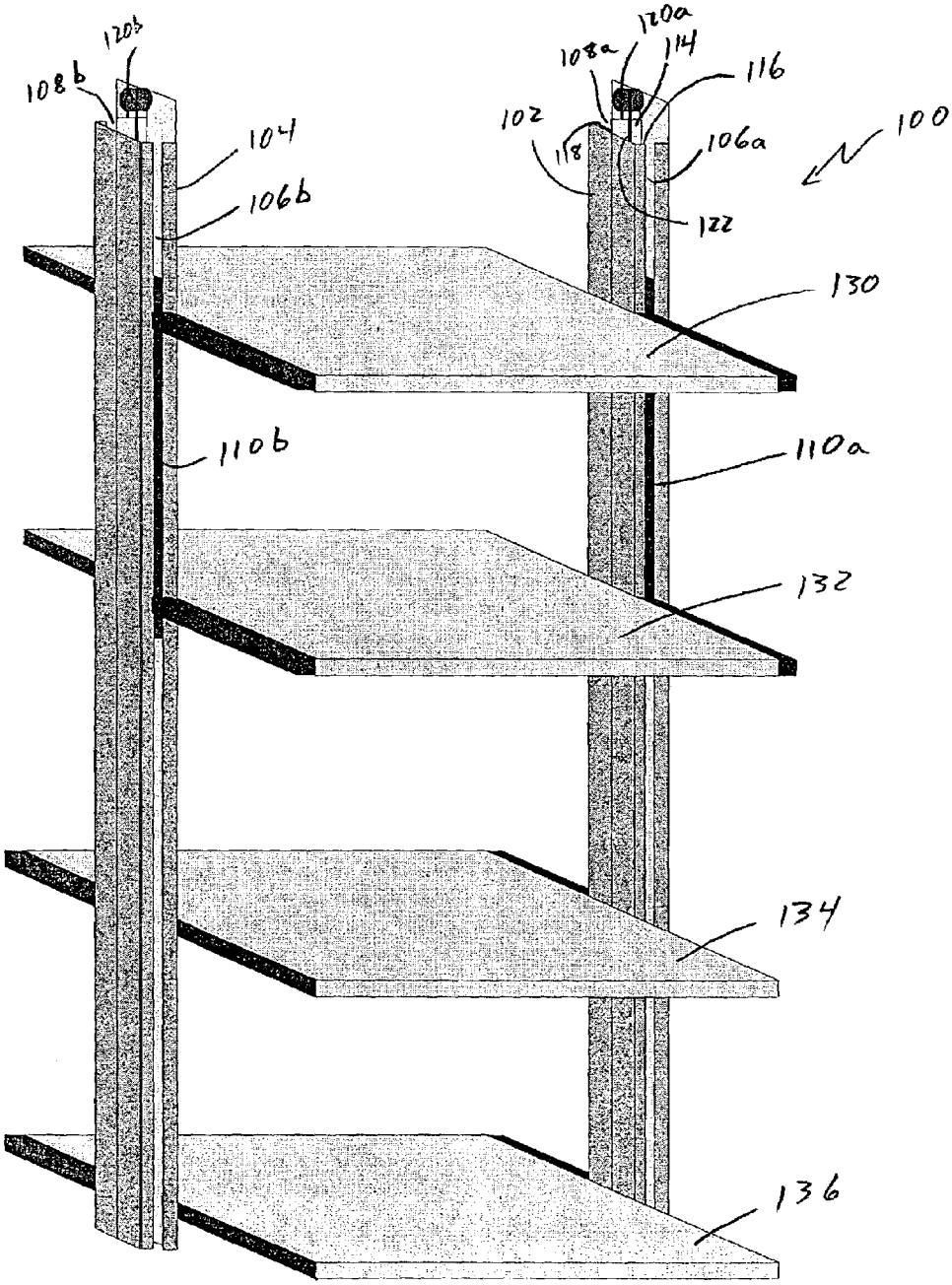
FIG. 1 is a perspective schematic view, partially cut-away, of an exemplary shelving system according to the present disclosure.

The present disclosure provides enhanced storage systems (commercially available as Storage Switching Systems™, Madafim, Inc.) and, more particularly, storage systems that facilitate efficient storage of, and access to, a variety of items and products. The disclosed shelving systems permit reliable and efficient repositioning of one or more shelves relative to upright supports, thereby enhancing utilization and efficiencies associated therewith. The disclosed shelving systems offer a stable, flexible construction that enhance safety for system users and significant economic benefits through cost-effective use of storage space.

Importantly, the shelving systems of the present disclosure are susceptible to wide ranging applications. For example, the disclosed shelving systems may be advantageously employed in free-standing shelving systems, e.g., shelving systems for use in commercial or domestic applications such as retail product displays, warehouse storage, electronic and telecommunication equipment storage, garage and attic storage, food storage, etc. Moreover, the disclosed shelving systems may be advantageously employed within enclosures, e.g., within armoires, closets, storage bins, freezers, refrigerators, kitchen cabinetry and the like. In addition, the disclosed "shelves" may take a variety of forms without departing from the spirit and/or scope of the present disclosure. For example, the exemplary "shelves" disclosed herein may alternatively take the form of hanging rods, drawers, bins and the like. Additionally, the disclosed shelving systems may be manufactured and/or distributed as free-standing, independent units or as components for use in retrofitting existing shelving unit(s) and/or shelving system(s). Thus, as used herein, the terms "shelf," "shelves," "shelving system" and "shelving systems" are intended to broadly encompass shelving/storage applications wherein storage is achieved through vertically spaced storage elements and wherein efficiencies and/or benefits may be achieved through vertical repositioning of such storage elements.

In describing individual structural components associated with exemplary shelving systems according to the present disclosure, elements that are structurally identical may be identified with an alphanumeric designation. In such circumstances, it is to be understood that the disclosed elements are structurally identical (subject to manufacturing tolerances and the like) in the disclosed exemplary embodiment, and that the element may be thereafter generically referenced in the subsequent narrative using only the common numeric designation. For example, structurally identical elements 10*a* and 10*b* may be generically referred to as element or elements 10. When referenced using only the numeric designation, it is to be understood that the narrative is referencing all elements that share the same numeric designation within respective alphanumeric designations.

With reference to the enclosed figures, which depict exemplary embodiments of shelving systems according to the present disclosure, reference is initially made to the exemplary shelving system 100 that is schematically depicted in FIGS. 1–6. Shelving system 100 includes upright supports 102, 104 which generally assume a substantially vertical orientation. Upright supports 102, 104 are typically of identical construction, i.e., upright supports 102, 104 may be used interchangeably. Upright supports 102, 104 may include telescopic functionality so that the disclosed shelving system can be adjusted to different sizes, e.g., based on available storage space, etc. For purposes of exemplary shelving system 100, upright supports 102, 104 have a substantially rectangular cross-section that is substantially uniform from a lower end to an upper end thereof. Thus, exemplary upright supports 102, 104 define "box-like" beams, and may be advantageously detachably mounted to surrounding structure(s), e.g., walls, cabinetry, adjacent shelving supports, etc. However, alternative cross-sectional configurations are contemplated, e.g., cross-sections that are, in whole or in part, elliptical, trapezoidal, etc., as may be desired to achieve aesthetic effects and/or to accommodate external considerations, e.g., space constraints or manufacturing efficiencies. Upright support designs featuring non-uniform cross-sections are also contemplated, e.g., wherein a greater cross-sectional area is defined at the "base" of the upright support relative to the "top" of the upright support, thereby providing potentially enhanced stability to exemplary storage systems of the present disclosure.

Upright support 102 defines first elongated slot 106*a* and second elongated slot 108*a*. Similarly, upright support 104 defines first elongated slot 106*b* and second elongated slot 108*b*. The dimensional characteristics of the first and second elongated slots defined for each upright support are generally identical, i.e., the first and second elongated slots 106, 108 typically have the same width and length/height. Elongated slots 106, 108 are sized and dimensioned to accommodate vertical movement of shelf support members 110*a*, 110*b*, 112*a*, 112*b*, as described in greater detail below, while ensuring structural stability/integrity of the upright support. Indeed, as discussed below, the shelf support members typically include wheels, ball bearing systems or the like, to facilitate vertical movements thereof. First and second elongated slots 106, 108 are typically aligned on the upright support; thus, if viewed from the front or rear, first and second elongated slots are generally in substantial registry.

Of note, it is contemplated according to the present disclosure that the shelf support members may be externally mounted on upright supports 102, 104, thereby obviating the need for slots 106, 108. In an externally mounted design according to the present disclosure, the shelf support members are adapted for vertical movement relative to the upright supports, and motion of the shelf support members may be guided by rails or tracks formed in the outer walls of the upright supports. Further structural details related to implementation of externally mounted shelf support members will be apparent to persons skilled in the art from the detailed description contained herein.

Figure 5:
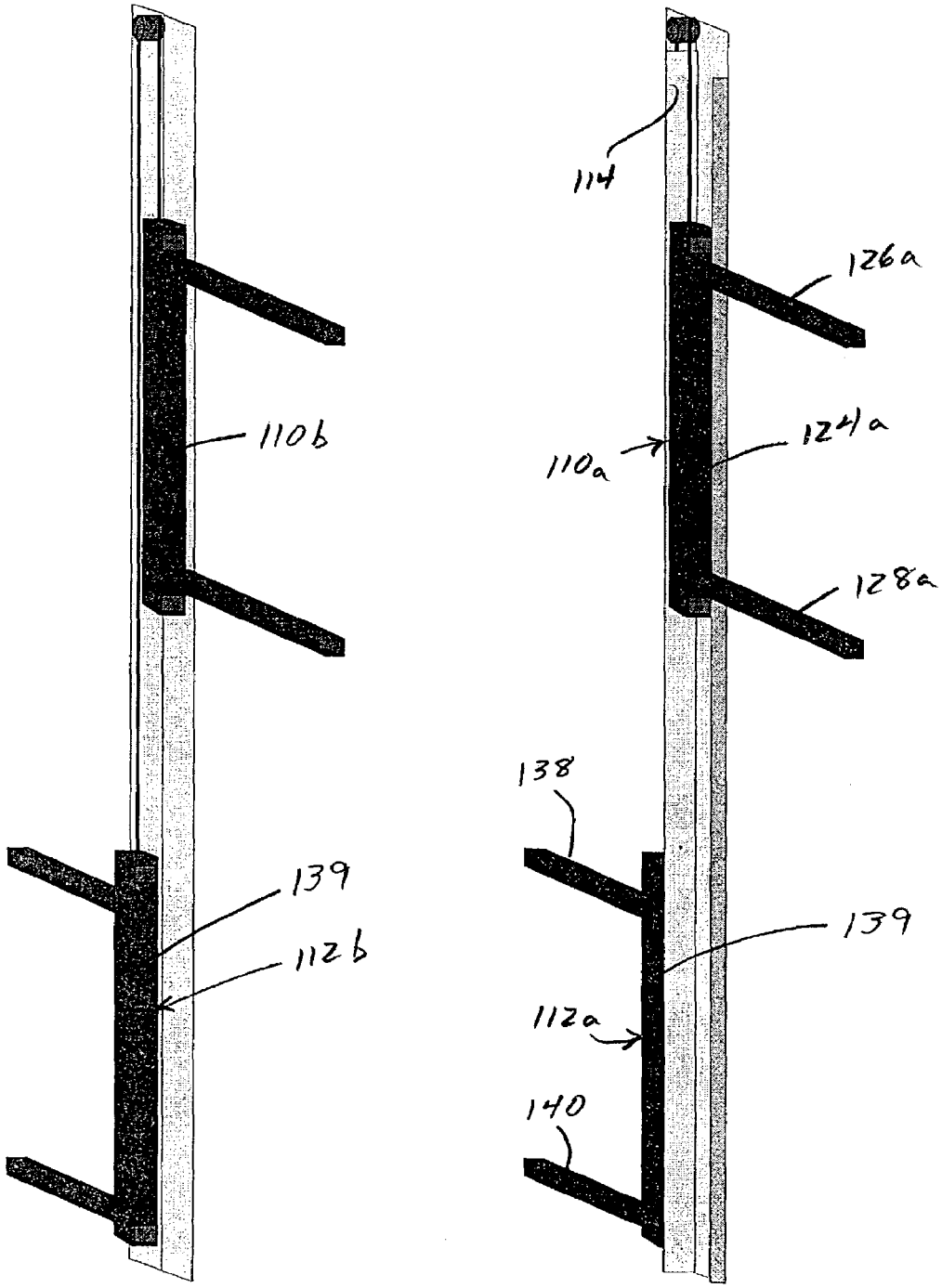
FIG. 5 is a perspective schematic view of structural aspects of the exemplary shelving system of FIG. 1.

As schematically depicted in FIG. 5, upright support 102 includes a transverse truss or web 114 that extends between respective sidewalls thereof to impart strength and stability to upright support 102 and to shelving system 100. A corresponding truss is generally provided within upright support 104. Truss 114 typically bisects the side walls of upright support 102. In cooperation with the side walls and front face of upright support 102, truss 114 thus defines a pair of substantially enclosed channels 116, 118 within upright support 102. The substantially enclosed channels 116, 118 open to the exterior by way of elongated channels 106*a*, 108*a*, respectively. Channels 116, 118 are sized and dimensioned to permit axial movement of shelf support members 110*a*, 112*a*, respectively, and to prevent binding of shelf support members 110*a*, 112*a* therewithin. Channels 116, 118 typically exhibit substantially square or rectangular cross-sections of substantially equivalent cross-sectional area, although alternative geometries and relative dimensional characteristics are contemplated, provided such alternatives function to effectively capture and guide the movement of associated shelf support members.

Figure 19:
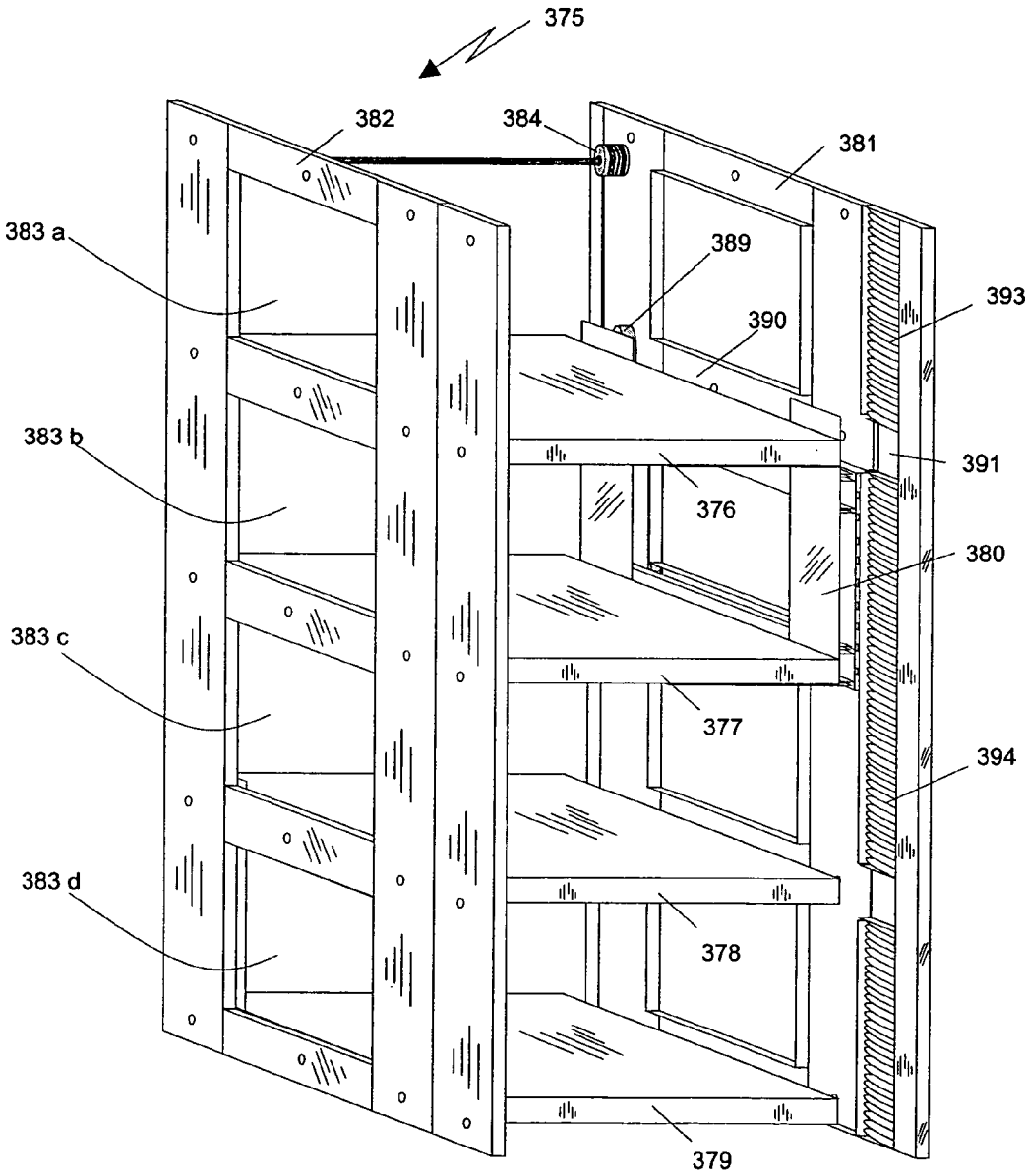
FIG. 19 is a perspective schematic view, partially cut-away, of structural aspects of a fifth exemplary shelving system according to the present disclosure.
Figure 20:
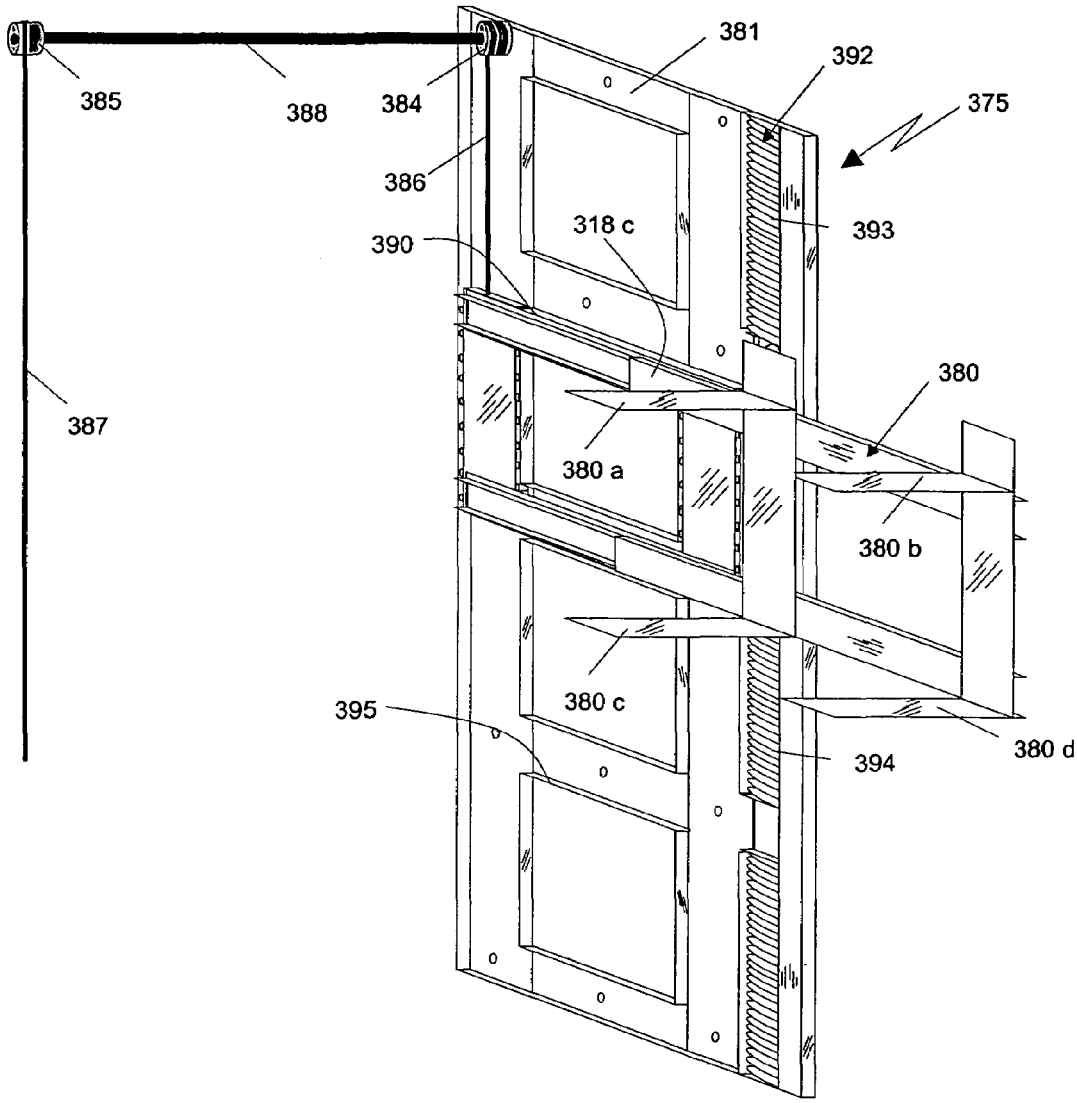
FIGS. 20–23 are cut-away perspective views of structural aspects of the fifth exemplary embodiment of FIG. 19.
Figure 21:
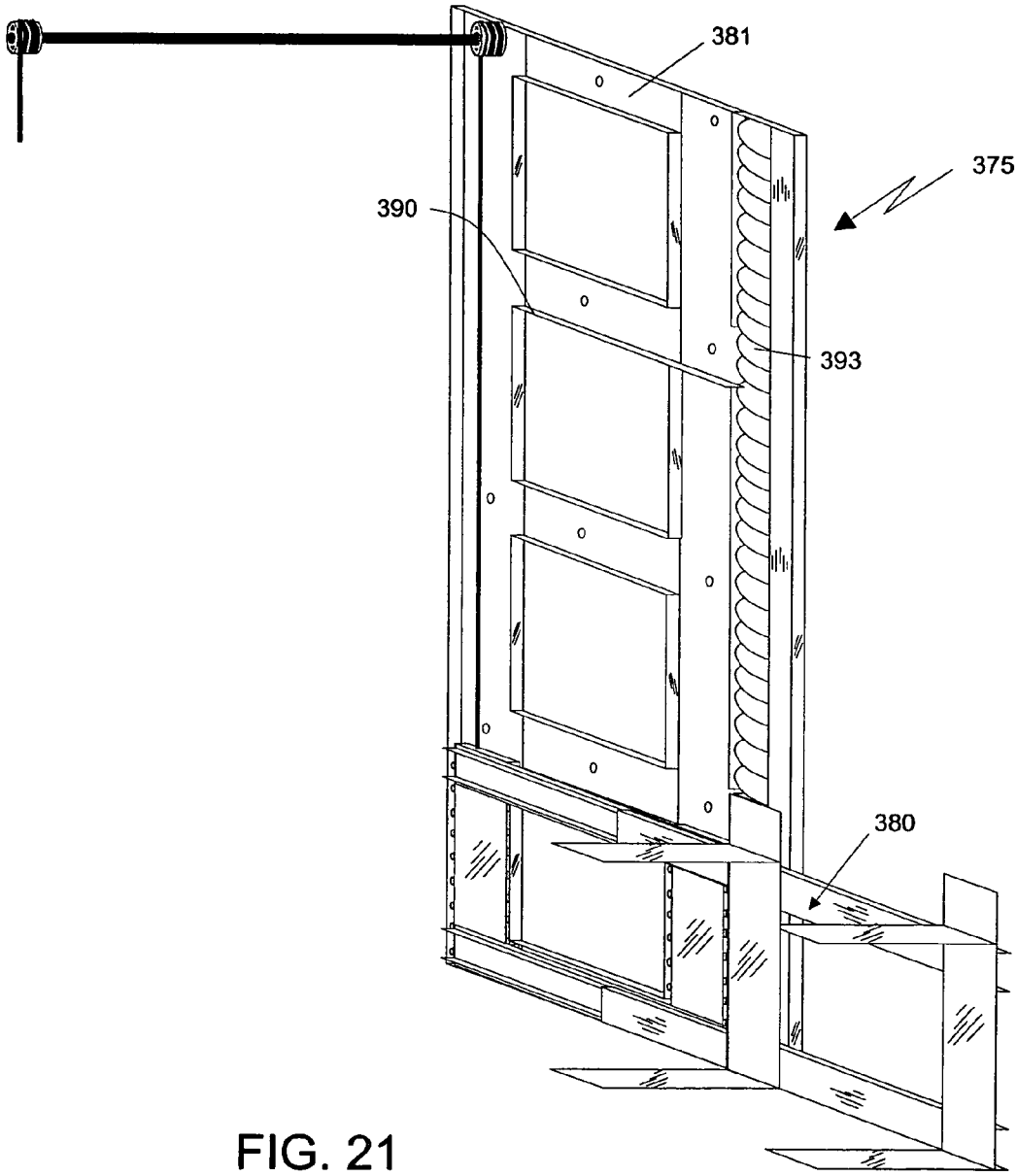

Pulleys 120*a*, 120*b* are mounted relative to upright supports 102, 104, e.g., relative to one or both side walls thereof. To prevent the shelves from tilting to the side, the pulley wheels may be advantageously connected to each other by a rod or other connecting structure. A connecting structure extending between the spaced pulley wheels, e.g., a metal rod as shown with reference to the alternative exemplary embodiment(s) of FIGS. 17, 19 and 20, synchronize the rotation of the respective pulley wheels. Of note, the pulley wheel and pulley line/cable disclosed herein may take the form of a spiked wheel and chain according to the present disclosure.

The pulleys are typically mounted at a midpoint of the side wall(s), e.g., directly above a centrally located truss. The mounting of pulleys 120*a*, 120*b* is effected so as to facilitate rotational motion thereof, e.g., rotational motion relative to a centrally positioned axle, as is known in the art. A cable, wire or other flexible member 122*a*, 122*b* is mounted at one end to a first shelf support member 110*a*,

110*b* and at the other end to a second shelf support member 112*a*, 112*b*. Cable 122*a*, 122*b* extends partially around pulley 120*a*, 120*b*, such that axial movement of first shelf support member 110*a*, 110*b* relative to upright support 102, 104 effects an equal and opposite axial movement of second shelf support member 112*a*, 112*b*. The manner in which cable 122*a*, 122*b* is mounted to respective shelf support members is not critical and a variety of mounting mechanisms are contemplated, e.g., by welding, conventional coupling, crimping and/or clamping mechanisms, and the like.

Pulleys 120*a*, 120*b* facilitate efficient and reliable translation of motion between respective first and second shelf support members. Thus, substantially unimpeded rotation of pulleys 120*a*, 120*b* is desired. Alternative mechanisms for translation of motion are contemplated. For example, gearing mechanisms and/or rack-and-pinion mechanisms may be employed to translate axial motion between first and second shelf support members, as will be readily apparent to persons skilled in the art.

With further reference to FIG. 5, exemplary shelf support members 110*a*, 110*b*, 112*a*, 112*b* define a substantially U-shaped or π-shaped configuration. The shelf support members may be fabricated, for example, by attaching two pairs of horizontal slides (see elements 102, 104) to two pairs of vertical slides (see elements 126*a*, 128*a*). In exemplary embodiments of the present disclosure, shelf support members 110*a*, 110*b* have substantially identical structural features and dimensions (subject to manufacturing tolerances and the like), and shelf support members 112*a*, 112*b* have substantially identical structural features and dimensions (subject to manufacturing tolerances and the like). Thus, with particular reference to shelf support member 110*a*, the U-shaped or reshaped configuration is defined by a support leg 124*a* positioned or captured within channel 116 and a plurality of support arms 126*a*, 128*a* that extend through elongated slot 106*a* to support first shelves 130, 132, respectively. Alternative structural arrangements may be employed to achieve the functional properties described herein. For example, the shelf support members may take the form of slides that are directly mounted (e.g., by welding) onto support legs, thereby simplifying the structural configuration thereof.

In the exemplary embodiment of FIGS. 1–5, shelf support member 110*a* include a pair of support arms 126*a*, 128*a*. However, it is contemplated according to the present disclosure that greater numbers of support arms may extend from individual support legs 124, e.g., three, four or more, to provide greater repositionable storage capacity according to the present disclosure. In preferred embodiments of the present disclosure, the number of support arms extending from shelf support members that are joined by a cable 122 are equal, although an unequal number of support arms (and shelves) may be implemented if spacing considerations are addressed, as discussed below.

Figure 2:
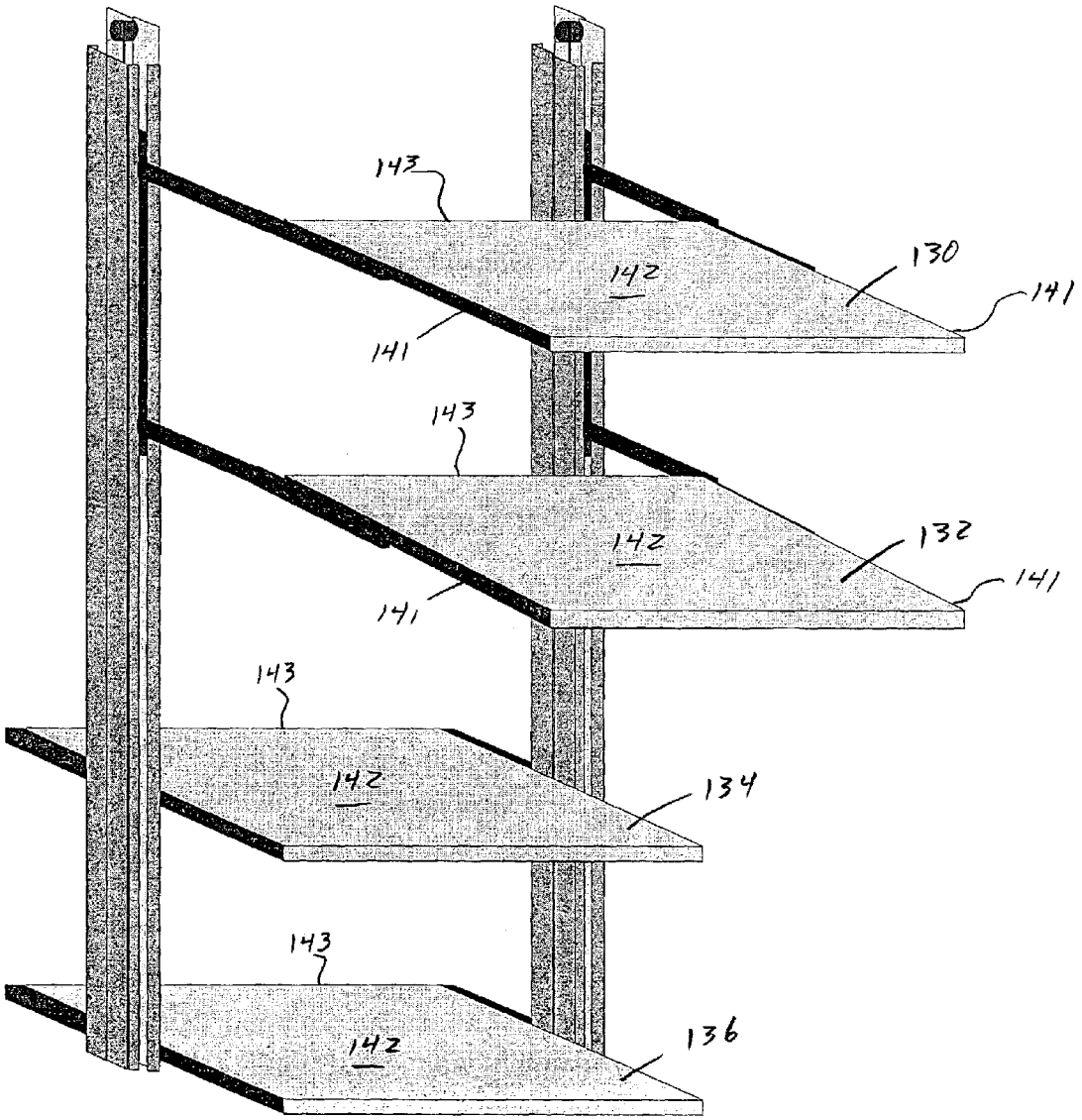
FIG. 2 is a perspective schematic view, partially cut-away, of the exemplary shelving system of FIG. 1, showing horizontal movement of a first set of shelves relative to upright supports thereof.
Figure 3:
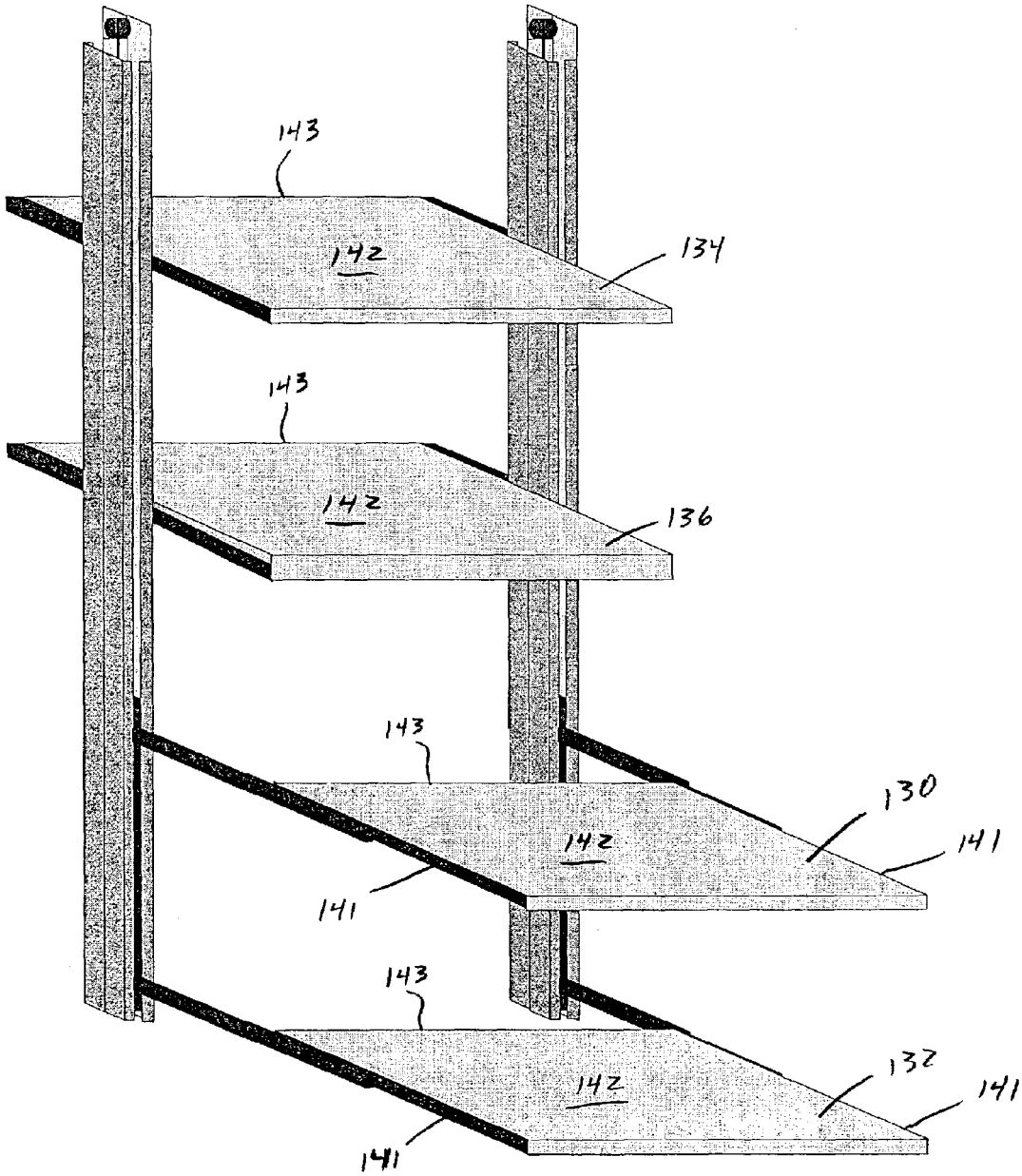
FIG. 3 is a perspective schematic view, partially cut-away, of the exemplary shelving system of FIG. 1, showing vertical movement of first and second sets of shelves relative to upright supports thereof.

As shown in the exemplary embodiments of FIGS. 1–4, shelving system 100 includes first shelves 130, 132 and second shelves 134, 136. The first and second shelves generally include sides 141, upper surfaces 142 and inner edges 143. As will hereinafter be described, first shelves 130, 132 may be advantageously repositioned, as a unit, relative to second shelves 134, 136. In the circumstance where first shelves 130, 132 are positioned above second shelves 134, 136 (as shown in FIGS. 1–2), repositioning of the first shelves relative to the second shelves permits the first shelves to be accessible to users at a lower position, and places second shelves at a higher level that may desirably be closer to "eye-level" and/or "elbow-level." Thus, repositioning of the first and second sets of shelves according to the present disclosure may be undertaken for a variety of advantageous reasons.

According to exemplary embodiments of the present disclosure, axial motion imparted to the first shelves is automatically translated to an opposite axial motion for the second shelves (and vice versa), based on the operation of the pulley/cable mechanism. Thus, as the first shelves 130, 132 are lowered past the second shelves 134, 136, the second shelves 134, 136 are automatically raised past the first shelves 130, 132 to effectively trade positions therewith. Thereafter, the first shelves 130, 132 can be raised up, and the second shelves 134, 136 lowered, such that the first and second sets of shelves are returned to their original relative positions.

Figure 6:
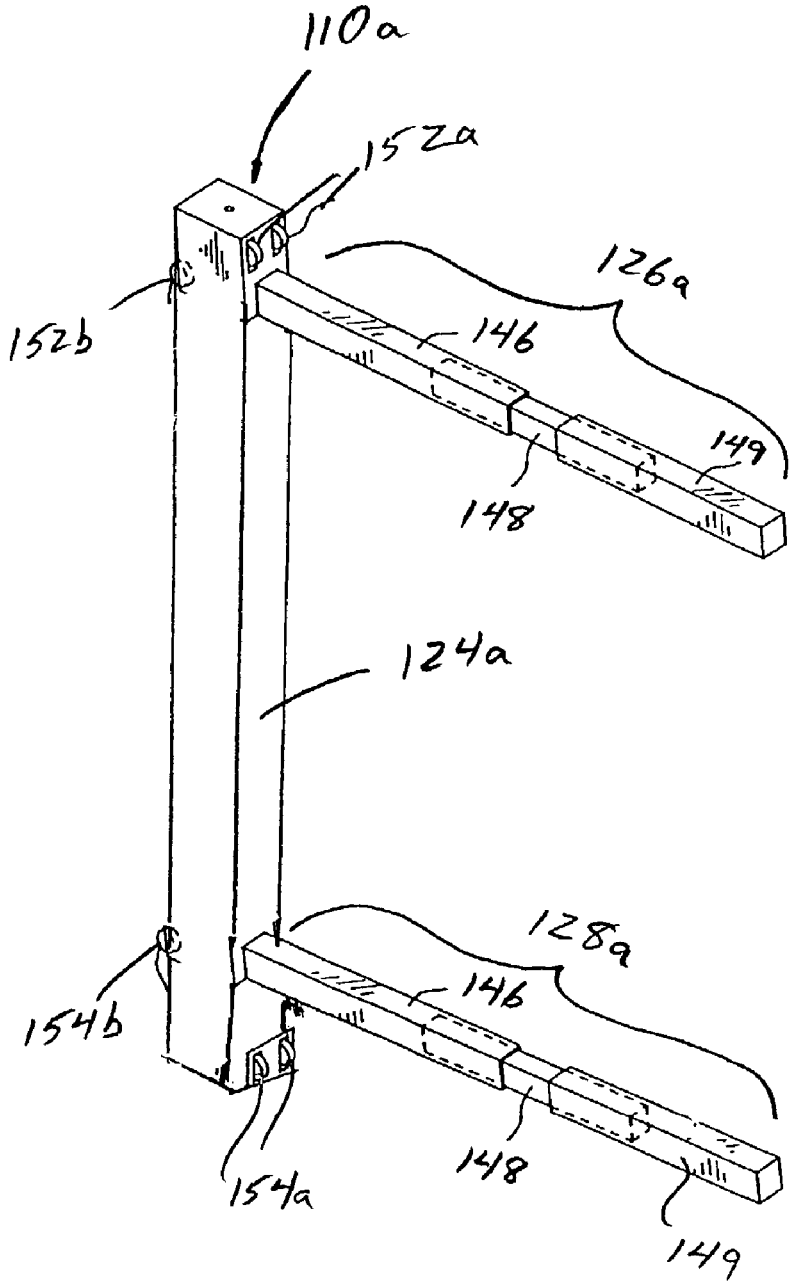
FIG. 6 is a perspective view of additional structural aspects of the exemplary shelving system of FIG. 1.

Movement of first shelves 130, 132 relative to second shelves 134, 136 is facilitated by horizontal movement of first shelves 130, 132 relative to second shelves 134, 136. With reference to FIG. 6, structural aspects of an exemplary shelf support member 110*a* for support of first shelves 130, 132 is provided. As noted above, shelf support member 110*a* includes support leg 124*a* and support arms 126*a*, 128*a* to define a substantially U-shaped configuration. Exemplary support arms 126*a*, 128*a* are each defined by extension legs 146, telescoping leg portions 148 and shelf member receptacles 149. Extension legs 146 at one end coact with the telescoping leg portions 148 to permit the first shelves 130, 132 to be moved horizontally away from support leg 124*a* and the associated upright support 102, 104. Shelf member receptacles 149 coact with telescoping leg portions 148 to further facilitate horizontal motion of first shelves 130, 132.

Of course, any of the members 146, 148 and/or 149 may be smaller or larger than adjacent members to permit telescoping interaction, as is known in the art and U.S. Pat. No. 5,799,588 to Engel, the contents of which are incorporated herein by reference. Indeed, the telescoping functionality described herein may be achieved through slide elements, e.g., slides that facilitate drawer functionality, that are commercially available in the market. The shelf member receptacle 149 may be advantageously formed integrally with the associated shelf, e.g., first shelf 130 or 132. Structural features, e.g., stops, are generally included with the telescoping elements to prevent disengagement there between, and to predefine the amount of horizontal motion permitted to first shelves 130, 132. Generally, first shelf 130 and first shelf 132 are permitted equal degrees of horizontal motion relative to support leg 124*a* and the associated upright support.

Indeed, it is contemplated that pulley/cable, gearing mechanisms or the like (not pictured) may be incorporated into shelf support members 110*a*, 110*b* such that horizontal motion of one of the first shelves results in an equivalent horizontal motion in the other of the first shelves. In other words, telescoping motion of a first support arm 126*a* is automatically translated to a corresponding horizontal motion of a second support arm 128*a*. Such mechanisms may be incorporated into the hollow spaces of support leg 124*a* and support arms 126*a*, 126*b*, as will be apparent to persons skilled in the art.

For purposes of the advantageous shelving systems of the present disclosure, it is generally not necessary that both the first shelves 130, 132 and the second shelves 134, 136 be capable of horizontal motion relative to the associated upright supports 102, 104, although such dual motion is not precluded according to the present disclosure and is preferred in certain disclosed embodiments. Thus, in the case where only a first set of shelves are adapted for horizontal motion, first shelves 130, 132 are mounted to telescoping support arms 126*a*, 128*a*, as described above, and shelf support members 112*a*, 112*b* need not accommodate telescoping motion. Thus, second shelves 134, 136 may be fixed for purposes of potential horizontal motion. In such case, fixed support arms 138, 140 are generally fixedly mounted to the associated shelf support leg 139 and are interconnected with the second shelves 134, 136 in any manner known in the art.

With further reference to FIG. 6, support leg 124*a* (which may be fabricated, at least in part, utilizing a conventional drawer slide) generally includes forward-facing rollers 152*a*, 154*a* and rearward-facing rollers 152*b*, 154*b*. Rollers 152, 154 are positioned within channel 116 of upright support 102, and coact with the inner walls of upright support 102 to facilitate axial (i.e., up and down) movement of shelf support member 110*a* relative to upright support 102. Thus, forward-facing rollers 152*a*, 154*a* and rearward-facing rollers 152*b*, 154*b* facilitate vertical movement of shelf support member 110*a* which translates to vertical movement of first shelves 130, 132. Alternative numbers and arrangements of rollers may be incorporated, as will be apparent to persons skilled in the art. Indeed, rollers or other rotating members may be mounted to the interior of upright supports 102, 104 to facilitate vertical movement of shelf support members 112, 114 therewithin.

In operation, exemplary shelving system 100 operates to facilitate repositioning of first shelves 130, 132 relative to second shelves 134, 136 by permitting outward horizontal motion of first shelves 130, 132 relative to upright supports 102, 104, as shown in FIG. 2. Such horizontal motion of first shelves 130, 132 is accomplished by way of telescoping functionality associated with shelf support members 110*a*, 110*b*. By moving first shelves 130, 132 outwardly, the telescoping leg portions 148 are moved out from the shelf member receptacle 149 and/or the support leg 146 to move the inner edge 143 of the first shelves 130, 132 out past second shelves 134, 136. Once first shelves 130, 132 are outwardly positioned, downward vertical movement of first shelves 130, 132 may be accomplished without contacting second shelves 134, 136. Stated differently, outward horizontal movement of first shelves 134, 136 creates clearance relative to second shelves 134, 136, thereby permitting the sets of shelves to move past each other to the orientation of FIG. 3.

Of note, axial movement of first shelves 130, 132 effects an equal and opposite axial motion of second shelves 134, 136 by way of the pulley mechanism internal to upright supports 102, 104. In addition, oppositely oriented elongated slots 106, 108 permits relative axial motion of shelf support members 110, 112 without interference therebetween. The central or mid-column positioning of upright supports 102, 104, with support arms 126, 128 and fixed support arms 138, 140 extending in opposite directions, contributes to enhanced stability and an advantageous symmetry of forces associated with shelving system 100.

Figure 4:
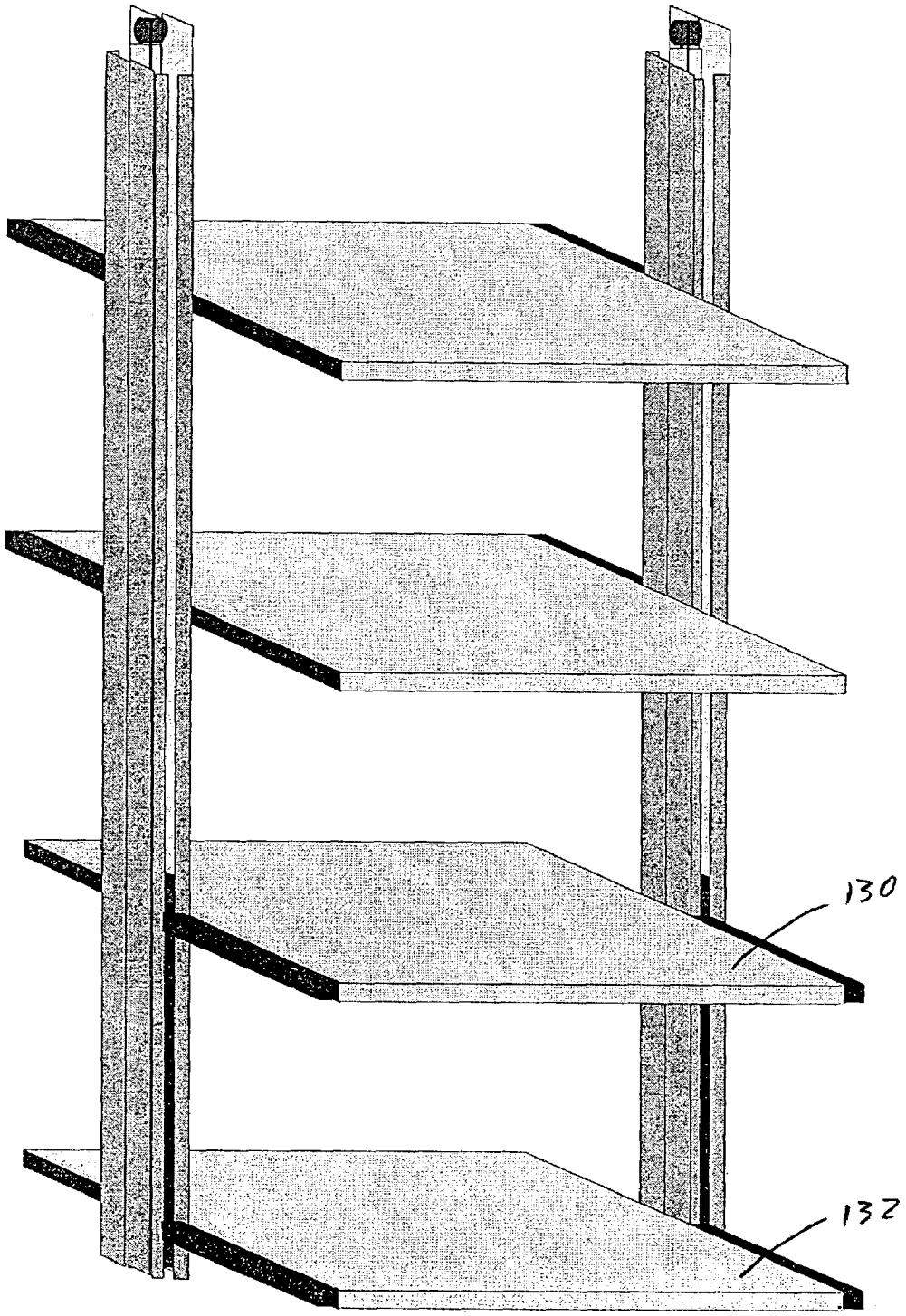
FIG. 4 is a perspective schematic view, partially cut-away, of the exemplary shelving system of FIG. 1, showing horizontal movement of a repositioned first set of shelves relative to upright supports thereof.

The distance of travel for first shelves 130, 132 and second shelves 134, 136 is such that first shelves 130, 132 assumes a "lower" position relative to second shelves 134, 136 and may be returned horizontally inward therebelow, as shown in FIG. 4. Generally, first shelves 130, 132 are moved to vertical location previously occupied by second shelves 134, 136, and vice versa. The first and/or second shelves may be interconnected with a counterweight (not shown) for preventing unwanted or uncontrolled movement of loaded shelves with respect to unloaded shelves, as well as preventing any other unwanted movement. Mechanisms for controlling the rest positions of the shelving members, e.g., as shown in FIGS. 1 and 4, may be incorporated in shelving system 100, e.g., as disclosed in U.S. Pat. No. 5,799,588 to Engel, the contents of which are incorporated herein by reference.

Based on the vertical repositioning of the first and second shelves, the contents of the respective shelves may be more effectively accesses. In addition, exemplary shelving system 100 advantageously permits simultaneous downward repositioning of multiple shelves at the same time multiple shelves are upwardly repositioned.

Referring now to FIGS. 7–11, a second exemplary shelving system 160 according to the present disclosure is schematically depicted. As with shelving system 100 described hereinabove, shelving system 160 includes upright supports 162, 164 which generally assume a substantially vertical orientation. Shelving system 160 further includes a horizontal cross bar 163 which joins upright support 162 to upright support 164, further enhancing the structural stability of shelving system 160 and enclosing system components, as described in greater detail below. Upright supports 162, 164 and cross bar 163 may include telescopic functionality so that the disclosed shelving system can be adjusted to different sizes, e.g., based on available storage space, etc. Upright supports 162, 164 are typically of similar construction, although structural differences may be necessitated to facilitate cooperation with cross bar 163.

Exemplary upright supports 162, 164 and cross bar 163 generally have a substantially uniform, rectangular cross-section. Thus, exemplary upright supports 162, 164 and support bar 163 typically define "box-like" beams that may be advantageously detachably mounted to surrounding structure(s), e.g., walls, cabinetry, adjacent shelving supports, etc. However, as with shelving system 100, alternative cross-sectional configurations are contemplated, e.g., cross-sections that are, in whole or in part, elliptical, trapezoidal, etc., as may be desired to achieve aesthetic effects and/or to accommodate external considerations, e.g., space constraints or manufacturing efficiencies, and upright support/cross bar designs featuring non-uniform cross-sections are also contemplated.

Upright support 162 defines first elongated slot 166 and upright support 164 defines second elongated slot 168. The dimensional characteristics of the first and second elongated slots 166, 168 are generally identical, i.e., the first and second elongated slots 166, 168 typically have the same width and length/height. Elongated slots 166, 168 are sized and dimensioned to accommodate vertical movement of shelf support members 170, 172, respectively, as described in greater detail below, while ensuring structural stability/integrity of the upright support. With reference to the partially cut-away view of FIG. 11, upright supports 162, 164 define substantially enclosed channels 176, 178, and cross bar 163 defines duct 177. The substantially enclosed channels 176, 178 open to the exterior by way of elongated channels 166, 168, respectively. Channels 176, 178 are sized and dimensioned to permit axial movement of shelf support members 170, 172, respectively, and to prevent binding of shelf support members 170, 172 therewithin. Channels 176, 178 and duct 177 typically exhibit substantially square or rectangular cross-sections of substantially equivalent cross-sectional area, although alternative geometries and relative dimensional characteristics are contemplated.

Figure 11:
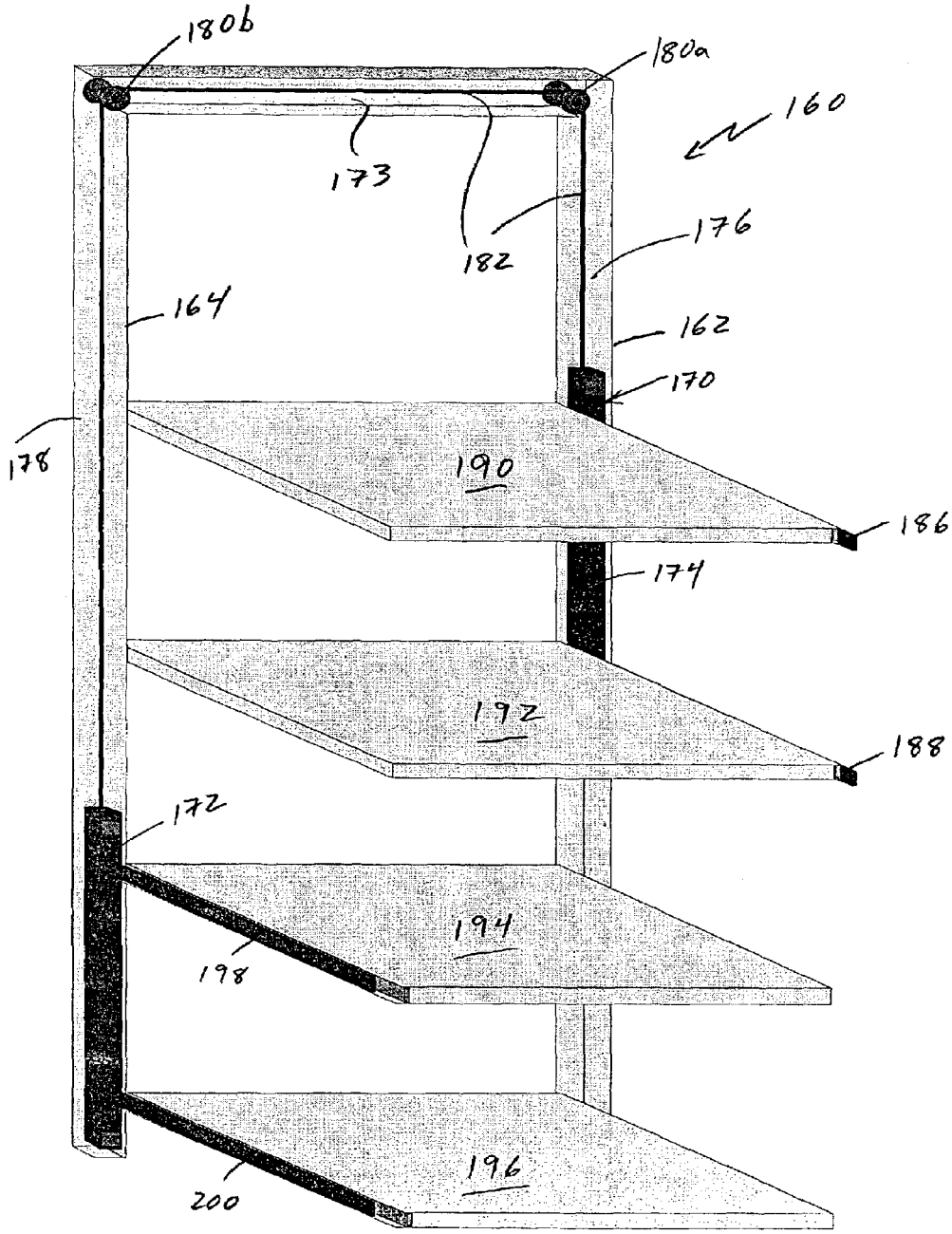
FIG. 11 is a perspective schematic view, partially cut-away, of the exemplary shelving system of FIG. 7, showing internal structural features thereof.

With further reference to FIG. 11, pulleys 180*a*, 180*b* are mounted relative to upright supports 162, 164, e.g., relative to one or both side walls thereof. The pulleys are typically mounted at a midpoint of the side wall(s) and at a height that ensures interaction with the duct 177 of cross bar 163. The mounting of pulleys 180*a*, 180*b* is effected so as to facilitate rotational motion thereof, e.g., rotational motion relative to a centrally positioned axle, as is known in the art. A cable, wire or other flexible member 182 is mounted at one end to first shelf support member 170 and at the other end to second shelf support member 172. Cable 182 extends partially around pulley 180*a*, 180*b*, such that axial movement of first shelf support member 170 relative to upright support 162 effects an equal and opposite axial movement of second shelf support member 172. The manner in which cable 182 is mounted to respective shelf support members is not critical and a variety of mounting mechanisms are contemplated, e.g., by welding, conventional coupling, crimping and/or clamping mechanisms, and the like.

Pulleys 180*a*, 180*b* facilitate efficient and reliable translation of motion between first and second shelf support members 170, 172. Thus, substantially unimpeded rotation of pulleys 180*a*, 180*b* is desired. Alternative mechanisms for translation of motion are contemplated. For example, gearing mechanisms and/or rack-and-pinion mechanisms may be employed to translate axial motion between first and second shelf support members, as will be readily apparent to persons skilled in the art.

As shown in the partially cut-away view of FIG. 11, exemplary shelf support members 170, 172 define a substantially U-shaped or r-shaped configuration. With particular reference to shelf support member 170, the U-shaped or π-shaped structural design corresponds to the structural design of shelf support member 110*a*, described with reference to FIG. 6 above. Thus, shelf support member 170 includes a support leg 174 that is captured within channel 176 and a plurality of support arms 186, 188 that extend through elongated slot 166 to support first shelves 190, 192, respectively. Exemplary shelf support member 170 includes a pair of support arms 186, 188. However, it is contemplated according to the present disclosure that greater numbers of support arms may extend from individual support legs 174, e.g., three, four or more, to provide greater repositionable storage capacity according to the present disclosure. In preferred embodiments of the present disclosure, the number of support arms extending from shelf support members that are joined by cable 182 are equal, although an unequal number of support arms (and shelves) may be implemented if requisite spacing considerations are addressed.

Figure 7:
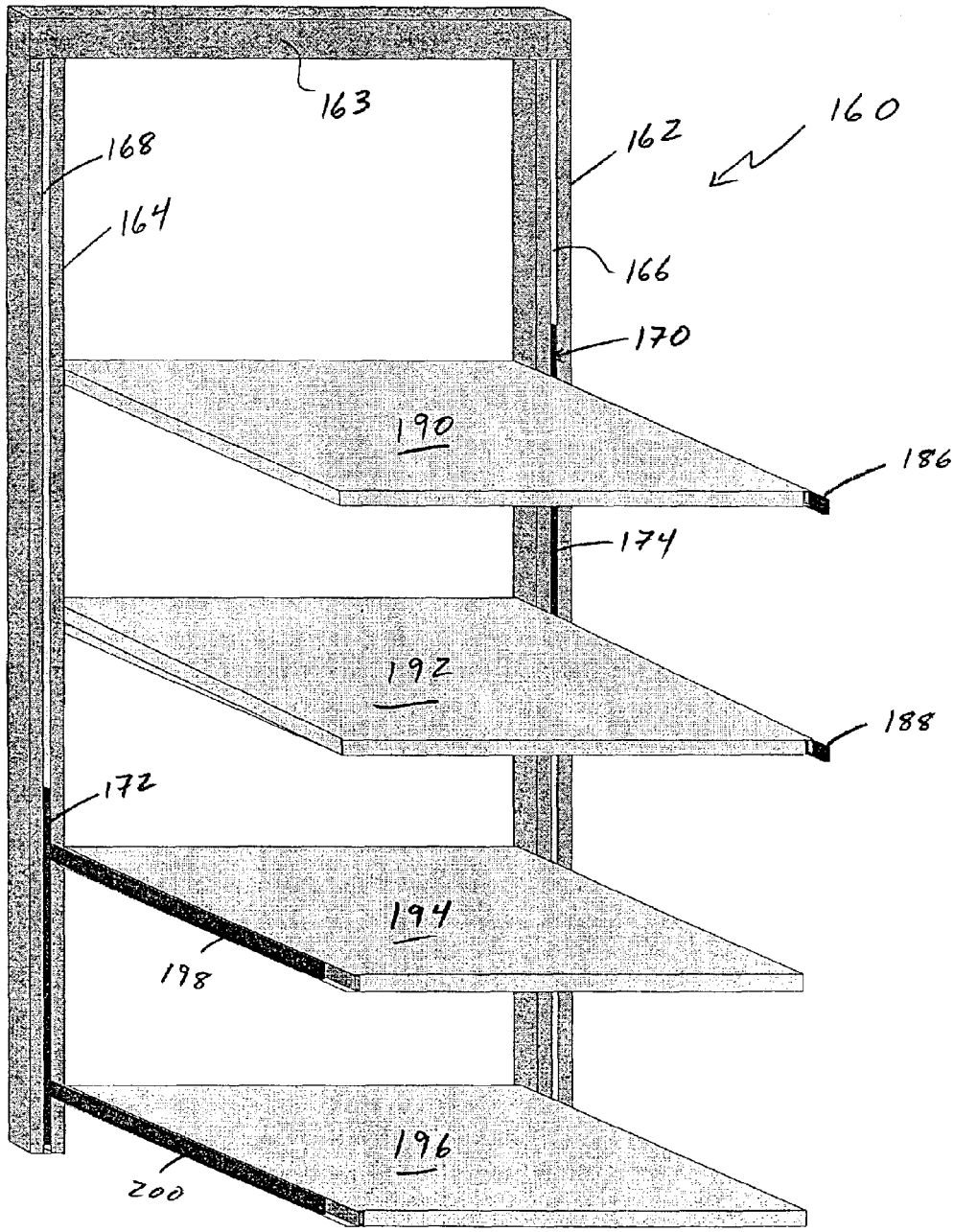
FIG. 7 is a perspective schematic view of a second exemplary shelving system according to the present disclosure.
Figure 8:
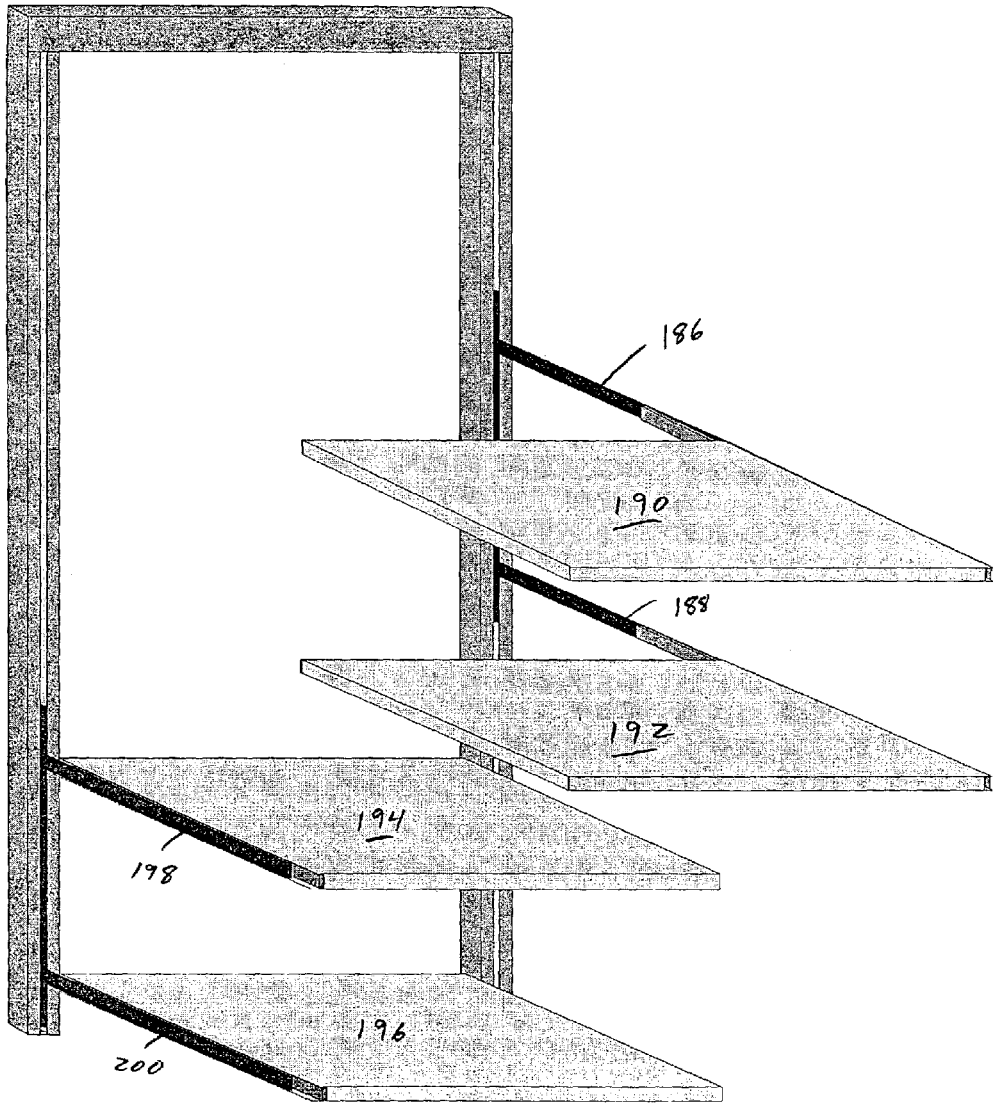
FIG. 8 is a perspective schematic view of the exemplary shelving system of FIG. 7, showing horizontal movement of a first set of shelves relative to upright supports thereof.

As shown in FIGS. 7–11, shelving system 160 includes first shelves 190, 192 and second shelves 194, 196. As will hereinafter be described, first shelves 190, 192 may be advantageously repositioned, as a unit, relative to second shelves 194, 196, and vice versa. In the circumstance where first shelves 190, 192 are positioned above second shelves 194, 196 (as shown in FIGS. 7–8 and 11), repositioning of the first shelves relative to the second shelves permits the first shelves to be accessible to users at a lower position, and places second shelves at a higher level that may desirably be closer to "eye-level" and/or "elbow-level." Thus, repositioning of the first and second sets of shelves according to the present disclosure may be undertaken for a variety of advantageous reasons.

According to exemplary embodiments of the present disclosure, axial (i.e., vertical) motion imparted to the first shelves is automatically translated to an opposite axial motion for the second shelves (and vice versa), based on the operation of the pulley/cable mechanism. Of note, cable 182 crosses from upright support 162 to upright support 164 within cross bar 163, and is thereby free to travel in an unimpeded manner. Thus, as the first shelves 190, 192 are lowered past the second shelves 194, 196, the second shelves 194, 196 are automatically raised past the first shelves 190, 192 to effectively trade positions therewith. Thereafter, the first shelves 190, 192 can be raised up, and the second shelves 194, 196 automatically lowered, or second shelves 194, 196 may be lowered and first shelves automatically raised, such that the first and second sets of shelves are returned to their original relative positions.

Movement of first shelves 190, 192 relative to second shelves 194, 196 is facilitated by horizontal movement of first shelves 190, 192 relative to second shelves 194, 196. Such horizontal motion of first shelves 190, 192 is facilitated by a telescoping mechanism associated with shelf support member 170, as described above with reference to shelf support member 110*a*. As also described with reference to shelf support member 110*a*, it is contemplated that shelf support member 170 may include pulley/cable mechanisms, gearing mechanisms or the like (not pictured), such that horizontal motion of one of the first shelves results in an equivalent horizontal motion in the other of the first shelves. In other words, telescoping motion of a first support arm is automatically translated to a corresponding horizontal motion of a second support arm.

For purposes of the advantageous shelving systems of the present disclosure, it is generally preferred (although not essential) that both the first shelves 190, 192 and the second shelves 194, 196 be capable of horizontal motion relative to the associated upright supports 162, 164. Thus, in the case where both first shelves 190, 192 and second shelves 194, 196 are mounted to telescoping support arms, as described above, vertical repositioning of first shelves 190, 192 relative to second shelves 194, 196 may be advantageously accomplished through repeated horizontal motion (to create a desired clearance) and downward movement of the shelves then-located in the upper position (or upward movement of the shelves then-located in the lower position). In other words, vertical repositioning of the first and second shelves may be advantageously achieved by outward movement of the first shelves when they are in the upper position, and outward movement of the second shelves when they are in the upper position, rather than limiting the outward movement to either the first or the second shelves. Similarly, the horizontal motion may be limited to shelves that are in the "lower" position. The advantageous ability to vertically reposition shelves/shelving units according to the foregoing sequential operation, which effectively establishes a clockwise or counter-clockwise movement of the first and second shelves as they are vertically repositioned relative to each other, is common to shelving units referred to as the "Patanosta" family of products.

Rollers (front-facing and rearward-facing) are generally mounted to shelf support members 170, 172 to facilitate vertical motion of the shelf support members relative to the upright supports. Thus, as with shelf support member 110*a* described above with reference to FIG. 6, rollers are rotatably mounted to the shelf support members and positioned within channels 176, 178 of upright supports 162, 164, respectively, to coact with the inner walls of thereof. The rollers facilitate axial (i.e., up and down) movement of shelf support members 170, 172 relative to upright supports 162, 164. Alternative numbers and arrangements of rollers may be incorporated, as will be apparent to persons skilled in the art.

In operation, exemplary shelving system 160 operates to facilitate repositioning of first shelves 190, 192 relative to second shelves 194, 196 by permitting outward horizontal motion of first shelves 190, 192 relative to upright supports 162, 164, as shown in FIG. 8. First shelves 190, 192 are effectively supported in a cantilever arrangement by support arms 186, 188. Similarly, second shelves 194, 196 are supported in a substantially cantilevered fashion by support arms 198, 200. In exemplary shelving system 160, the only shelf support member (170) that travels within upright support 162 is associated with first shelves 190, 192, whereas the only shelf support member (172) that travels within upright support 164 is associated with second shelves 194, 196. Thus, the travel of shelf support members 170, 172 is restricted to independent upright support members, yet the motions of the a shelf support member is immediately and automatically translated to the other shelf support member by the pulley/cable mechanism. Thus, axial movement of first shelves 190, 192 effects an equal and opposite axial motion of second shelves 194, 196 by way of the pulley mechanism internal to upright supports 162, 164 and cross bar 163.

Figure 9:
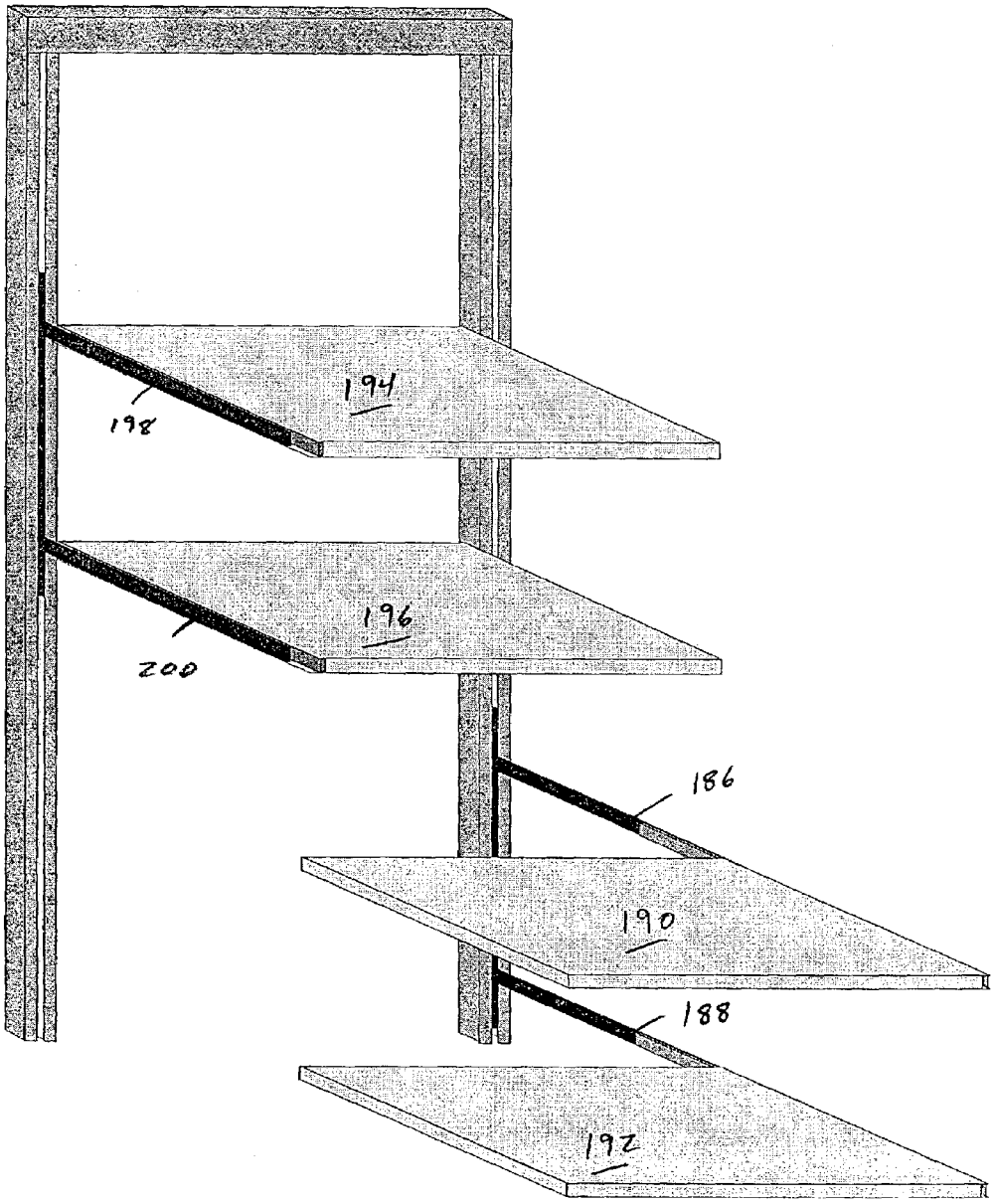
FIG. 9 is a perspective schematic view of the exemplary shelving system of FIG. 7, showing vertical movement of first and second sets of shelves relative to upright supports thereof.
Figure 10:
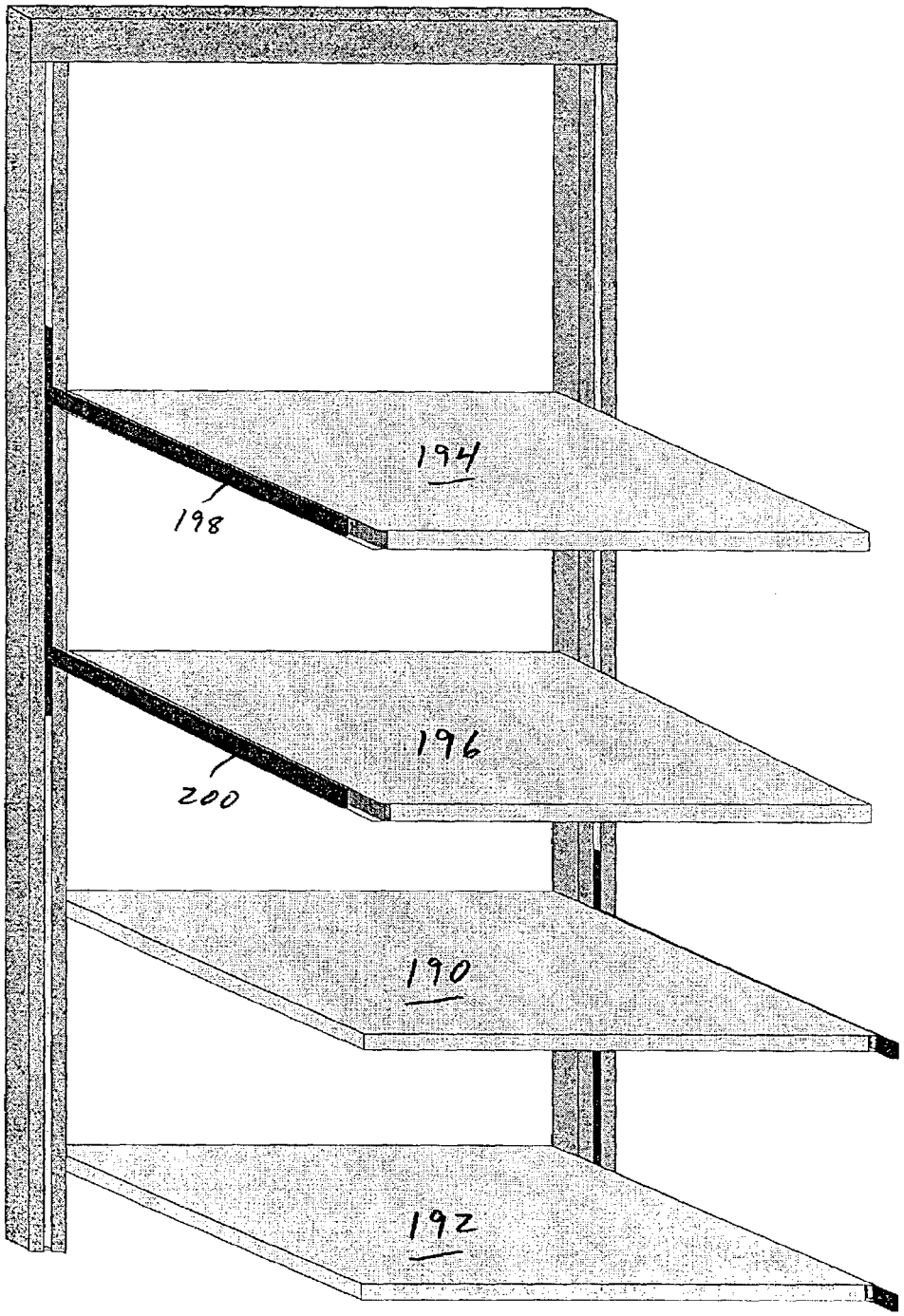
FIG. 10 is a perspective schematic view of the exemplary shelving system of FIG. 7, showing repositioning of first and second sets of shelves.

Horizontal motion of first shelves 190, 192 is accomplished by way of telescoping or sliding functionality associated with shelf support member 170. Once first shelves 190, 192 are outwardly positioned, downward vertical movement of first shelves 190, 192 may be accomplished without contacting second shelves 194, 196 based on clearance defined relative to second shelves 194, 196 (FIGS. 8–9). The travel distance of first shelves 190, 192 and second shelves 194, 196 is such that first shelves 190, 192 assume a "lower" position relative to second shelves 194, 196 and may be returned horizontally inward therebelow, as shown in FIG. 10.

Generally, first shelves 190, 192 are moved to vertical location previously occupied by second shelves 194, 196, and vice versa. The first and/or second shelves may be interconnected with a counterweight (not shown) for preventing unwanted or uncontrolled movement of loaded shelves with respect to unloaded shelves, as well as preventing any other unwanted movement. Mechanisms for controlling the rest positions of the shelving members, e.g., as shown in FIGS. 7 and 10, may be incorporated in shelving system 160, e.g., as disclosed in U.S. Pat. No. 5,799,588 to Engel, the contents of which are incorporated herein by reference.

Based on the vertical repositioning of the first and second shelves, the contents of the respective shelves may be more effectively accessed. Vertical repositioning of the first and second shelves may be advantageously achieved by outward movement of the first shelves when they are in the upper position, and outward movement of the second shelves when they are in the upper position, rather than limiting the outward movement to either the first or the second shelves. Similarly, the horizontal motion may be limited to shelves that are in the "lower" position. The advantageous ability to vertically reposition shelves/shelving units according to the foregoing sequential operation, which effectively establishes a clockwise or counterclockwise movement of the first and second shelves as they are vertically repositioned relative to each other, is common to the "Patanosta" family of products referenced above.

Repeated repositioning of the first and second shelves/shelving units may be accomplished by sequential horizontal repositioning of the "upper" (or "lower") shelves, as discussed above with reference to the Patanosta product family. In addition, exemplary shelving system 160 advantageously permits simultaneous downward repositioning of multiple shelves at the same time multiple shelves are upwardly repositioned.

Turning to FIGS. 12–16, a third exemplary shelving system 210 according to the present disclosure is schematically depicted. Shelving system 210 shares many features with exemplary shelving system 160 described above with reference to FIGS. 7–11. However, unlike shelving system 160, shelving system 210 includes four upright supports 212*a*, 212*b*, 214*a*, 214*b* that are deployed in a substantially rectangular or square orientation. Support bars 213*a–d* provide structural support to the upright supports and two of the support bars 213*b*, 213*d* define an enclosed space for cables, as described below with reference to FIG. 16.

As schematically depicted, upright supports 212*a*, 212*b* define elongated slots that face toward each other (elongated slot 216 is visible) and upright supports 214*a*, 214*b* define elongated slots that face toward each other (elongated slot 218 is visible). However, it is not necessary that the slots be in facing alignment. Rather, alternative slot arrangements may be adopted, provided the relative movement of first and second shelves is facilitated, as described herein. Shelf support member 220 is movably positioned within upright support 212*b* and shelf support member 221 is positioned within shelf support member 212*a* (see FIG. 16). Shelf support members 220, 221 cooperate to support first shelves 240, 242. Shelf support member 222 is movably positioned within upright support 214*b* and shelf support member 223 is movably positioned within upright support 214*a* (see FIG. 16). Shelf support members 222, 223 cooperate to support second shelves 244, 246.

Two coordinated pulley mechanisms are included within shelving system 210. First pulley mechanism 250 includes first and second pulleys 254, 256 mounted within upright supports 212*a*, 214*a*, respectively, whereas second pulley mechanism 252 includes third and fourth pulleys 258, 260 mounted within upright supports 212*b*, 214*b*, respectively. Cables 262, 264 are associated with the first and second pulley mechanisms 250, 252, respectively, and are generally of comparable length. Cable 262 is mounted to shelf support members 221, 223, and passes over pulleys 254, 256. Similarly, cable 264 is mounted to shelf support members 220, 222 and passes over pulleys 258, 260. Cables 262, 264 are generally enclosed within upright supports and support bars 213*b*, 213*d*, thereby ensuring unimpeded movement thereof.

Shelf support members 220, 221 are generally designed to accommodate horizontal movement of first shelves 240, 242 relative to upright supports 212*a*, 212*b*. Thus, with particular reference to FIGS. 13–14, shelf support member 220 includes telescoping arms 270, 272 that extend through elongated slot 216 in upright support 212*b* and cooperate with shelf support member 221 for additional support thereof. In the exemplary shelving system 210, shelf support member 222 includes fixed arms 274, 276 that extend through elongated slot 218 in upright support 214*b* and cooperate with shelf support member 223, although telescoping arms may also be associated with shelf support members 222, 223, if desired. Indeed, vertical repositioning of the first and second shelves may be advantageously achieved by outward movement of the first shelves when they are in the upper position, and outward movement of the second shelves when they are in the upper position, rather than limiting the outward movement to either the first or the second shelves. Similarly, the horizontal motion may be limited to shelves that are in the "lower" position. The advantageous ability to vertically reposition shelves/shelving units according to the foregoing sequential operation, which effectively establishes a clockwise or counter-clockwise movement of the first and second shelves as they are vertically repositioned relative to each other, is common to shelving units referred to as the "Patanosta" family of products.

Rollers (front-facing and rearward-facing) are generally mounted to shelf support members 220–223 to facilitate vertical motion of the shelf support members relative to the upright supports. Generally, the rollers are rotatably mounted to the shelf support members and positioned within channels formed in the upright supports to coact with the inner walls of thereof. The rollers facilitate axial (i.e., up and down) movement of shelf support members 220–223 relative to the respective upright supports. Alternative numbers and arrangements of rollers may be incorporated, as will be apparent to persons skilled in the art.

Figure 13:
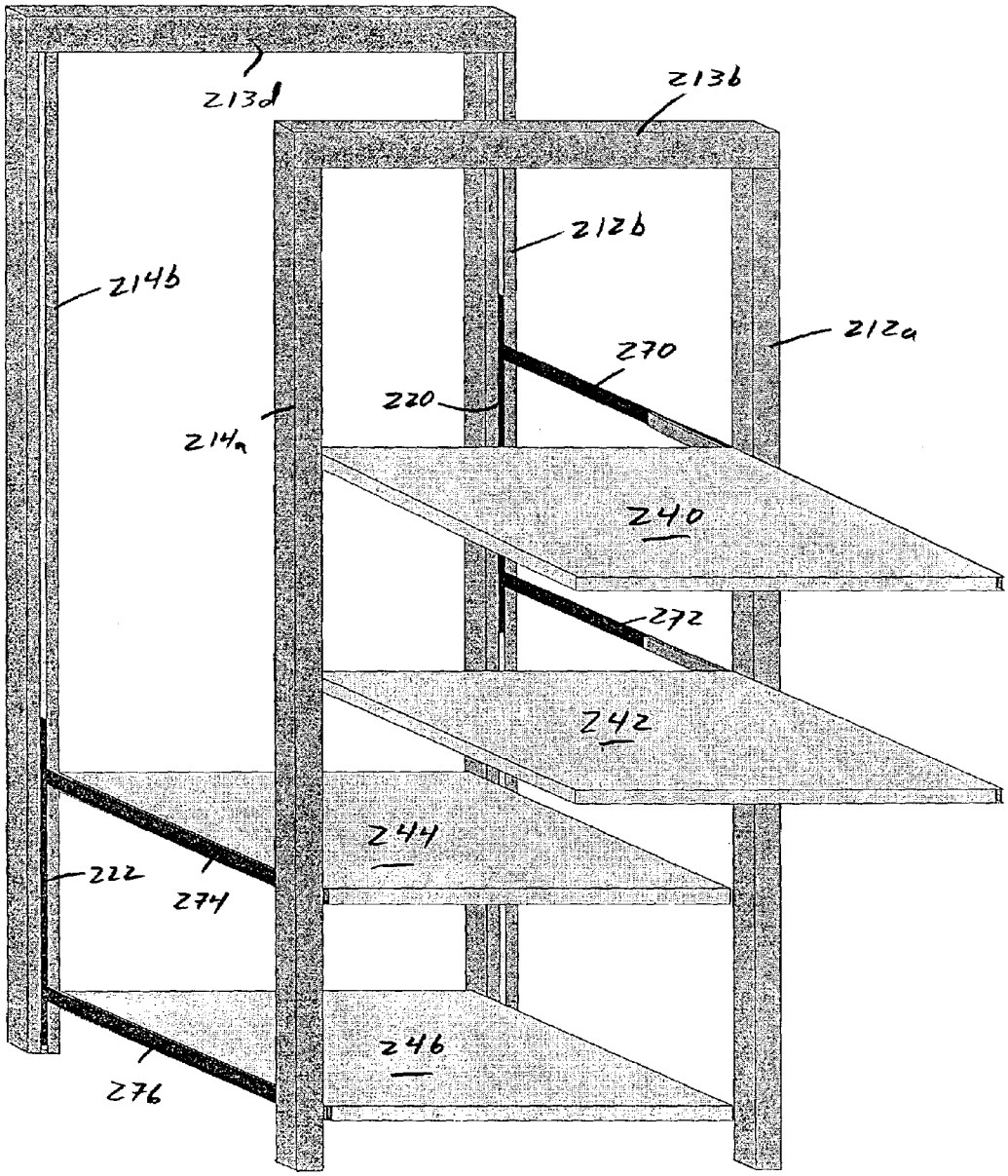
FIG. 13 is a perspective schematic view of the exemplary shelving system of FIG. 12, showing horizontal movement of a first set of shelves relative to upright supports thereof.

In operation, exemplary shelving system 210 operates to facilitate repositioning of first shelves 240, 242 relative to second shelves 244, 246 by permitting outward horizontal motion of first shelves 240, 242 relative to upright supports 212*a*, 212*b*, 214*a*, 214*b*, as shown in FIG. 13. First shelves 240, 242 are effectively supported in a cantilever arrangement by telescoping arms 270, 272, which are in turn supported by the remainder of shelf support members 221, 220 positioned within upright supports 212*a*, 212*b*, respectively. Similarly, second shelves 244, 246 are supported in a substantially cantilevered fashion by arms 274, 276, which are in turn supported by the remainder of shelf support members 222, 223 positioned within upright supports 214*b*, 214*a*, respectively.

In exemplary shelving system 210, each shelf support member is advantageously positioned within a distinct upright support. Thus, the first and second shelves are provided with ample structural support by the four upright supports associated with shelving system 210, and relative vertical movement between first shelves 240, 242 and second shelves 244, 246 is facilitated by the segregated positioning of translatable shelf support members. The travel of shelf support members 220, 221 within upright supports 212*b*, 212*a* is immediately and automatically translated to the oppositely positioned shelf support member by pulley mechanisms 250, 252. In particular, axial movement of first shelves 240, 242 effects an equal and opposite axial motion of second shelves 244, 246 by way of pulley mechanisms 250, 252 internal to the upright supports and support bars. Pulley mechanism 250 translates motion between shelf support members 221, 223, whereas pulley mechanism 252 translates motion between shelf support members 220, 222. Interaction between the elongated slots formed in the upright supports and the outwardly extending arms/telescoping arms enhances the stability and leveling of the first and second shelves.

Figure 14:
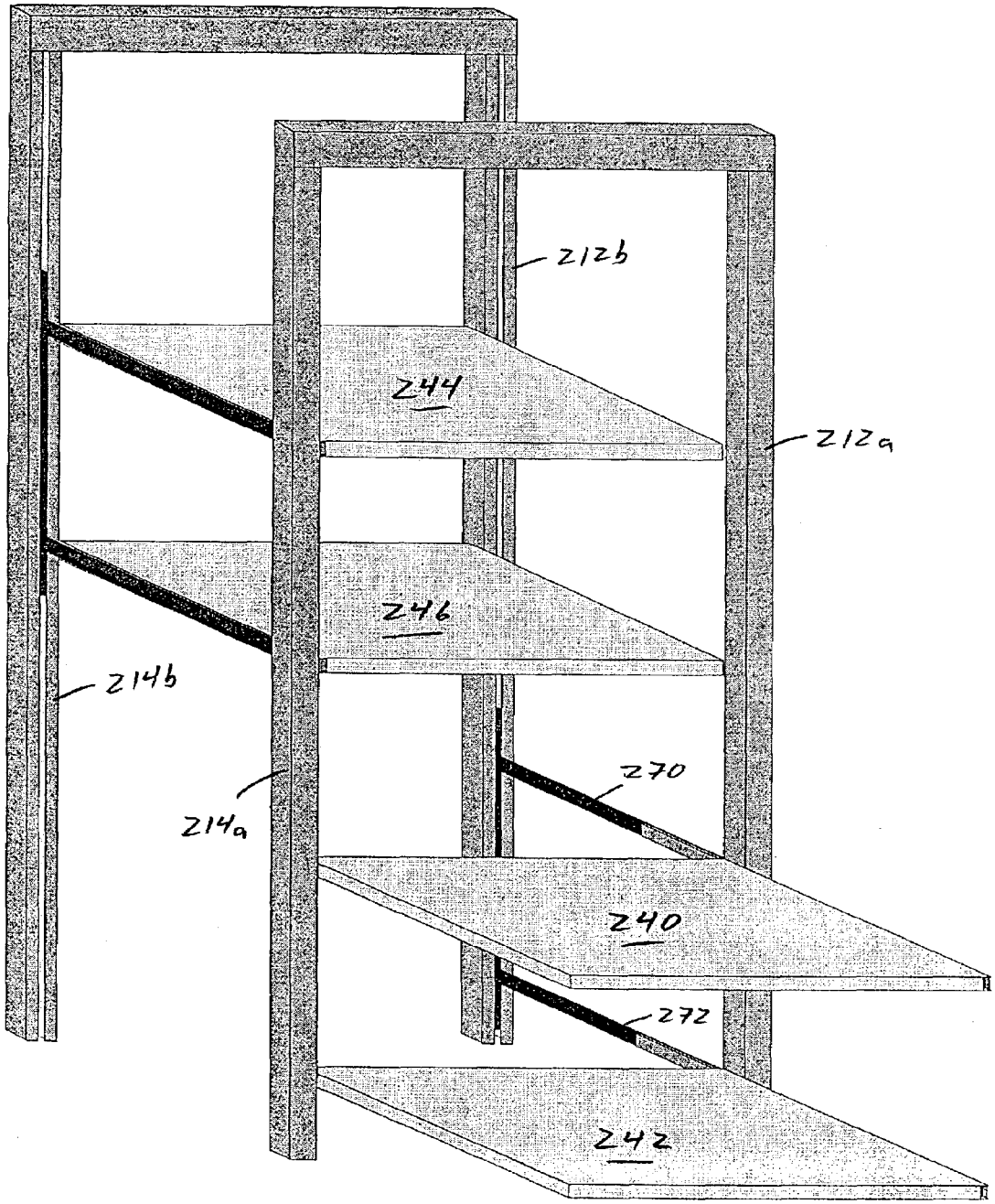
FIG. 14 is a perspective schematic view of the exemplary shelving system of FIG. 12, showing vertical movement of first and second sets of shelves relative to upright supports thereof.
Figure 15:
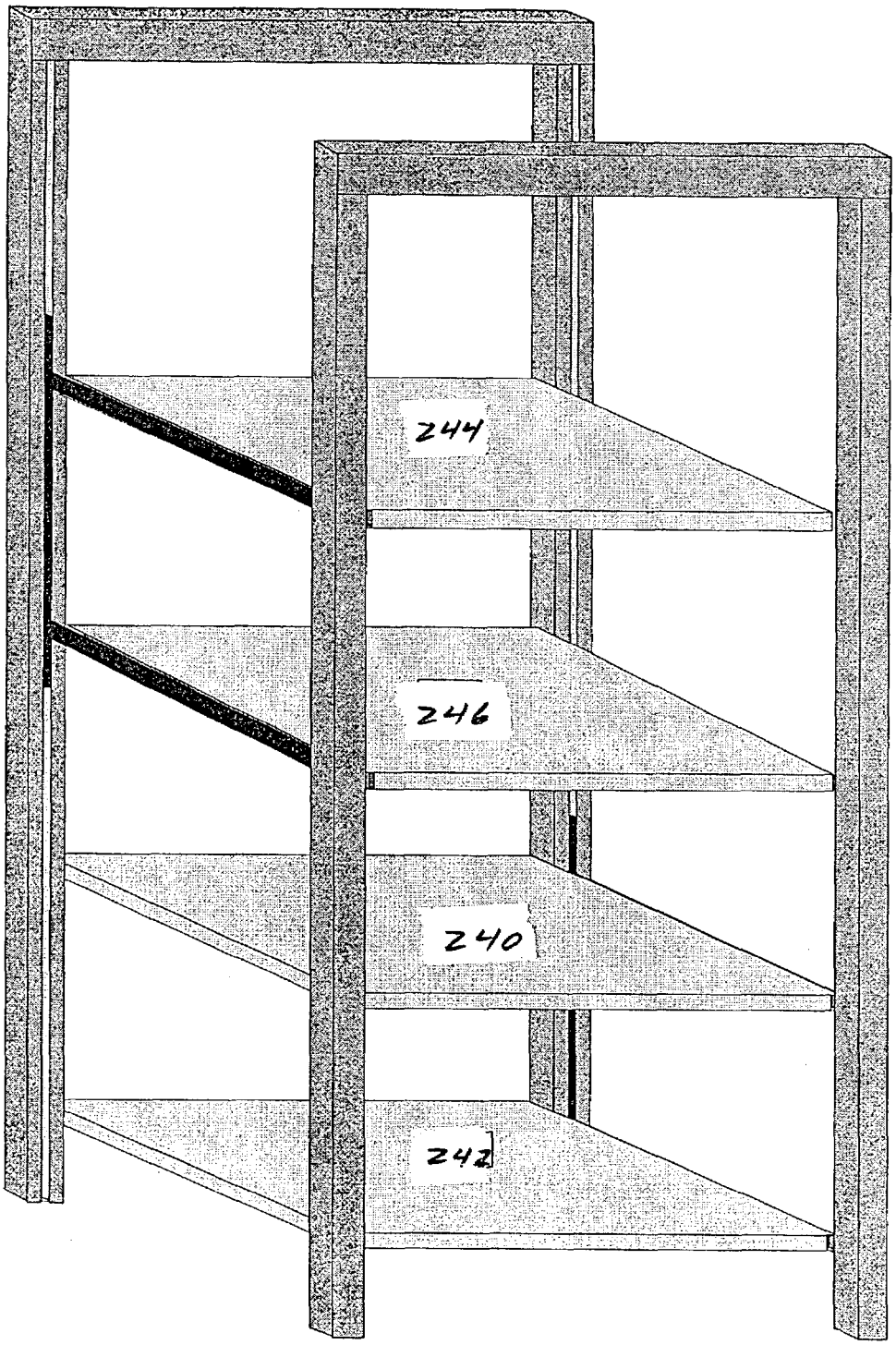
FIG. 15 is a perspective schematic view of the exemplary shelving system of FIG. 12, showing repositioning of first and second sets of shelves.

Horizontal motion of first shelves 240, 242 is accomplished by way of telescoping functionality associated with telescoping arms 270, 272. Once first shelves 240, 242 are outwardly positioned, downward vertical movement of first shelves 240, 242 may be accomplished without contacting second shelves 244, 246 based on clearance defined relative to second shelves 244, 246 (FIGS. 13–14). The travel distance for first shelves 240, 242 and second shelves 244, 246 is such that first shelves 240, 242 assume a "lower" position relative to second shelves 244, 246 and may be returned horizontally inward therebelow, as shown in FIG. 15.

Figure 12:
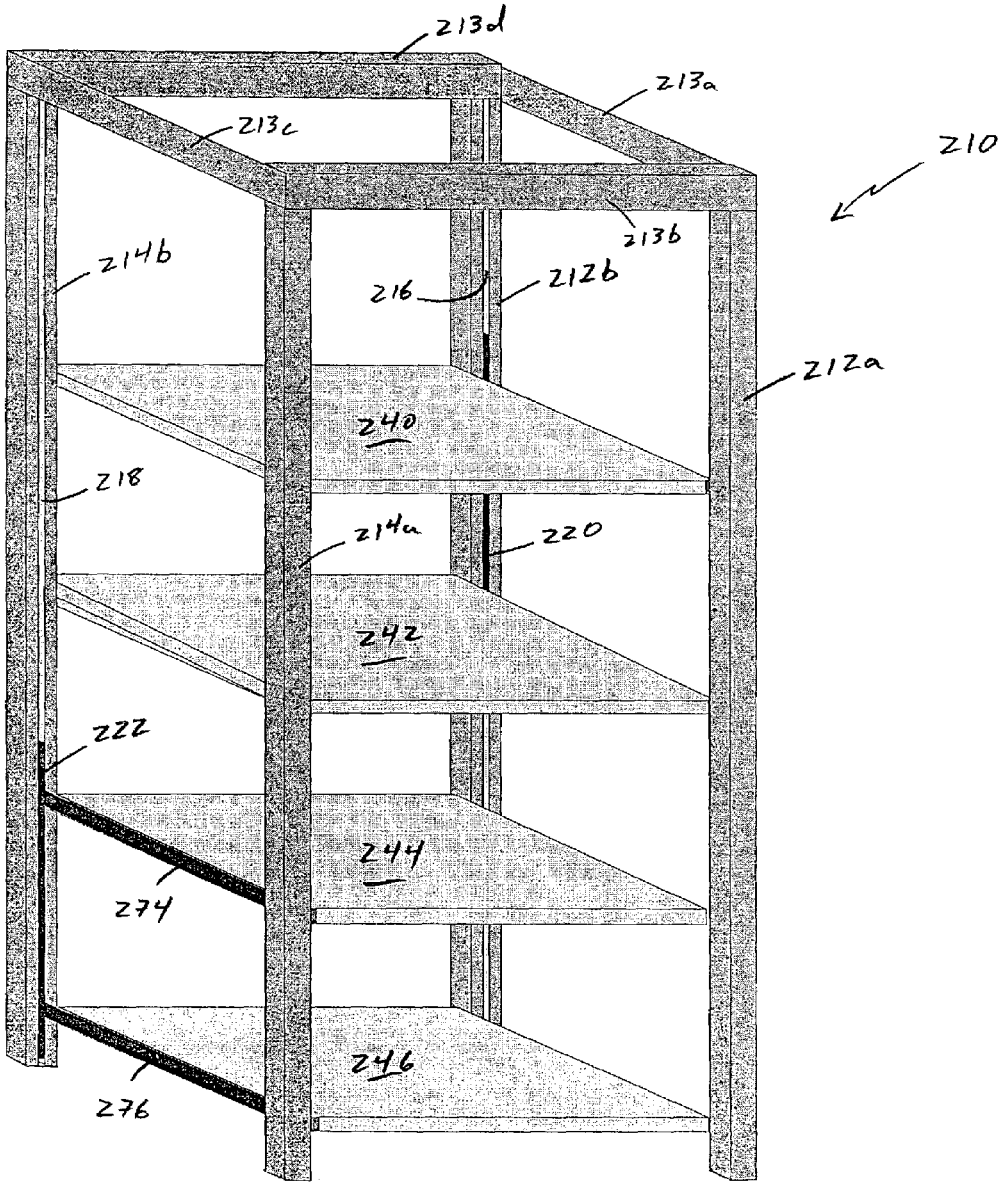
FIG. 12 is a perspective schematic view of a third exemplary shelving system according to the present disclosure.
Figure 16:
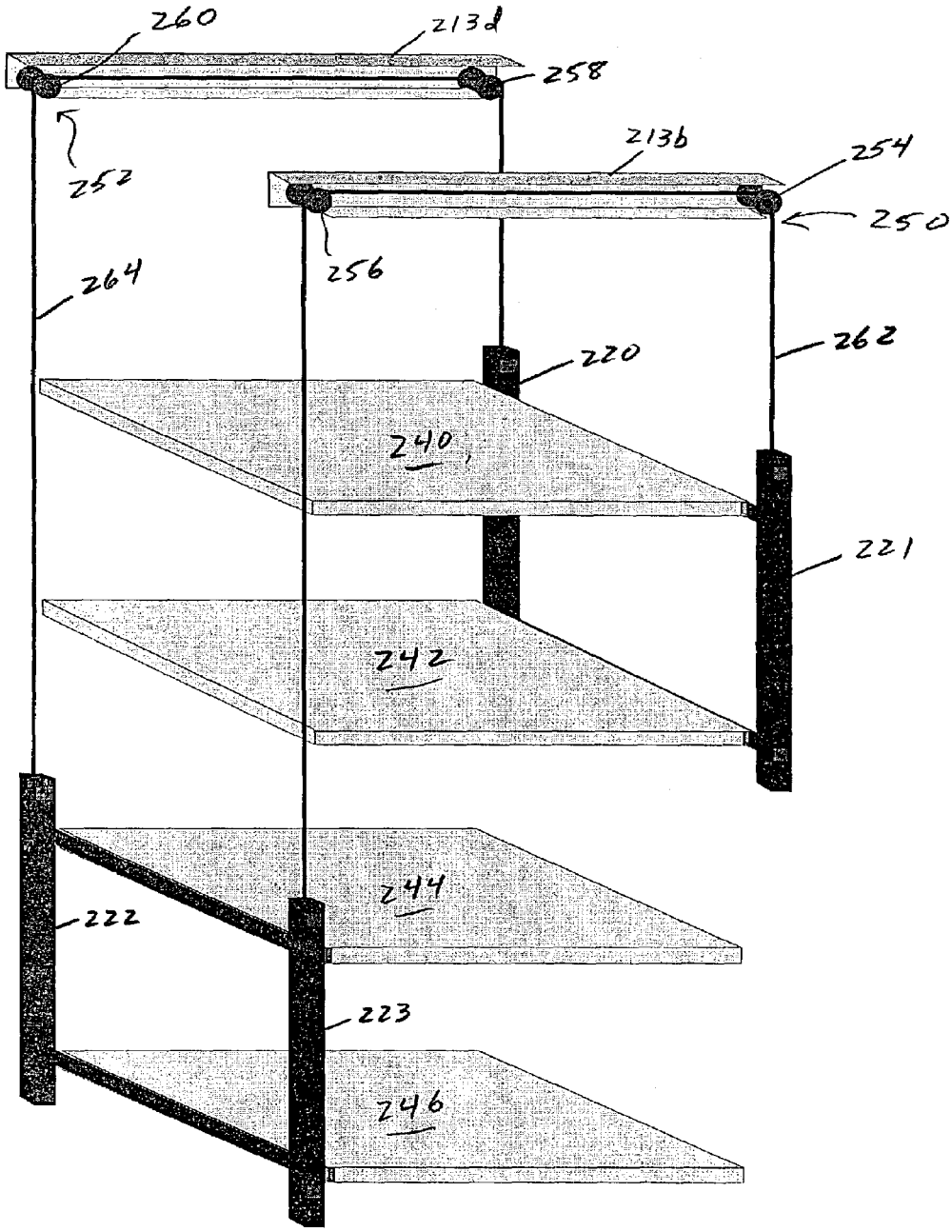
FIG. 16 is a perspective schematic view, partially cut-away, of the exemplary shelving system of FIG. 12, showing internal structural features thereof.

Generally, first shelves 240, 242 are moved to vertical location previously occupied by second shelves 244, 246, and vice versa. The first and/or second shelves may be interconnected with a counterweight (not shown) for preventing unwanted or uncontrolled movement of loaded shelves with respect to unloaded shelves, as well as preventing any other unwanted movement. Mechanisms for controlling the rest positions of the shelving members, e.g., as shown in FIGS. 12 and 16 may be incorporated in shelving system 210, e.g., as disclosed in U.S. Pat. No. 5,799,588 to Engel, the contents of which are incorporated herein by reference.

Based on the vertical repositioning of the first and second shelves, the contents of the respective shelves may be more effectively accessed. In addition, exemplary shelving system 210 advantageously permits simultaneous downward repositioning of multiple shelves at the same time multiple shelves are upwardly repositioned and is preferably fabricated as a member of the Patanosta family of products, as described above.

Figures 17, 18:
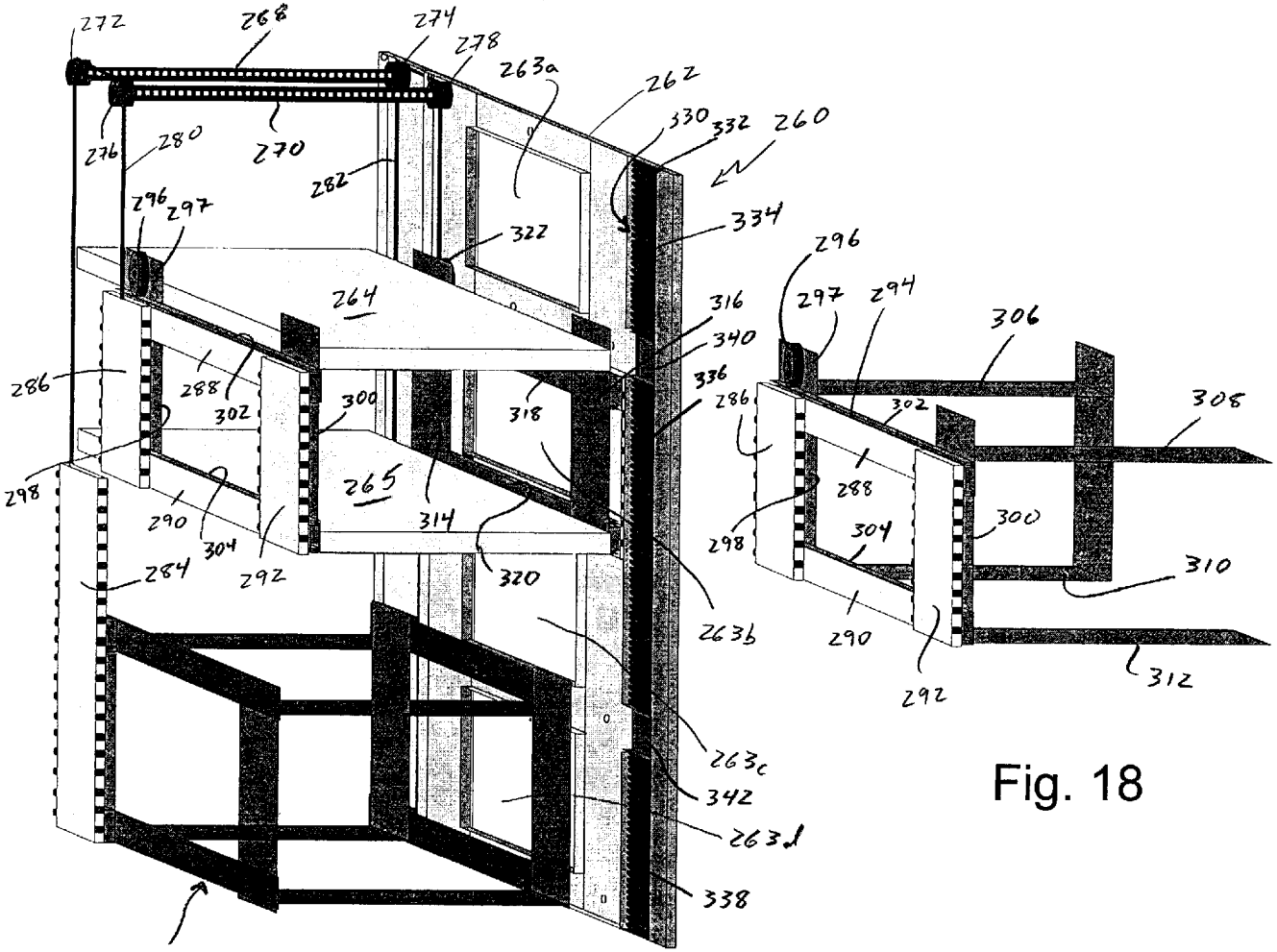
FIG. 17 is a perspective schematic view, partially cut-away, of a fourth exemplary shelving system according to the present disclosure.
FIG. 18 is a perspective schematic view of structural aspects of the fourth exemplary embodiment of FIG. 17.

With reference to FIGS. 17–18, a further exemplary shelving system 260 according to the present disclosure is depicted. Shelving system 260 includes opposing upright supports 261, 262 that provide structural support therefor. Upright supports 261, 262 include a plurality of openings or cut-outs 263*a–h* that facilitate access to products/items stored or positioned on shelves associated therewith, e.g., first shelves 264, 265 or second shelves 266, 267.

Elongated rods 268, 270 synchronize the motion of pulleys 272, 274 and pulleys 276, 278, respectively. Thus, at opposing ends of rods 268, 270 are pulleys which are mounted with respect to upright supports 261, 262. Pulleys 272, 274 are mounted at opposite ends of 268, while pulleys 276, 278 are mounted at opposite ends of rod 270, thereby synchronizing the rotations of the "connected" pulley wheels. With equal rotation of the connected pulley wheels, the shelves will not tilt, i.e., will remain in an advantageous horizontal orientation. All four pulleys are typically mounted at substantially equivalent heights relative to upright supports 261, 262, and are adapted for free rotation to facilitate relative vertical motion of first and second shelves, as described below.

With particular reference to FIG. 17, first cable 280 is mounted to shelf support member 284 at one end by conventional mounting means, and to shelf support member 286 at the opposite end thereof by conventional mounting means. First cable 280 travels around pulleys 272, 276 and is adapted for substantially unimpeded motion. Similarly, second cable 282 is mounted to corresponding shelf support members (not fully visible in FIG. 17) on the opposite side of first shelves 264, 265. With further reference to FIGS. 17 and 18, shelf support member 286 is mounted to horizontal beams 288, 290, which are, in turn, mounted to further shelf support member 292. As a unit, shelf support members 286, 292 and horizontal beams 288, 290 define a rectangular or square sliding frame that enjoys enhanced structural stability. A further shelf support member 370 is provided for the second shelves (not pictured), which may include spacer(s) mounted or incorporated into the outward face(s) thereof to ensure sufficient clearance between the first and second shelves and their respective supporting structures as they travel vertically relative to each other, as will be apparent to persons skilled in the art.

A rail or other cooperative structure is formed or mounted to the upright support or atop the horizontal bar which cooperates with wheel or roller 296 that is rotatably mounted to an upwardly extending flap 297 of bracket 298. The wheel may alternatively be rotatably mounted to the slide or shelf, as will be apparent to persons skilled in the art. A second bracket 300 is in a spaced relation to bracket 298 and is joined thereto by telescoping beams 302, 304. As shown in FIG. 18, brackets 298, 300 include upper shelf support arms 306, 308 and lower shelf support arms 310, 312. With reference to FIG. 17, brackets 298, 300 are also typically joined to faces 314, 316 which in turn are connected to telescoping beams 318, 320 to initially define a rectangular or square brace opposite the comparable structure formed by elements 298, 300, 302, 304. Similarly, a pair of shelf support members and associated horizontal beams are positioned behind such rectangular brace, i.e., to define a rectangular/square structure corresponding to that formed by elements 286, 288, 290, 292. A second wheel or roller 322 is rotatably mounted to upstanding extension associated with face 314 and is adapted to ride on a rail or other cooperative structure formed on the upright support and/or atop the top horizontal beam.

Top and bottom telescoping beams 318, 320 are shown in an extended orientation. Top telescoping beam 318 typically includes a fixed beam portion and a nested, translatable beam portion. Similarly, bottom telescoping beam 320 typically includes a fixed beam portion and a translatable beam portion. Fixed beam portions are fixedly mounted to the horizontal members positioned therebehind, e.g., by screws, bolts or the like. One or more stops (not pictured) may be associated with telescoping beams 318, 320 to ensure that relative horizontal motion between the fixed beam portions and translatable beam portions is limited, i.e., so that the beam portions to do not undesirably disengage. Telescoping beams 302, 304 are structured and function in like manner to that described with reference to telescoping beams 318, 320.

Referring again to FIG. 17, upright support 262 defines an elongated channel 330 that generally extends substantially the entire height of upright support 262. A corresponding elongated channel is formed in upright support 261 opposite elongated channel 330. The elongated channels are advantageously positioned outward of the initial position of bracket 300 and associated face 316. Such positioning of the elongated channels also generally places the elongated channels outward of the front faces of second shelves 266, 267. According to exemplary embodiments of shelving system 260, first shelves 264, 265 are of similar, if not identical, dimension to second shelves 266, 267, in which case the elongated channels are also positioned outward of the front faces of first shelves 264, 265. However, it is contemplated (although not necessary) that first shelves 264, 265 may have a greater depth, in which case the front faces of the first shelves may overlap with the elongated channels, thereby gaining additional storage space on first shelves 264, 265.

Elongated channel 330 advantageously contains a spring 332 that includes a plurality of spring segments, e.g., first spring segment 334, second spring segment 336 and third spring segment 338. A comparable spring with interspersed box elements is positioned within the elongated channel formed in opposing upright support 261. Spring 332 is typically fixed relative to elongated channel 330 at or near opposed ends of the first spring segment 334 and third spring segment 336, e.g., by screws, bolts or the like. Positioned between first and second spring segments 334, 336 is first box element 340, and positioned between second and third spring segments 336, 338 is second box element 342. Typically, the number of spring segments associated with spring 332 exceeds the number of box elements. In addition, it is contemplated that each box element may constitute a plurality of adjoining box elements to enhance the ease with which the wheel aligns with a box element in its horizontal travel, and/or that the box element(s) may include outwardly flared walls to guide the wheel therewithin.

The box elements advantageously catch and hold a shelf or stack of shelves, and contribute to preventing the weight associated with the shelf/stack of shelves from crushing the portion of spring 332 positioned therebelow. In the exemplary embodiment of FIGS. 17–18, a single shelving unit is adapted for both horizontal and vertical movement (i.e., first shelves 264, 265), and two box elements (box elements 340, 342) and three spring segments (334, 336, 338) are advantageously provided. If the number telescoping shelving units were increased, then the number of box elements may be increased to facilitate operative ease.

Spring 332 generally includes an internal spring structure and an outer structure or sleeve that may be fabricated from a resilient flexible material, e.g., rubber, although any material that holds fluid and/or air and is able to shrink and extend with the contraction and extension of the internal spring structure may be advantageously employed. The outer structure or sleeve associated with spring 332 may include an undulating, baffled or accordion configuration, although such configuration is not required. Indeed, the outer structure, e.g., a rubber sleeve or casing, may be stretched over the internal spring when the internal spring is in any one of its possible configurations, i.e., compressed, relaxed/rest or stretched, and the appearance/configuration of the outer structure or sleeve would be influenced thereby, as will be apparent to persons skilled in the art. The outer structure may also encase the inner spring structure, e.g., may be molded therearound.

Thus, spring 332 may confine fluid/air within the outer structure positioned around the internal spring structure of spring segments 334, 336, 338, and the speed/ease with which the spring segments extend and constrict may be controlled by the degree to which fluid/air is permitted to pass therethrough. Thus, it is contemplated that a degree of porosity or fluid/air passage is advantageously incorporated into the outer structure of spring segments 334, 336, 338 to facilitate operation of spring 332 within channel 330. By incorporating greater porosity and/or incorporating additional fluid/air passages, the ease with which spring 332 may extend/constrict is enhanced and, conversely, by limiting/reducing the porosity and/or fluid/air passage volume associated with spring segments 334, 336, 338, the ease with which spring 332 extends/constricts may be reduced. It is further contemplated according to the present disclosure that fluid/air contained within a first spring segment (or segments), e.g., spring segment 338, may be transferred to adjoining spring segment(s) as it is compressed, e.g., by way of communicating passages, tubes or the like.

Thus, in designing shelving systems according to the present disclosure, operative control of the relative vertical positioning of first and second shelves may be controlled, at least in part, by the physical properties imparted to spring 332 (and its counterpart spring associated with upright support 261) as described herein. Indeed, control of the fluid/air within the outer structure or sleeve is the major factor in controlling the speed at which the shelves move according to exemplary embodiments of the present disclosure. In such exemplary embodiments, the elastic properties of the spring within the outer structure or sleeve function mainly to bring the sleeve to its original position after the weight/force of the shelves is removed, e.g., to move the box elements into an appropriate alignment with a wheel.

Box elements 340, 342 are dimensioned and configured to permit wheel/roller 322 to enter therein, i.e., when first shelves 264, 265 are translated horizontally relative to upright supports 261, 262. Box elements 340, 342 advantageously include indentations or other structural feature(s)

that permit wheel 322 (or a wheel-related feature, e.g., a small knob) to be detachably locked therein. By detachably locking wheel 322 within box element 340, 342, the security and stability of first shelves 264, 265 may be enhanced during vertical repositioning.

The combination of upright support, sliding frame and shelf support member is an advantageous subassembly according to the present disclosure. The foregoing combination permits both horizontal and vertical motion of shelves associated therewith. The foregoing subassembly is referred to as a "2D Slide" because of the advantageous two-dimensional sliding or translating functionalities facilitated thereby. Fundamental to a "2D Slide" subassembly acording to the present disclosure is a stationary support element, a structure that facilitates vertical motion (e.g., a sliding frame), and a structure that facilitates telescoping or horizontal translation (e.g., a telescoping shelf support member). It is not necessary to achieve the advantageous horizontal and vertical motions associated with a "2D Slide" subassembly that the shelf support member include support arms or similar shelf support structures. Rather, the shelf may be directly mounted to the structure that facilitates telescoping or horizontal translation, thereby obviating the need for shelf support arms and the like.

In operation, first shelves 264, 265 may be advantageously repositioned relative to second shelves (not pictured) by horizontally sliding the first shelves outward, i.e., out of vertical alignment with the second shelves. Wheels 296, 322 advantageously enter box elements and, in exemplary embodiments of the present disclosure, are detachably locked therein. Spring 332 facilitates downward movement of first shelves 264, 265 by controlling fluid/air passage relative to outer structure or sleeves associated with spring segments 334, 336, 338. In particular, spring segment 334 (which is being extended or stretched) requires fluid/air to enter through the associated sleeve structure, whereas spring segments 336, 338 (which are being compressed) require fluid/air to exit through the associated sleeve structure. As first shelves 264, 265 move downward relative to upright supports 261, 262, the pulley/cable systems automatically effect an opposite motion for the second shelves. Thus, the second shelves move upward. Once the first shelves reach the desired vertical orientation, they may be pushed horizontally inward into alignment with the second shelves, and spring 322 automatically returns to its initial rest position under the bias of internal spring structures associated with spring segments 334, 336, 338.

Turning to further shelving system 375 of FIGS. 19–23, first shelves 376, 377 are initially positioned in an upper position relative to second shelves 378, 379. First shelves are supported by shelf support member 380 that is horizontally and vertically movable with respect to upright support 381. An opposing upright support 382 is positioned opposite upright support 381, and includes a plurality of rectangular openings 383*a–d* to facilitate access to items stored on the first and second shelves. Of note, second shelves 378, 379 may be fixedly positioned relative to upright supports 381, 382, e.g., by way of a fixed shelf support member mounted to upright support 382. Alternatively, a second horizontally and vertically movable shelf support member (not pictured) may be mounted relative to upright support 382, in like manner to the relationship between shelf support member 380 and upright support 381.

In the case where a horizontally and vertically movable shelf support member is mounted relative to both upright supports 381, 382, a pulley/cable system is advantageously provided to translate vertical motion between the two shelf support members. Thus, first pulley wheel 384 and second pulley wheel 385 are rotatably mounted relative to upright supports 381, 382, respectively, and synchronizing bar 388 extends therebetween. First cable 386 is mounted to shelf support member 380 and to first pulley wheel 384. Second cable 387 is mounted to the shelf support member associated with second shelves 378, 379 and to second pulley wheel 385. Of note, the manner of attachment of first and second cables 386, 387 to first and second pulley wheels 384, 385 is such that clockwise motion of pulley wheels 384, 385 and synchronizing rod 388 effects extension of one cable and uptake of the other cable, whereas counter-clockwise motion of the pulley wheels and synchronizing bar has the opposite effect on the cables. Thus, downward vertical motion of first shelves 376, 377 is automatically translated to an equal and opposite upward vertical motion of second shelves 378, 379.

Figure 22:
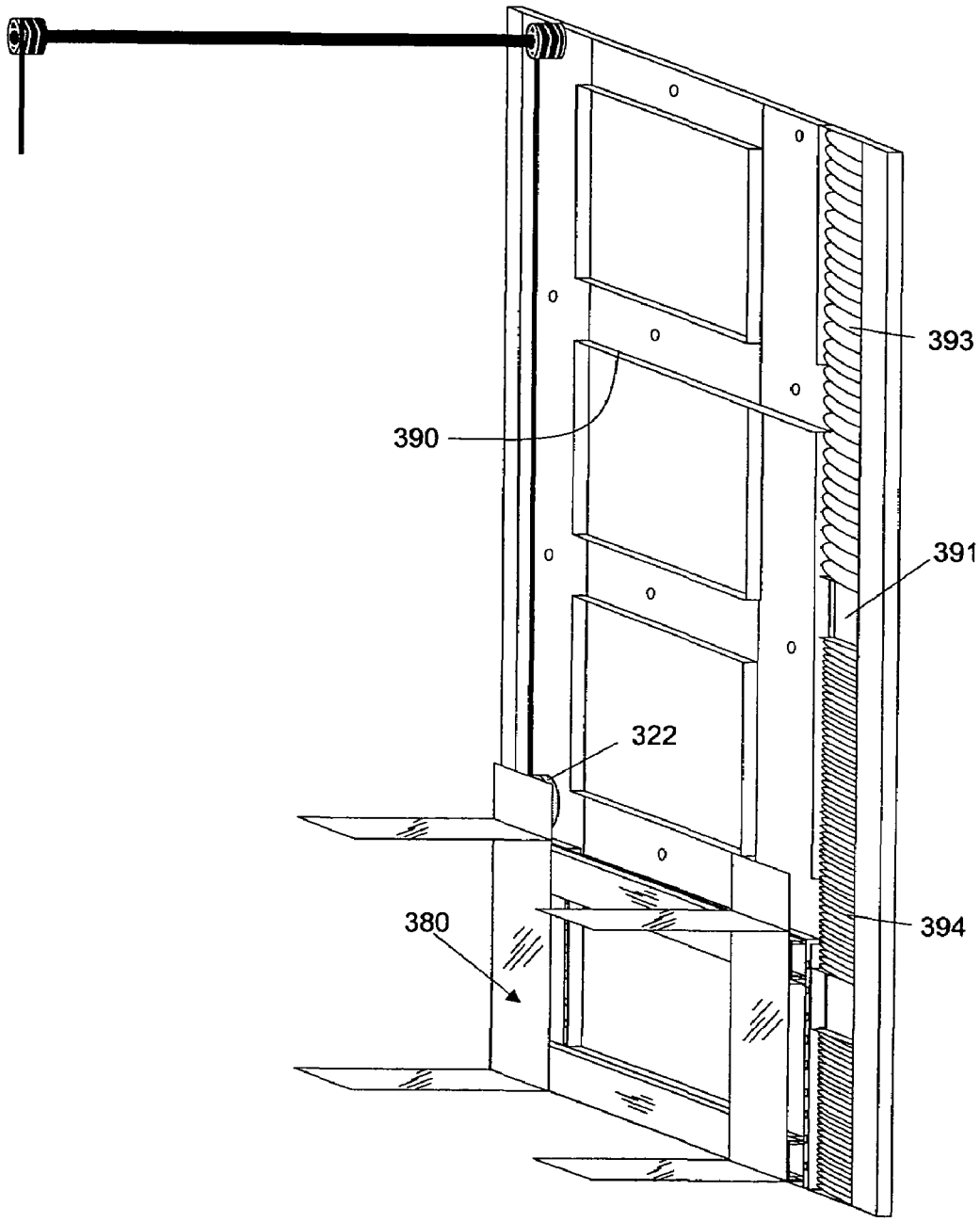

A wheel 389 is associated with shelf support member 380 and travels horizontally along a rail 390 formed on upright support 381 into box element 391 included within spring 392 and surrounded by spring segments 393, 394. The design and operation of spring 392 is generally the same as spring 330 described above with reference to FIGS. 17–18. Thus, wheel 389 may be detachably secured within box element 391 and vertically transported downward through compression of spring segment 394 and extension of spring segment 393. Once shelf support member 380 reaches the lower orientation of FIG. 21, wheel 389 aligns with rail 395 formed on upright support 381, which facilitates inward travel of wheel 389. Of note, rail 395 does not extend to the region of spring 392, thereby permitting unimpeded downward vertical motion of shelf support member 380. As shown in FIG. 22, shelf support member 380 may then be pushed horizontally inward. Although not shown, it will be appreciated that the pulley/cable systems result in an equal and opposite upward movement of the second shelf support member and the second shelves 378, 379 (if "2D Slide" functionality is incorporated into the second shelves).

Figure 23:
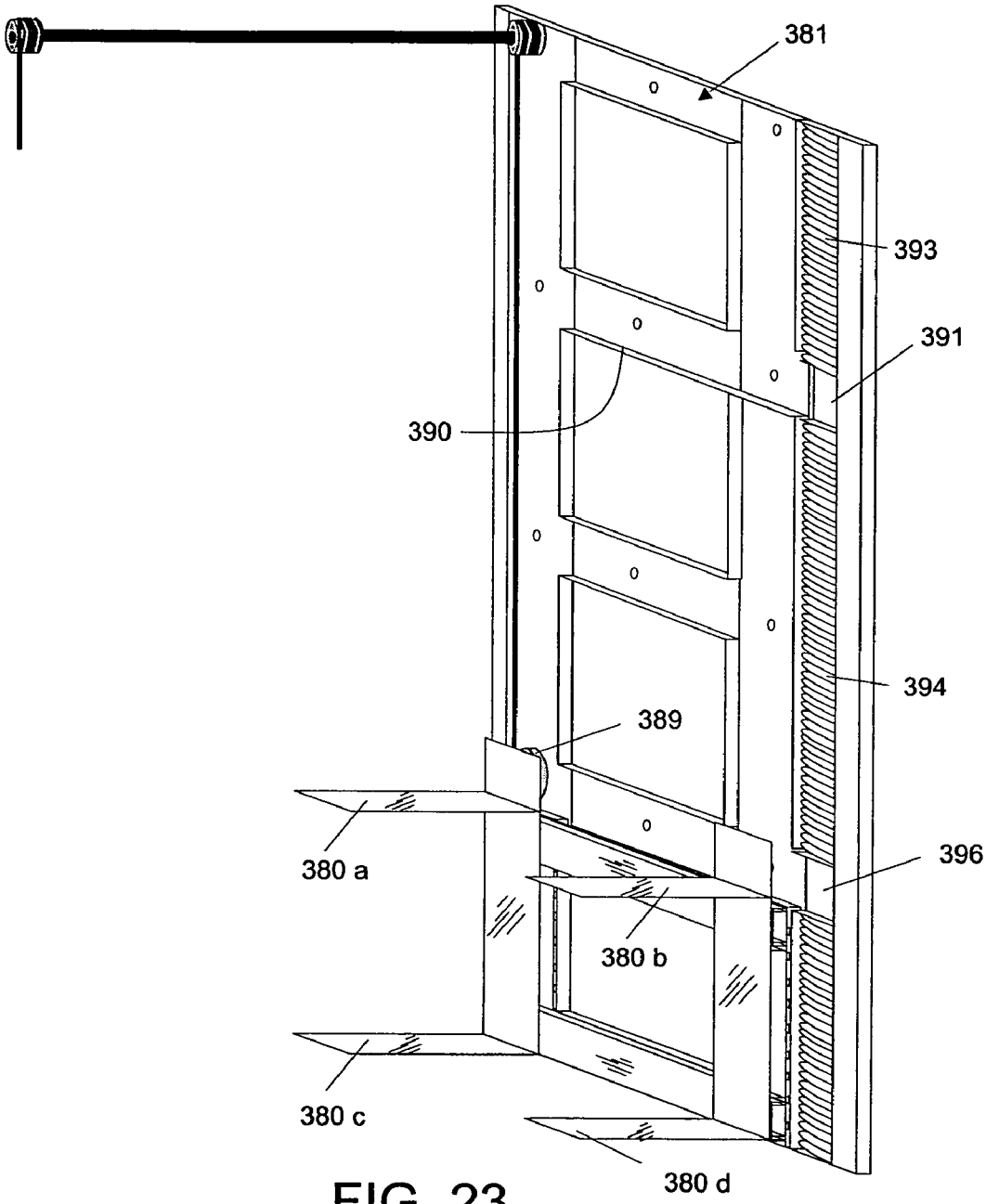

As shown in FIG. 23, after the wheel 389 exits box element 391, spring 392 returns to its initial, unstressed position, thereby readying itself for further repositionings of the first and second shelves. A second box element 396 becomes substantially aligned with lower rail 395 and is positioned for receipt of wheel 389 should it be desired to move first shelves 376, 377 horizontally outward.

With further reference to shelf support member 380, FIGS. 20–23 illustrate the telescoping functionality associated therewith. Of particular note, shelf support member 380 includes support legs 380*a–d* that extend toward the opposite upright support 382 and advantageously support first shelves 376, 377 in a cantilevered fashion. Similarly, the shelf support member associated with upright support 382 (which supports second shelves 378, 379) includes a series of support legs that support second shelves 378, 379 in a cantilevered fashion.

As noted above, the combination of upright support, sliding frame and shelf support member is an advantageous subassembly according to the present disclosure. The foregoing combination permits both horizontal and vertical motion of shelves associated therewith, and is referred to as a "2D Slide" because of the advantageous two-dimensional sliding or translating functionalities facilitated thereby. Fundamental to a "2D Slide" subassembly acording to the present disclosure is a stationary support element, a structure that facilitates vertical motion (e.g., a sliding frame), and a structure that facilitates telescoping or horizontal translation (e.g., a telescoping shelf support member). As noted above, it is not necessary to achieve the advantageous horizontal and vertical motions associated with a "2D Slide" subassembly that the shelf support member include support arms or similar shelf support structures. Rather, the shelf may be directly mounted to the structure that facilitates telescoping or horizontal translation, thereby obviating the need for shelf support arms and the like.

Advantageously, the design and operation of the respective shelf support members in connection with exemplary shelving system 375 permit sequential repositioning of the first and second shelves based on horizontal motion of the shelves located in the "upper" (or in the "lower") position, as may be desired by the user. Thus, when horizontal motion is directed to the "upper" shelves, the sequence will initially involve horizontal motion of first shelves 376, 377, then second shelves 378, 379, then first shelves 376, 377, etc. In other words, vertical repositioning of the first and second shelves may be advantageously achieved by outward movement of the first shelves when they are in the upper position, and outward movement of the second shelves when they are in the upper position, rather than limiting the outward movement to either the first or the second shelves. Similarly, the horizontal motion may be limited to shelves that are in the "lower" position. The advantageous ability to vertically reposition shelves/shelving units according to the foregoing sequential operation, which effectively establishes a clockwise or counter-clockwise movement of the first and second shelves as they are vertically repositioned relative to each other, is common to shelving units referred to as the "Patanosta" family of products.

According to the foregoing exempary shelving system, the contents of the first and second shelves are advantageously repositioned to permit ease of access thereto, as will be apparent to persons skilled in the art. Of note, the design and operation of exemplary shelving system 375 permits multiple shelving members to be moved downward at the same time multiple shelving members are simultaneously and automatically moved upward, thereby greatly enhancing the efficiencies associated with access to products/items stored thereon or therein.

Turning to FIGS. 24–29, a further exemplary shelving system 400 is schematically depicted according to the present disclosure. Shelving system 400 is encompassed within an enclosure 410, e.g., an armoire, cabinet, refrigerator/freezer or the like. In all other material respects, shelving system 400 corresponds in structure and function to shelving system 260 described with reference to FIGS. 17–19. Thus, first shelves 402, 404 and second shelves 406, 408 are adapted for vertical repositioning relative to each other. First shelves 402, 404 are movably mounted relative to enclosure 410 by telescoping beams 412*a*, 412*b*, 414*a*, 414*b*, which permit horizontal motion. Pulley systems are provided to translate vertical motion between first shelves 402, 404 and second shelves 406, 408 (see, e.g., pulley system 416).

Figure 25:
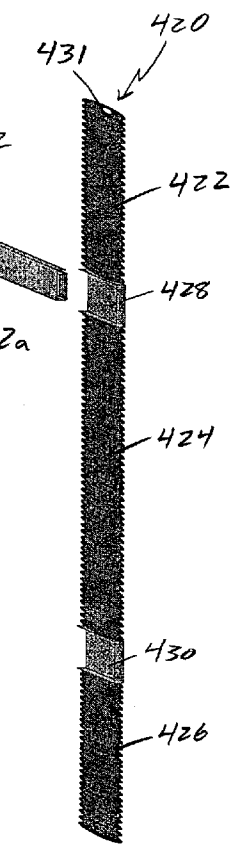
FIGS. 25, 27 and 29 are cut-away perspective views of structural aspects of the sixth exemplary embodiment of FIGS. 24, 26 and 28.
Figure 24:
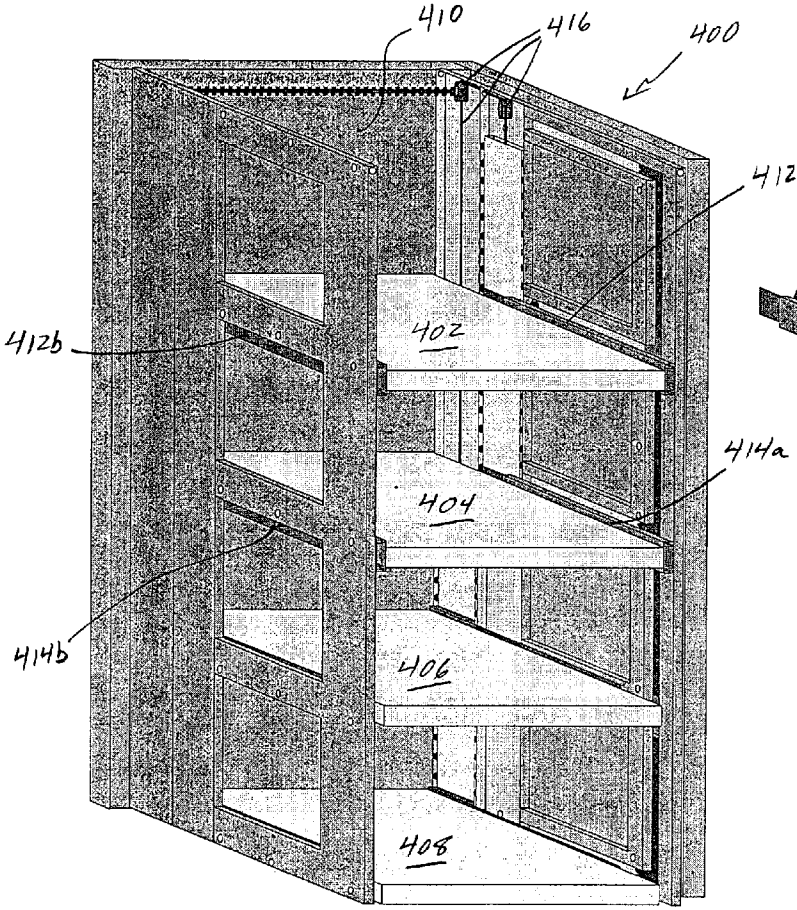
FIGS. 24, 26 and 28 are perspective schematic views of a sixth exemplary shelving system according to the present disclosure.
Figure 27:
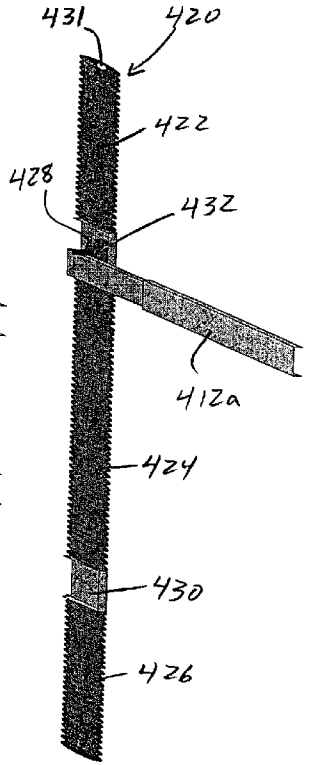
Figure 26:
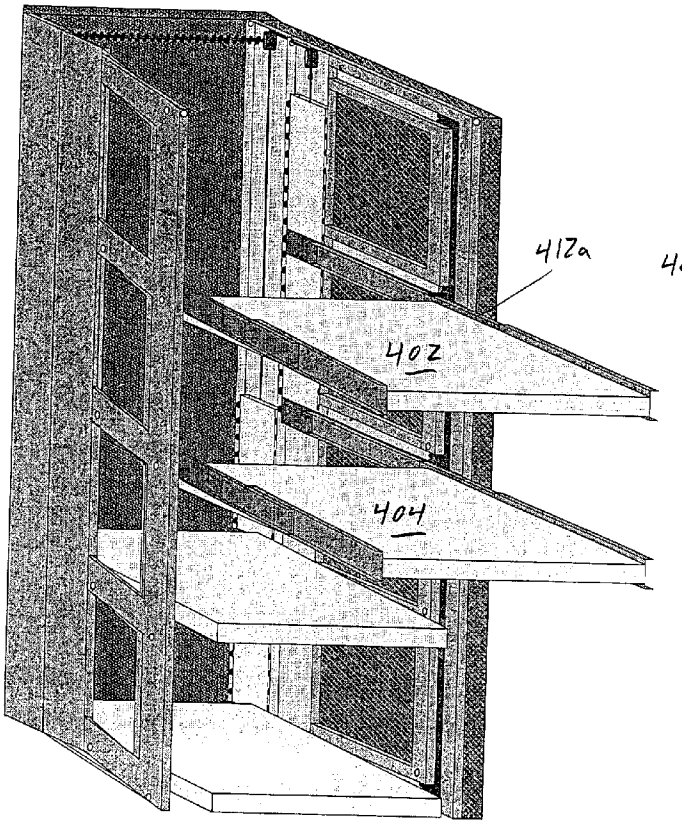
Figure 29:
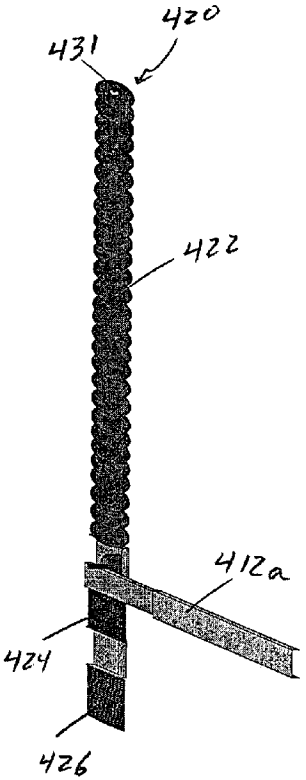

With particular reference to FIGS. 25, 27 and 29, spring 420 includes first, second and third spring segments 422, 424, 426, and box elements 428, 430. Apertures are provided at the top and bottom of first and third spring elements 422, 426, respectively (see, e.g., aperture 431 formed in first spring element 422), to facilitate attachment of spring 420 relative to enclosure 410, e.g., by screws, bolts or the like. Wheel 432 associated with telescoping beam 412*a* is initially adapted to enter box element 428 and become detachably locked therewithin. FIGS. 26 and 27 show the position of first shelves 402, 404 when the first sleeves have been moved horizontally outward and wheel 432 has assumed a detachably locked orientation with respect to box element 428. Of note, in the schematic views of FIGS. 24, 26, 28, spring 420 is not visible because it is positioned behind facing structures associated with enclosure 410. However, according to exemplary embodiments of shelving system 400, spring 420 is positioned within a channel formed in the side wall of enclosure 410, comparable in design and dimension to the channels described with reference to shelving system 260 above.

Figure 28:
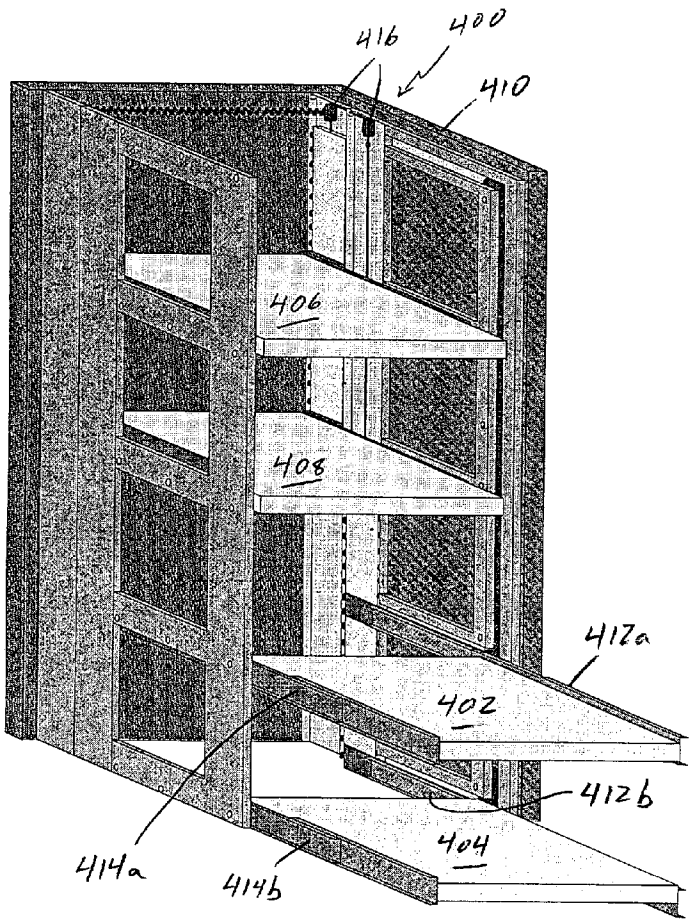

Turning to FIGS. 28 and 29, first shelves 402, 404 are schematically depicted in a lower position whereas second shelves 406, 408 are shown in a higher position. Relative vertical motion of the first and second shelves is facilitated, at least in part, by the clearance established between the first and second shelves by the outward horizontal movement of the first shelves 402, 404 relative to enclosure 410. In addition, downward vertical motion of first shelves 402, 404 is automatically translated to an equal and opposite upward movement of second shelves 406, 408 by the pulley systems associated with shelving system 400, e.g., pulley system 416. In the position of FIG. 29, first spring segment 422 is extended or elongated, whereas second and third spring segments 424, 426 are constrained or compressed. Physical attributes imparted to first, second and third spring segments 422, 424, 426, e.g., porosity, fluid/air passages and the like, permit relative control of the dampening properties and functionality of spring 420. In addition, one or more counterweights may be associated with the first and/or second shelving units to further militate against uncontrolled movements thereof.

The exemplary shelving system of FIGS. 24–29 advantageously include an upright support, sliding frame and shelf support member combination that permits both horizontal and vertical motion of shelves associated therewith, and therefore includes a "2D Slide" subassembly, as discussed above.

Once first shelves 402, 404 have been lowered to the position of FIG. 28 (and second shelves 406, 408 have traveled upward based on the translational functionality associated with the pulley systems and associated structures), first shelves 402, 404 may be advantageously pushed inward, thereby returning telescoping beams 412*a*, 412*b*, 414*a*, 414*b* to their respective non-telescoped orientation. Thus, first shelves 402, 404 effectively assume the vertical orientation initially occupied by second shelves 406, 408, and vice versa. Through the easy, efficient and safe repositioning of the first and second shelves, as described herein, shelving system 400 offers advantageous access to products/items stored by shelving system 400.

Figure 30:
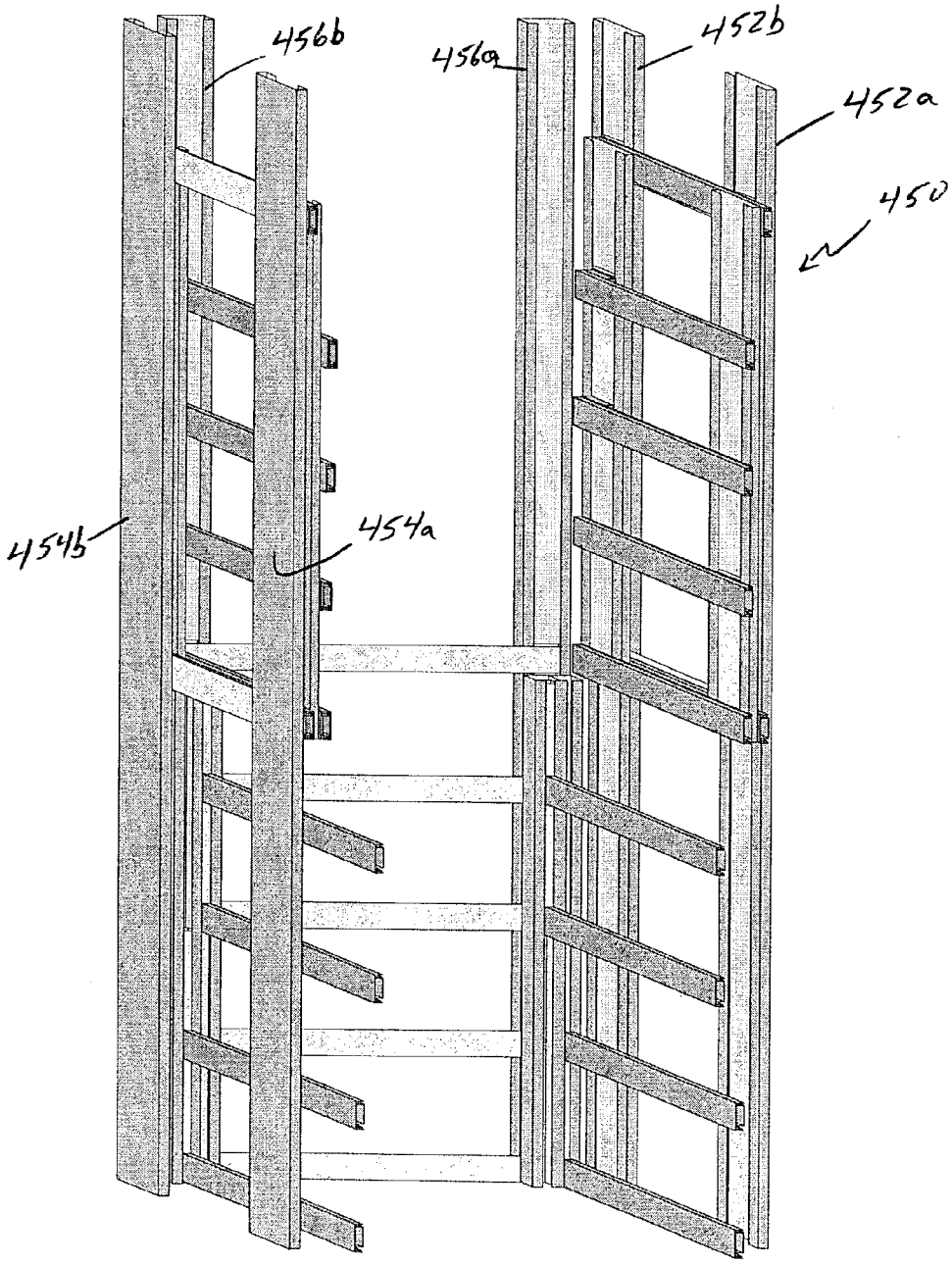
FIG. 30 is a perspective schematic view of the structural aspects of a seventh exemplary shelving system according to the present disclosure.
Figure 31:
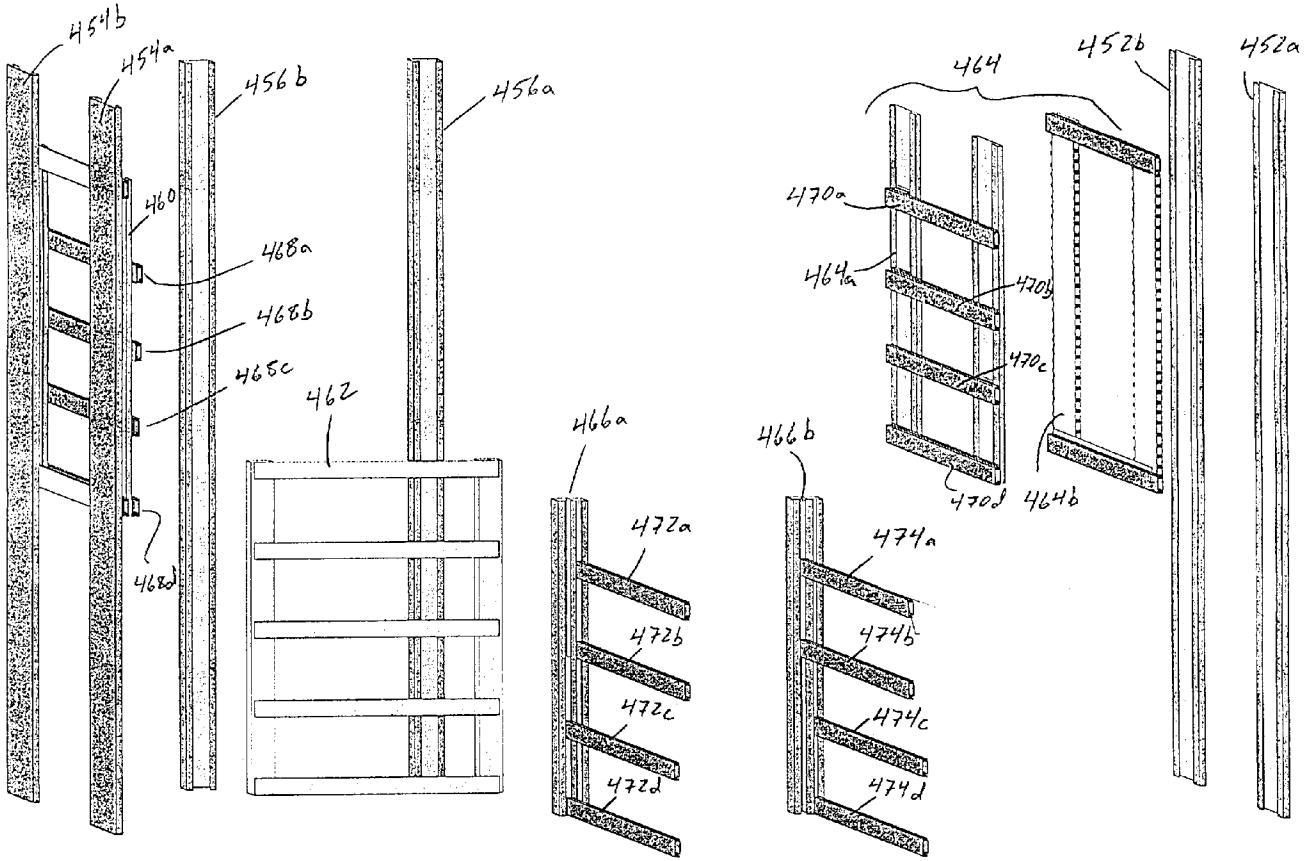
FIG. 31 is a schematic exploded view of certain components of the seventh exemplary shelving system of FIG. 30.

Turning to FIGS. 30–31, a further exemplary shelving system 450 includes first side supports 452*a*, 452*b*, second side supports 454*a*, 454*b*, and rear supports 456*a*, 456*b*. Each of the foregoing supports includes an elongated slot that cooperates with sliding frames that facilitate vertical motion of such sliding frames. Thus, side supports 454*a*, 454*b* facilitate vertical motion of sliding frame 460, rear supports 456*a*, 456*b* facilitate sliding motion of sliding frame 462, and side supports 452*a*, 452*b* facilitate vertical motion of sliding frame 464, which includes shelf support member 464*a* and support brace 464*b*. Sliding frame 462 supports a pair of spaced translating uprights 466*a*, 466*b*, each of which includes a pair of elongated slots.

Telescoping shelf support arms are associated with each of the foregoing vertically translating structures. Thus, sliding frame 460 supports four spaced telescoping arms 468*a–d*, and sliding frame 464 supports four telescoping arms 470*a–d*. Similarly, translating uprights 466*a*, 466*b* support telescoping arms 472*a–d* and 474*a–d*, respectively.

Telescoping arms 472*a*, 472*b* travel in the inner elongated slot formed in translating upright 466*a*, whereas telescoping arms 472*c*, 472*d* travel in the outer elongated slot. With reference to translating upright 466*b*, telescoping arms 474*a*, 474*b* travel in the inner elongated slot, whereas telescoping arms 474*c*, 474*d* travel in the outer elongated slot.

In use, opposing telescoping arms cooperate to support individual shelves. Thus, for example, telescoping arm 468*a* cooperates with telescoping arm 470*a* to support a shelf, and telescoping arm 472*a* cooperates with telescoping arm 474*a* to support a shelf. Based on the free movement of the various vertically translating structures within the associated elongated slot, substantial flexibility is provided in repositioning of shelves according to exemplary shelving system 450. For example, sliding frame 462 permits the four shelves associated with translating uprights 466*a*, 466*b* to be vertically repositioned. Moreover, the elongated slots associated with translating uprights 466*a*, 466*b* permit the pairs of shelves associated therewith to be vertically repositioned relative to each other. Pulley/cable mechanisms and synchronizing rods may be provided to coordinate motions of opposed structures, as discussed above with reference to other exemplary shelving systems according to the present disclosure. Exemplary shelving system 450 advantageously permits vertical repositioning of shelves (in response to horizontal motions creating required clearance), thereby enhancing access to items stored or positioned thereon.

Figure 32:
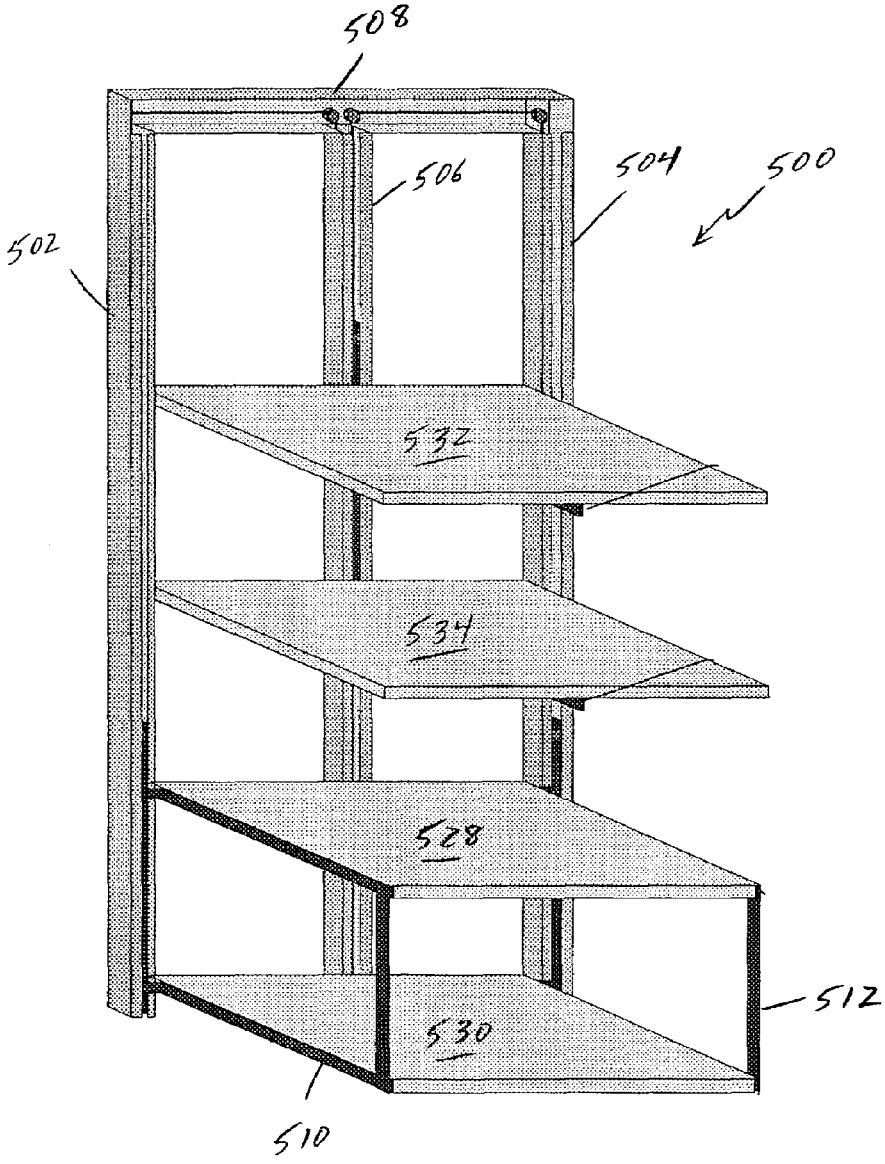
FIG. 32 is a perspective schematic view of a further exemplary shelving system according to the present disclosure.
Figure 33:
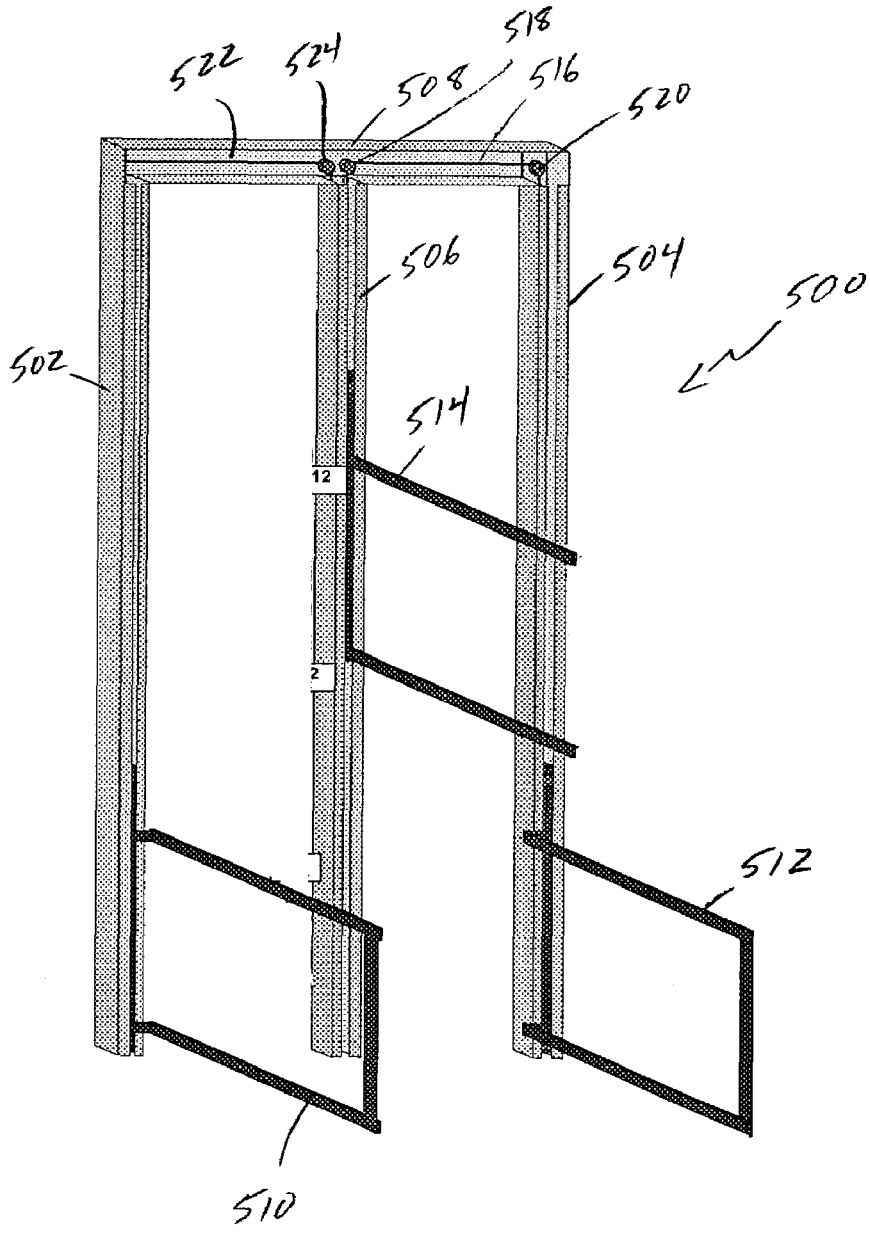
FIG. 33 is a perspective, partially cut away, view of the exemplary shelving system of FIG. 32.

With reference to FIGS. 32 and 33, a further exemplary shelving system 500 according to the present disclosure is schematically depicted. Shelving system 500 includes outer upright supports 502, 504 and central upright support 506. A brace 508 extends across the top of upright supports 502, 504, 506 and provides structural stability thereto. Each of the foregoing upright supports includes an elongated slot that cooperates with a vertically translatable shelf support member. Thus, outer upright support 502 cooperates with a substantially rectangular shelf support member 510 and outer upright support 504 cooperates with substantially rectangular shelf support member 512. A substantially U-shaped shelf support member 514 is associated with central upright support 506 and cooperates with the elongated slot formed therein.

A pair of pulley/cable mechanisms are provided as part of shelving system 500. Thus, cable 516 cooperates with pulley wheels 518, 520 to translate motion between shelf support members 512, 514. Similarly, cable 522 cooperates with pulley wheels 524 (other pulley wheel not visible) to translate motion between shelf support members 510, 514. Shelf support members 510, 512 advantageously telescope with respect to upright supports 502, 504, thereby permitting shelves 528, 530 to be moved horizontally outward, at which point a clearance is created relative to shelves 532, 534. Thus, shelves 528, 530 may be vertically repositioned relative to shelves 532, 534, and then pushed horizontally inward to reassume a stacked orientation relative to shelves 532, 534. The pulley/cable systems automatically translate the upward vertical motion of shelves 528, 530 to a corresponding downward motion of shelves 532, 534. Thus, exemplary shelving system permits efficient and safe access to items stored on shelves 528, 530, 532, 534.

Figure 36:
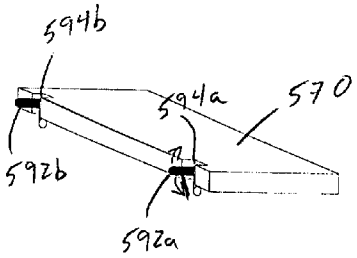
FIG. 36 is a perspective schematic view of an exemplary component of the shelving system of FIGS. 34–35.
Figure 34:
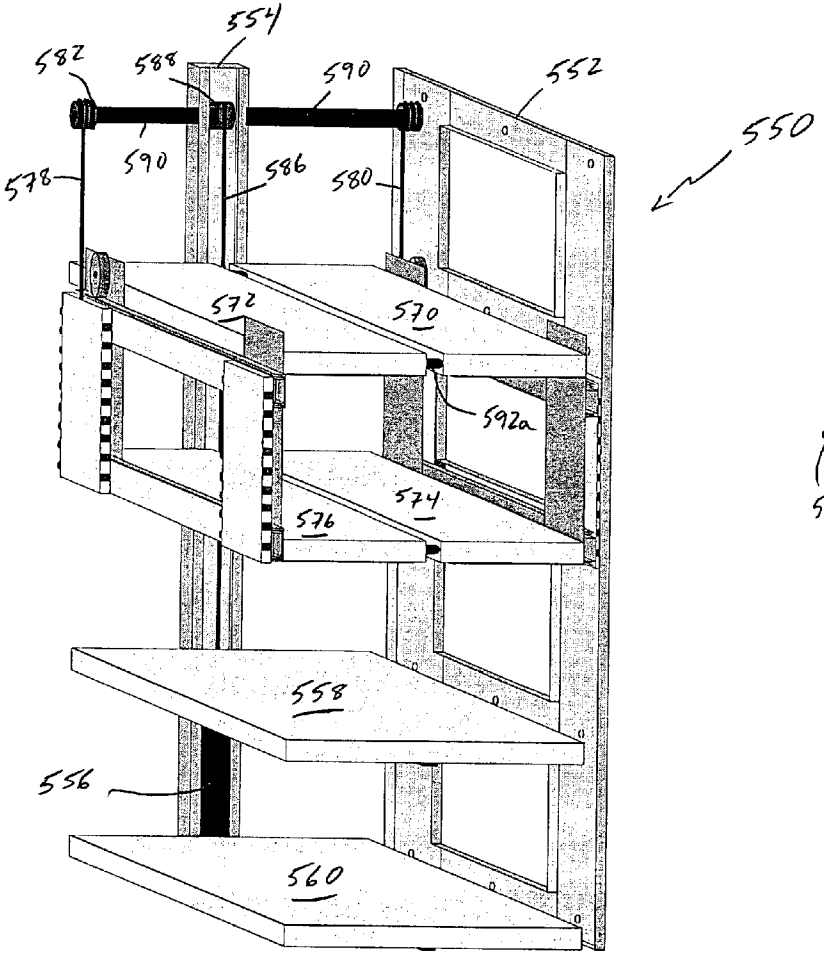
FIG. 34 is a perspective schematic view of a ninth exemplary shelving system according to the present disclosure.
Figure 35:
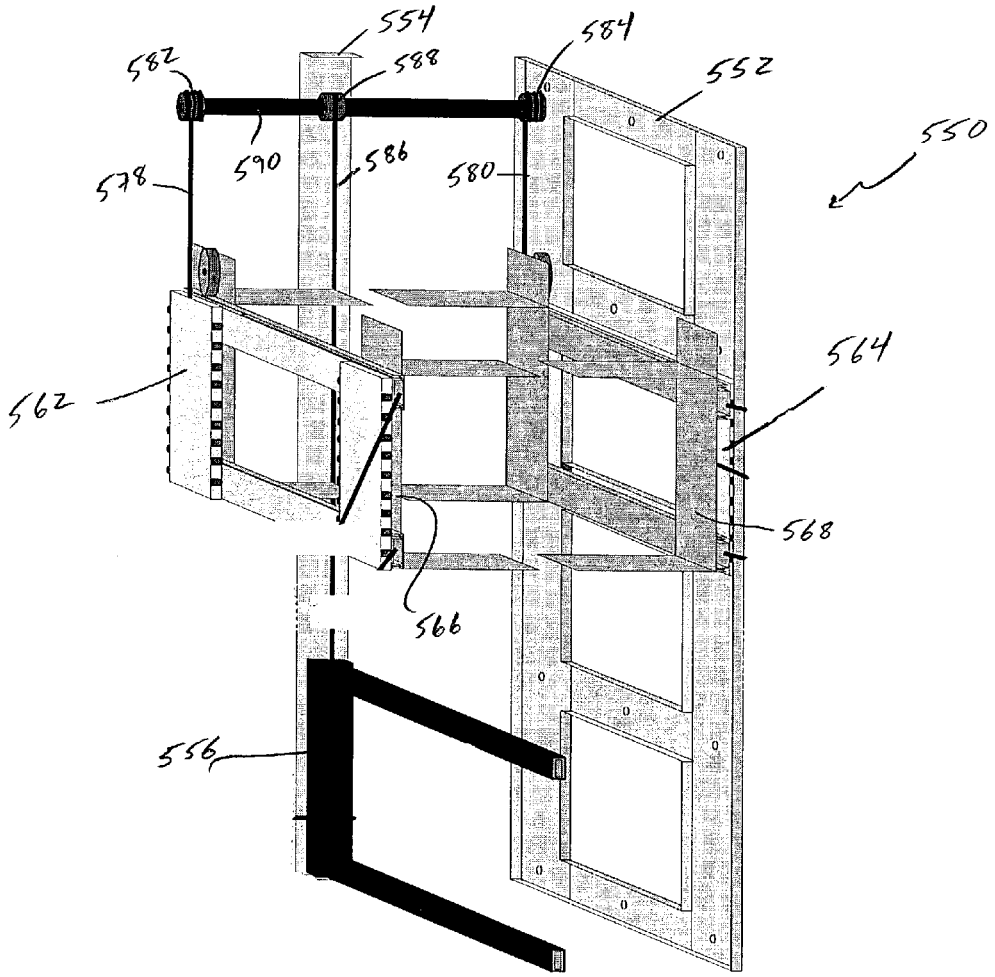
FIG. 35 is a schematic partially cut away view of the exemplary shelving system of FIG. 34.

Turning to FIGS. 34–36, exemplary shelving system 550 is depicted, which includes opposing outer upright supports 552 (opposite upright support is omitted for clarity) and a central upright support 554. With particular reference to FIG. 35, telescoping U-shaped shelf support member 556 cooperates with an elongated slot formed in central upright support 554. First shelves 558, 560 are supported by shelf support member 556 and are adapted for horizontal motion relative to central upright support 554 based on the telescoping functionality associated therewith. A pair of sliding frames 562, 564 are associated with the opposed outer upright supports (e.g., upright support 552). Sliding frames 562, 564 cooperate with shelf support members 566, 568, respectively, which are adapted for horizontal motion relative to the upright supports based on telescoping slides associated therewith.

Each of shelf support members 566, 568 define four inwardly directed support arms, and pairs of such inwardly directed arms are adapted to support shelf portions. Thus, opposing shelf portions 570, 572 are positioned on the upper support arms associated with shelf support members 568, 566, respectively. Similarly, shelf portions 574, 576 are supported by the lower support arms associated with shelf support members 568, 566, respectively. Gaps are defined between opposing shelf portions. The gaps are sized and configured to permit passage of the outwardly extending arms of shelf support member 556 therethrough. Thus, the foregoing gaps permit vertical repositioning of shelf portions 570, 572, 574, 576 relative to shelves 558, 560.

Pulley/cable systems are provided to automatically translate motion between the respective shelves/shelf portions. Thus, as cables 578, 580 are drawn upward, i.e., wrapped around uptake wheels 582, 584, respectively, cable 586 is extended from central uptake wheel 588 (based on a reverse winding thereof). Conversely, cables 578, 580 are let out as cable 586 is drawn in. Synchronizing rod 590 coordinates the motions therebetween.

With reference to FIG. 36, one or more of the shelf portions may advantageously include alignment pin(s) to align opposed shelf portions. Thus, as shown in FIG. 36, alignment pins 592*a*, 592*b* are pivotally mounted within slots 594*a*, 594*b* formed in shelf portion 570. Pins 592*a*, 592*b* are adapted to pivot from the depicted horizontal orientation to a non-horizontal orientation to permit passage of outwardly extending elements of shelf support member 556 therethrough. Once the passage is complete, pins 592*a*, 592*b* are generally spring biased to resume their initial horizontal orientation. Of note, pins 592*a*, 592*b* are generally adapted to pivot both upward and downward, depending on the direction of travel of shelf support member relative to the shelf portions.

The combination of upright support, sliding frame and shelf support member in exemplary shelving system 550 permits both horizontal and vertical motion of shelves and includes "2D Slide" functionality. Indeed, as required for a "2D Slide" subassembly, shelving system 550 includes a stationary support element, a structure that facilitates vertical motion (e.g., a sliding frame), and a structure that facilitates telescoping or horizontal translation (e.g., a telescoping shelf support member).

In use, either shelves 558, 560 or shelf portions 570, 572, 574, 576 may be moved horizontally outward, as described above with reference to telescoping structures and sliding frames associated with other exemplary shelving systems of the present disclosure. Once horizontally repositioned, the vertical positioning of the shelves and shelf portions may be reversed, with the pulley/cable systems automatically translating vertical motion therebetween. Moreover, exemplary shelving system 550 advantageously falls within the Patanosta family of products because vertical repositioning of the first and second shelves may be advantageously achieved by outward movement of the first shelves when they are in the upper position, and outward movement of the second shelves when they are in the upper position, rather than limiting the outward movement to either the first or the second shelves. Similarly, the horizontal motion may be limited to shelves that are in the "lower" position. Thus, exemplary shelving system 550 advantageously permits vertical repositioning of shelves/shelving units by way of a substantially clockwise or counter-clockwise movement of the first and second shelves.

Figure 37:
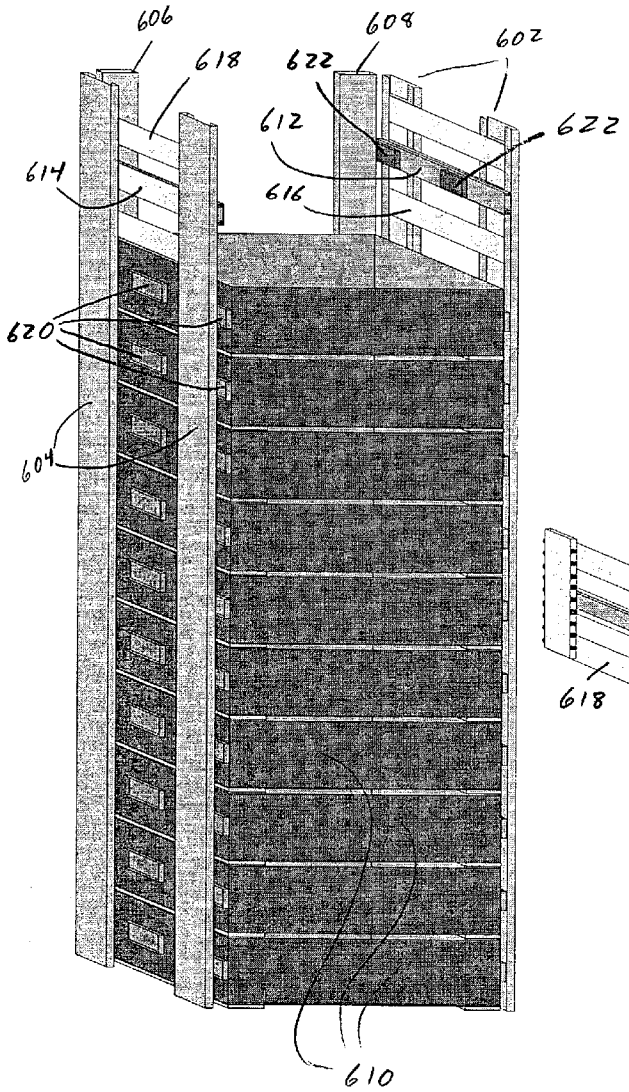
FIG. 37 is a perspective schematic view of a tenth exemplary shelving system according to the present disclosure.
Figure 38:
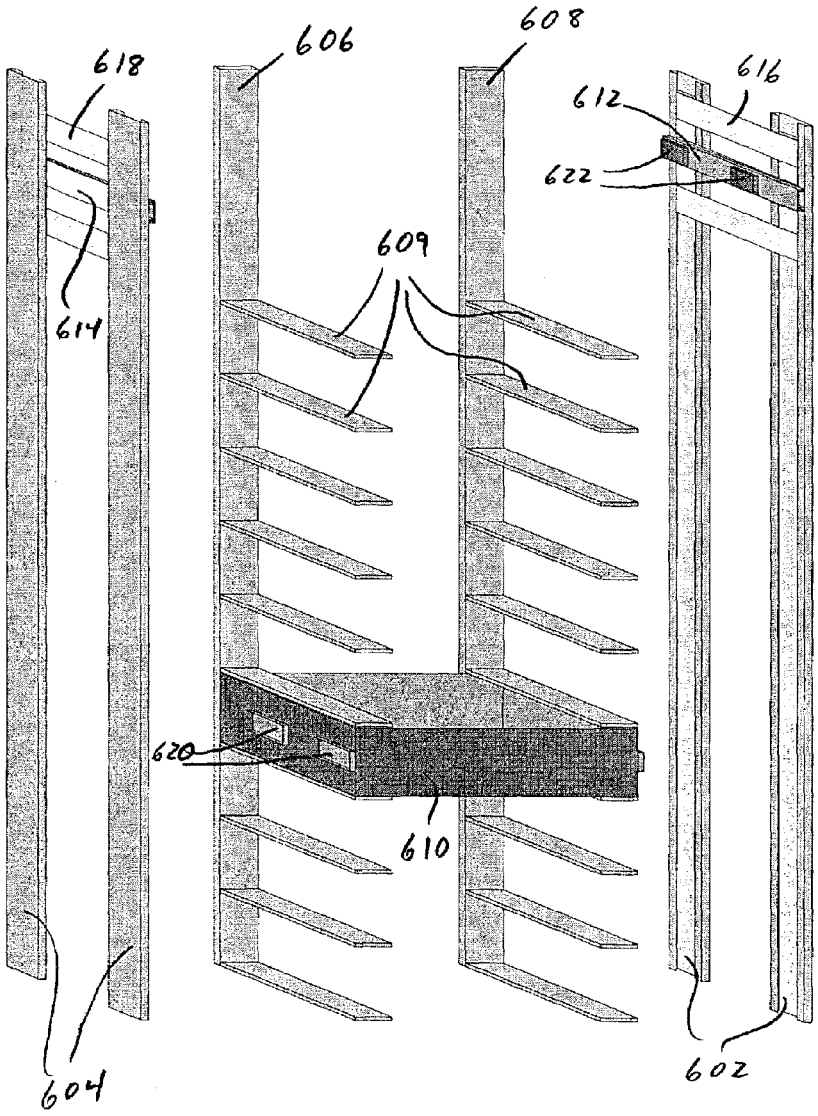
FIG. 38 is a schematic exploded view of the exemplary shelving system of FIG. 37.

With reference to FIGS. 37 and 38, a further exemplary shelving system 600 according to the present disclosure is schematically depicted. Shelving system 600 includes opposing upright supports 602, 604 and rear supports 606, 608 that support a plurality of drawers 610. Shelf support arms 609 extend outwardly from rear supports 606, 608 to support the individual drawers 610 (see FIG. 38). A pair of opposing, telescoping movable arms 612, 614 are movably mounted with respect to upright supports 602, 604 through cooperation with sliding frames 616, 618, respectively. The sliding frames slidably move along the vertical axis within channels formed within upright supports 602, 604, and typically include wheels or ball bearings to facilitate such vertical motion.

Figure 37A:
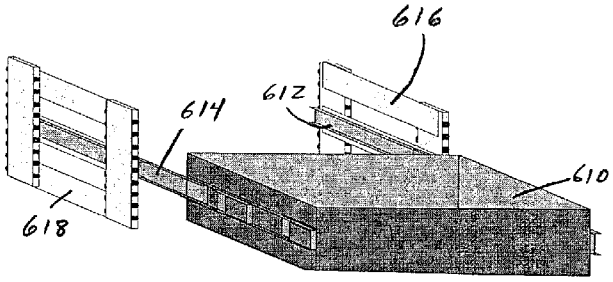
FIG. 37A is a perspective schematic view of a structural component of the exemplary shelving system of FIG. 37.

Telescoping movable arms 612, 614 define substantially beam-like structures that are typically oriented horizontally, as depicted in FIGS. 37 and 37A. Cooperating structures are defined on the inward faces of movable arms 612, 614 and the opposing outward faces of drawers 610 that permit movable arms to selectively engage an individual drawer 610 for horizontal motion relative to upright supports 602, 604. In exemplary shelving system 600, the cooperating structures that permit selective engagement of the movable arms with individual drawers take the form of inwardly directed spaced blocks formed on the movable arms and outwardly directed channels formed on the drawers that are adapted to receive and engage such spaced blocks. Thus, with reference to FIGS. 37 and 38, a pair of outwardly directed channels 620 are formed on each side of individual drawers 610, and a pair of spaced blocks 622 face inwardly from the telescoping movable arms 612, 614. Alternative designs, numbers and orientations of cooperating structures may be implemented, as will be apparent to persons skilled in the art.

Through horizontal movement of movable arms 612, 614 relative to an individual drawer 610, spaced blocks 622 are brought into engagement with channels 620. Thus, as shown in FIG. 37A, telescoping functionality associated with movable arms 612, 614 permit drawer 610 to be moved horizontally outward from the drawer stack support by shelving system 600. Once outwardly positioned, the drawer 610 may be moved vertically to a desired elevation based on the translation of sliding frames 616, 618 relative to upright supports 602, 604. Once interaction with the vertically translated drawer 610 is complete, such drawer may be advantageously returned to its initial position within the drawer stack and the movable arms 612, 614 may be disengaged from such drawer 610. The operation of sliding frames 616, 618 and movable arms 612, 614 may be controlled by a processor and associated software drivers, by mechanical means and/or manually by a user. Thus, it is contemplated according to the present disclosure that appropriate software program(s) may be developed to permit selection of a desired drawer 610 from the drawer stack based on minimal command(s), e.g., key strokes and/or buttons associated with a control panel.

Figure 39:
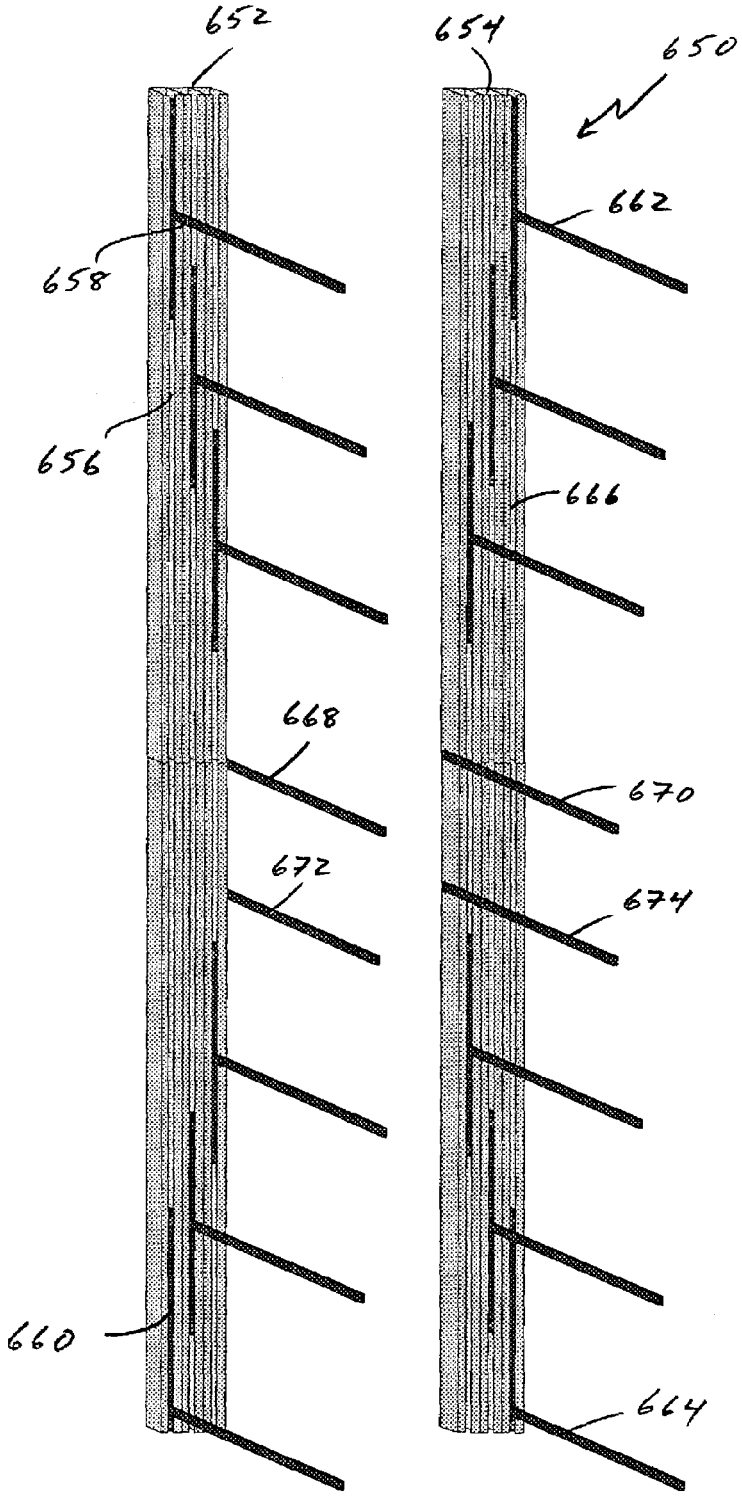
FIG. 39 is a perspective schematic view of an eleventh exemplary shelving system according to the present disclosure.

Turning to FIG. 39, a further exemplary shelving system 650 is depicted which includes rear upright supports 652, 654. Each of the rear upright supports 652, 654 define three spaced, elongated slots. A pair of telescoping shelf support members advantageously travel in each elongated slot. Thus, with reference to outer slot 656 defined in upright support 652, telescoping upper shelf support member 658 and telescoping lower shelf support member 660 travel therewithin. A cooperative pair of telescoping shelf support members, i.e., upper shelf support member 662 and lower shelf support member 664. travel in the outer slot 666 formed in upright support 654. Each of the foregoing cooperative pairs of shelf support members are adapted to support a single shelf (not pictured) and facilitate horizontal and vertical movement thereof with respect to supports 652, 654. Fixed shelf support members 668, 670, 672, 674 are formed in the central region of rear upright supports 652, 654, e.g., at or near elbow and/or eye level.

In use, the telescoping functionality associated with the shelf support members permit individual shelves to be moved horizontally outward to establish clearance relative to the shelf stack. In this horizontally displaced position, the shelf may be moved upward or downward to a desired location. Multiple shelves may be simultaneously horizontally extended and moved vertically, provided the simultaneously extended shelves are not brought into contact with each other. Thus, for example, an upper shelf associated with shelf support members 658, 662 may be brought downward into alignment with a shelf associated with fixed shelf support members 668, 670, while simultaneously a shelf associated with shelf support members 660, 664 may be brought upward into alignment with fixed shelf support members 672, 674. Thus, exemplary shelving system 650 offers significant flexibility and enhanced utility in storage applications.

Figure 41:
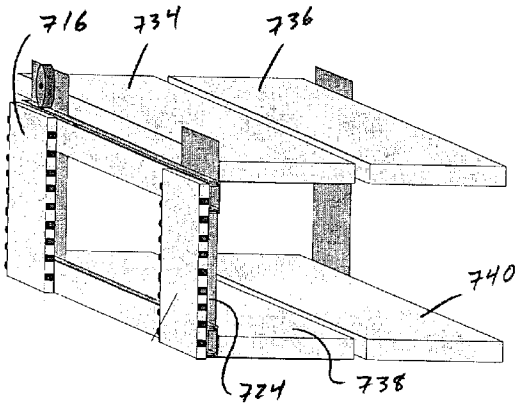
FIGS. 40–42 are perspective schematic views of a twelfth exemplary shelving system and associated components according to the present disclosure.
Figure 42:
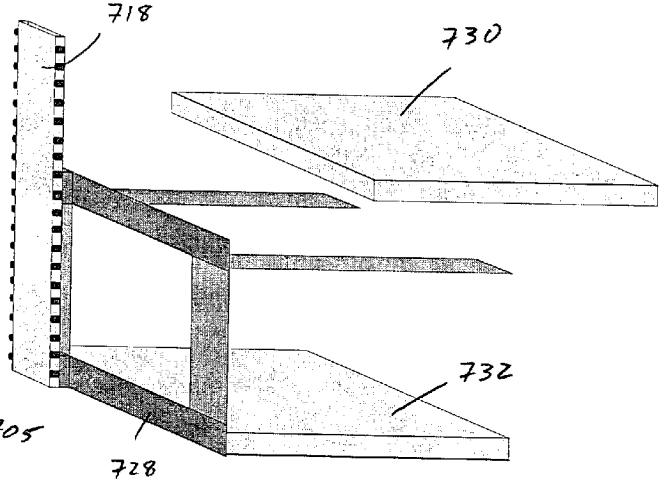
Figure 40:
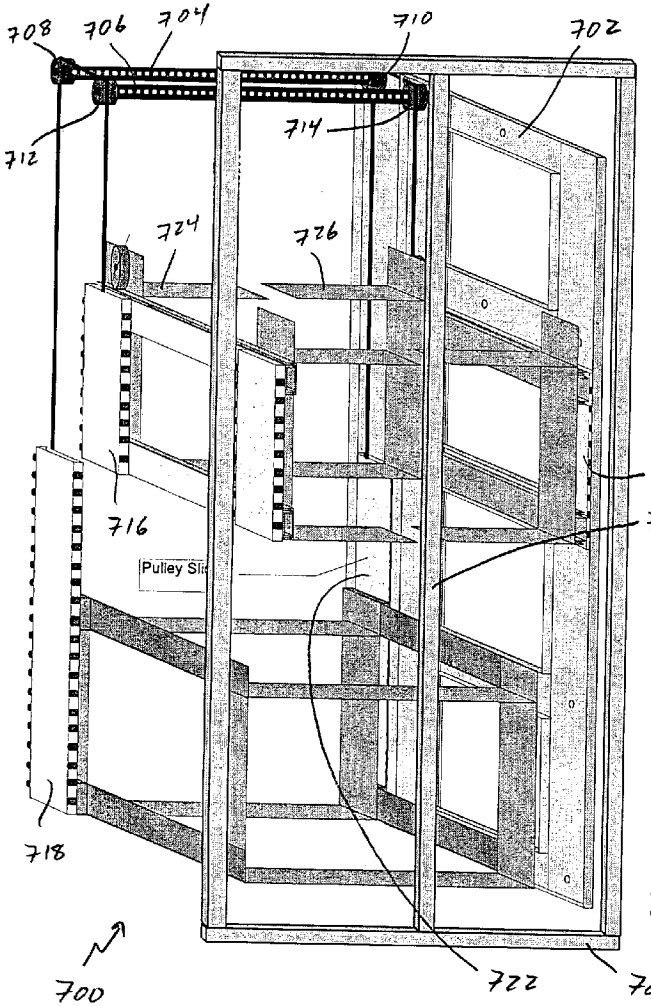

With reference to FIGS. 40–42, exemplary shelving system 700 is similar in structure and operation to exemplary shelving system 260 that is schematically depicted in FIGS. 17–18. Thus, shelving system 700 includes opposing upright supports 702 (opposing upright support is not visible for clarity purposes) that include a plurality of openings or cut-outs facilitating access to products/items stored or positioned on shelves associated therewith. A front frame 705 is provided as part of shelving system 700 that includes a central bar 707 that substantially bisects the rectangular frame 705. Elongated rods 704, 706 synchronize the motion of pulley wheels 708, 710 and pulley wheels 712, 714, respectively. Cables cooperate with the pulley wheels to translate motion between sliding frames 716, 718, 720, 722. Spacer(s) may be mounted or incorporated into the design of the sliding frames to ensure sufficient clearance between shelves as they travel vertically relative to each other.

Rails or other cooperative structures are formed or mounted to the opposing upright supports to cooperate with wheels or rollers that facilitate horizontal movement of telescoping shelf support members 724, 726. A non-telescoping shelf support member 728 is associated with sliding frames 718, 722 and supports shelves 730, 732. Non-telescoping shelf support member 728 (and the associated shelves) are adapted for vertical motion relative to the upright supports. Vertical motion of shelf support member 728 is automatically translated to a corresponding opposite motion of telescoping shelf support members 724, 726 and the shelves associated therewith by way of the pulley/cable systems.

With further reference to FIGS. 40 and 41, each of telescoping shelf support members 724, 726 include two pairs of support arms that are dimensioned to avoid impact with central bar 707 as they are moved horizontally outward. In other words, the support arms associated with shelf support member 724 and the opposing support arms associated with shelf support member 726 define a gap that is configured and dimensioned to permit central bar 707 to pass therethrough. Shelf portions 734, 736, 738, 740 are similarly dimensioned to cooperate with the foregoing support arms and to maintain a gap that permits passage of central bar 707 therebetween. Exemplary shelving system 700 combines an upright support, sliding frame and shelf support member that permit both horizontal and vertical motion of shelves associated therewith. Accordingly, the foregoing subassembly is referred to as a "2D Slide" because of the advantageous two-dimensional sliding or translating functionalities facilitated thereby.

In operation, shelf portions 734, 736, 738, 740 may be advantageously repositioned relative to shelves 730, 732 by horizontally sliding the shelf portions outward, i.e., out of vertical alignment with shelves 730, 732. In moving shelf portions 734, 736, 638, 740 horizontal outward, central bar 707 advantageously passes within the gap formed therebetween. Once clearance is established relative to shelves 730, 732, vertical repositioning is permitted by vertical translation of sliding frames 716, 720 relative to sliding frames 718, 722. When the shelf portions are in the desired vertical location, they may be advantageously horizontally moved back into vertical alignment with shelves 730, 732. In moving shelf portions back into vertical alignment, central bar 707 again advantageously passes through the gap formed between opposed shelf portions and support arms.

In each of the foregoing exemplary embodiments, it is contemplated that automatic translation of vertical motion between first and second shelves need not automatically occur. Thus, it is contemplated that exemplary shelving systems according to the present disclosure may omit or exclude the pulley systems (or other motion translation mechanisms), such that vertical motion of first shelves is not automatically translated to an equal and opposite vertical motion for the second shelves (and vice versa). It is further contemplated that the translation mechanism may be manually disengaged and/or overridden, such that automatic translation of vertical motion is optional. For example, a clutch mechanism may be incorporated into the pulley mechanism, as would be apparent to persons skilled in the art, to impart additional flexibility to users of the exemplary shelving systems according to the present disclosure. In such circumstances, it may be desirable, for example, to move the first shelves into a position vertically aligned with, but forward of, the second shelves, by moving the first shelves downward (or the second shelves upward, or some combination thereof). Thus, the present disclosure provides shelving systems that offer substantial flexibility in implementation, including the foregoing variations in the presence, absence and/or manual control of translation of vertical/axial motion between shelving units. Moreover, the shelving systems of the present invention facilitate safe usage of storage areas by children and/or handicapped people including wheelchair bound people.

Although the shelving systems disclosed herein have been described with reference to exemplary embodiments thereof, it is apparent that modifications and/or changes may be made to the disclosed systems without departing from the spirit and/or scope of the disclosed invention as defined by the appended claims. For example, it is envisioned and well within the scope of the present invention that the disclosed systems could be modified in such a manner as to increase or decrease the number of shelves associated with individual shelving units, the number of shelving units included within a shelving system, etc. Thus, having described the present invention in detail and with reference to exemplary embodiments thereof, it is to be understood that the foregoing description is not intended to limit the spirit and scope of the invention, as set forth in the claims which follow.

What is claimed is:

1. A shelving system comprising:

(a) a first upright support and a second upright support positioned in a spaced side-by-side relation;

(b) a first shelf support member movably mounted with respect to said first and second upright supports, said first shelf support member being horizontally slidable and vertically translatable with respect to said first and second upright supports;

(c) a second shelf support member movably mounted with respect to said first and second upright supports, said second shelf support member being vertically translatable with respect to said first and second shelf support members;

(d) first shelves supported by said first shelf support member; and (e) second shelves supported by said second shelf support member;

(f) first and second spring members mounted with respect to said first and second upright support members, respectively;

wherein said first shelf support member is adapted to be horizontally slidable such that said first shelves move out of a vertically stacked orientation with respect to said second shelves;

wherein movement of said first shelves along a vertical axis is automatically translated to an opposite movement of said second shelves along said vertical axis; and wherein said first and second spring members include at least three spring segments separated by interpositioned box elements, and wherein said spring segments include an inner spring structure and an outer sleeve element that is adapted to control the rate of air passage therethrough.

2. A shelving system according to claim 1, wherein said first shelves and second shelves are selected from the group consisting of shelving members, hanging rods, drawers, bins and combinations thereof.

3. A shelving system according to claim 1, further comprising first and second pairs of pulleys mounted with respect to said first and second upright supports, and cables cooperating with said first and second pairs of pulleys; wherein said pairs of pulleys and cables automatically translate vertical motion between said first shelves and said second shelves.

4. A shelving system according to claim 1, wherein said second shelf support member is horizontally slidable with respect to said first and second upright supports.

5. A shelving system according to claim 1, wherein said outer sleeve element is fabricated from a material that exhibits sufficient resilience to shrink and extend as said first and second shelves vertically translate with respect to the first and second upright supports.

6. A shelving system according to claim 1, wherein said first shelf support member includes a pair of wheels that facilitate horizontal movement of said first shelf support member with respect to said first and second upright supports, and wherein said box elements are configured and dimensioned to receive said wheels in connection with said horizontal movement.

7. A shelving system according to claim 6, wherein said box elements include structure for detachably locking said wheels therewithin.

8. A shelving system comprising:

(a) at least two upright supports;

(b) a first slide mechanism adapted for horizontal and vertical motion relative to at least one of said at least two upright supports, said first slide mechanism associated with at least one shelf; and (c) a second slide mechanism adapted for horizontal and vertical motion relative to at least one of said at least two upright supports, said second slide mechanism associated with at least one shelf;

wherein said first and second slide mechanisms permit said shelves to be repeatedly repositioned relative to each other in a clockwise or counterclockwise rotational manner.

9. A shelving system according to claim 8, wherein said first slide mechanism is movably mounted relative to a first of said at least two upright supports, and said second slide mechanism is movably mounted relative to a second of said at least two upright supports.

10. A shelving system according to claim 9, wherein said shelves are supported in a cantilevered fashion relative to said first and second slide mechanisms.

11. A shelving system according to claim 8, wherein each of said first and second slide mechanisms includes a sliding frame and one or more telescopic members.

12. A shelving system according to claim 8, wherein said clockwise or counterclockwise rotational movement of said shelves is based on the following repeatable sequence of movements:

sliding horizontally outward relative to said upright supports;

moving vertically in a first direction relative to said upright supports;

sliding horizontally inward relative to said upright supports; and moving vertically in a second direction opposite to said first direction.

13. A shelving system according to claim 8, wherein each of said first and second slide mechanisms is associated with a plurality of shelves.

14. A shelving system according to claim 8, wherein each of said shelves is selected from the group consisting of shelving members, hanging rods, drawers, bins and combinations thereof.

15. A shelving system according to claim 8, wherein said first slide mechanism includes a first sliding frame and one or more telescopic members movably mounted with respect to a first upright support, and a second sliding frame and one or more telescopic members movably mounted with respect to a second upright support, and said second slide mechanism includes a first sliding frame and one or more telescopic members movably mounted with respect to said first upright support, and a second sliding frame and one or more telescopic members movably mounted with respect to said second upright support.

16. A shelving system according to claim 8, further comprising at least one pulley system that translates motion between said first slide mechanism and said second slide mechanism.

17. A shelving system comprising:

(a) at least two upright supports;

(b) at least one slide mechanism movably mounted with respect to said upright supports; said at least one slide mechanism being adapted for both horizontal and vertical motion relative to said upright supports; and (c) a spring system positioned within at least one of said upright supports for dampening movement of said slide mechanism, said spring system including a plurality of spring segments and at least one box element positioned between adjacent spring segments for receiving and vertically translating said at least one slide mechanism relative to said upright supports.

18. A shelving system according to claim 17, wherein said spring system is positioned within a channel formed in said upright support.

19. A shelving system according to claim 17, wherein each of said plurality of spring segments includes an internal spring structure and an outer sleeve structure.

20. A shelving system according to claim 17, wherein said outer sleeve structure is fabricated from a resilient flexible material.

21. A shelving system according to claim 17, wherein said outer sleeve structure possesses an undulating, baffled or accordion configuration.

22. A shelving system according to claim 17, wherein said spring system exerts a spring force on said slide mechanism, and wherein said spring force is related to the degree to which fluid passes through said outer sleeve structure.

23. A shelving system according to claim 17, wherein said slide mechanism includes a wheel element, and wherein said at least one box element is configured and dimensioned to receive said wheel element.

24. A shelving system according to claim 23, wherein said at least one box element is structured to guide said wheel into alignment with a wheel-receiving portion of said box element.

25. A method for repositioning a first shelf relative to a second shelf, comprising:

(a) providing at least two upright supports with the first shelf and the second shelf in an initial position with the first shelf positioned above the second shelf;

(b) moving the first shelf outward relative to the at least two upright supports such that the first shelf can move downward past the second shelf;

(c) moving the first shelf downward relative to the second shelf such that the first shelf assumes a position below the second shelf;

(d) moving the first shelf inward relative to the at least two upright supports;

(e) moving the second shelf outward relative to the at least two upright supports such that the second shelf can move downward past the first shelf; and (f) moving the second shelf downward relative to the first shelf such that the second shelf assumes a position below the first shelf.

26. The method of claim 25, further comprising:

(g) moving the second shelf inward relative to the at least two upright supports.

27. The method of claim 25, wherein the first and second shelves are supported by slide mechanisms that are adapted for horizontal and vertical motion relative to said at least two upright supports.

28. The method of claim 27, wherein a spring system is positioned within at least one of said upright support members to dampen movement of said slide mechanisms.

29. The method of claim 28, wherein the spring system includes a plurality of spring segments and at least one box element positioned between adjacent spring segments for receiving and vertically translating one of said slide mechanisms.

30. The method of claim 25, wherein each of said first and second shelves constitute a plurality of individual shelving units.

31. A method for repositioning a first shelf relative to a second shelf, comprising:

(a) providing at least two upright supports with the first shelf and the second shelf in an initial position with the first shelf positioned below the second shelf;

(b) moving the first shelf outward relative to the at least two upright supports such that the first shelf can move upward past the second shelf;

(c) moving the first shelf upward relative to the second shelf such that the first shelf assumes a position above the second shelf;

(d) moving the first shelf inward relative to the at least two upright supports;

(e) moving the second shelf outward relative to the at least two upright supports such that the second shelf can move upward past the first shelf; and (f) moving the second shelf upward relative to the first shelf such that the second shelf assumes a position below the first shelf.

32. The method of claim 31, further comprising:

(g) moving the second shelf inward relative to the at least two upright supports.

33. The method of claim 31, wherein the first and second shelves are supported by slide mechanisms that are adapted for horizontal and vertical motion relative to said at least two upright supports.

34. The method of claim 33, wherein a spring system is positioned within at least one of said upright support members to dampen movement of said slide mechanisms.

35. The method of claim 34, wherein the spring system includes a plurality of spring and at least one box element positioned between adjacent spring segments for receiving and vertically translating one of said slide mechanisms.

36. The method of claim 31, wherein each of said first and second shelves constitute a plurality of individual shelving units.

* * * * *